US005961284A

United States Patent [19]

Kuriyama et al.

[11] Patent Number: 5,961,284

[45] Date of Patent: Oct. 5, 1999

[54] HIGH STRENGTH HEAT RESISTING CAST STEEL, STEAM TURBINE CASING, STEAM TURBINE POWER PLANT AND STEAM TURBINE

[75] Inventors: Mitsuo Kuriyama, Ibaraki; Masao Shiga; Kishio Hidaka, both of Hitachi; Shigeyoshi Nakamura, Hitachinaka; Yutaka Fukui, Hitachi; Ryo Hiraga, Hitachiota; Nobuo Shimizu, Hitachi; Masao Kawakami, Hitachinaka, all of Japan

[73] Assignee: Hitachi, Ltd., Tokyo, Japan

[21] Appl. No.: 08/701,701

[22] Filed: Aug. 22, 1996

[30] Foreign Application Priority Data

Aug. 25, 1995 [JP] Japan ..... 7-217047

[51] Int. Cl.[6] ..... F01D 1/02; B63H 1/26; C22C 38/18

[52] U.S. Cl. ..... 415/200; 415/216.1; 416/241 R; 60/39.75; 420/69; 420/106; 420/64

[58] Field of Search ..... 415/200, 217.1, 415/216.1; 416/241 R, 241 A; 420/69, 106, 109, 111, 113, 114, 64; 60/39.75

[56] References Cited

U.S. PATENT DOCUMENTS

| | | | |
|---|---|---|---|
| 4,764,225 | 8/1988 | Shankar et al. . | |
| 5,084,238 | 1/1992 | Masuyama et al. | 420/105 X |
| 5,158,745 | 10/1992 | Hasegawa et al. | 420/66 |
| 5,383,768 | 1/1995 | Siga et al. | 416/241 R |
| 5,601,411 | 2/1997 | Usami et al. | 416/241 R |
| 5,749,228 | 5/1998 | Shiga et al. | 416/241 R X |

FOREIGN PATENT DOCUMENTS

| | | |
|---|---|---|
| 2142924 | 8/1995 | Canada . |
| 188995 | 7/1986 | European Pat. Off. . |
| 427301 | 5/1991 | European Pat. Off. . |
| 639691 | 2/1995 | European Pat. Off. . |
| 759499 | 2/1997 | European Pat. Off. . |
| 62-248806 | 10/1987 | Japan . |
| 2-290950 | 11/1990 | Japan . |
| 4-371551 | 12/1992 | Japan . |

OTHER PUBLICATIONS

Patent Abstracts of Japan vol. 95, No. 005, & JP–A–07 118812 (Hitach, Ltd) May 9, 1995 Tables 1–4, col. 8, abstract.

Database WPI, Sec. Ch, Week 9507, Derwent Publs. AN 95–049294 & JP–A–06 330 245 (Nippon Steel) Nov. 1994, Composition Table.

*Primary Examiner*—John E. Ryznic

*Attorney, Agent, or Firm*—Antonelli, Terry, Stout & Kraus, LLP

[57] ABSTRACT

A steam turbine has main components such as rotor shaft exposed to high temperature and intermediate pressure, which are made of a ferritic steel and the main steam temperature and the re-heat steam temperature are 610° C. to 660° C., and a steam turbine power plant employs the turbine. Further, the rotating blades are made of only a martensitic steel or a combination of the martensitic steel and a Ni base alloy, the turbine rotor is made of a ferritic forged steel having a creep rupture strength at the operating temperature for 100 thousands hours of above 15 kg/mm$^2$, and the casing is made of a ferritic cast steel having a creep rupture strength at the operating temperature for 100 thousands hours of above 10 kg/mm$^2$.

48 Claims, 12 Drawing Sheets

FIG. 12
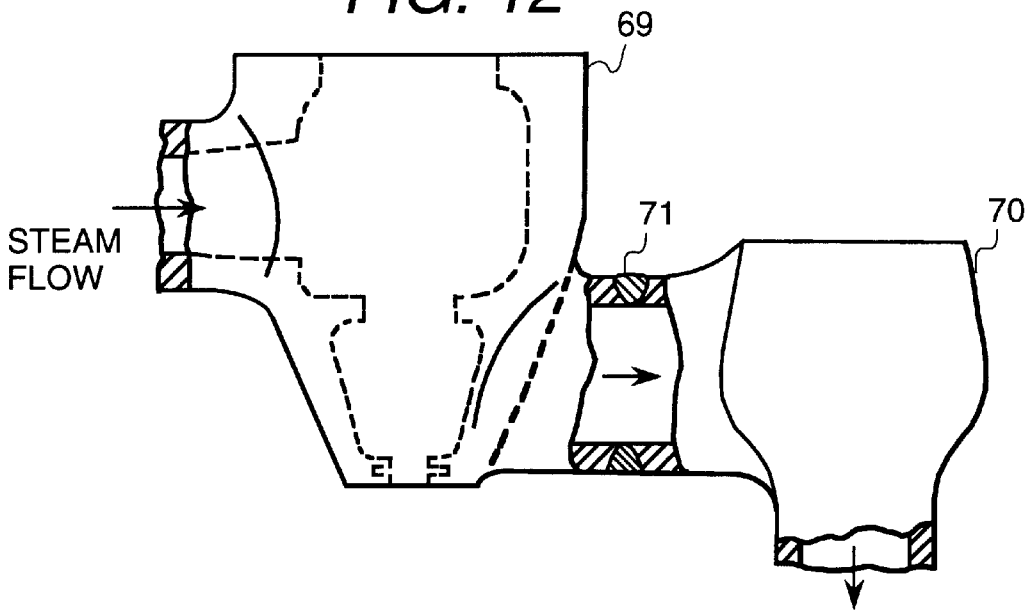
FIG. 13 ( a )
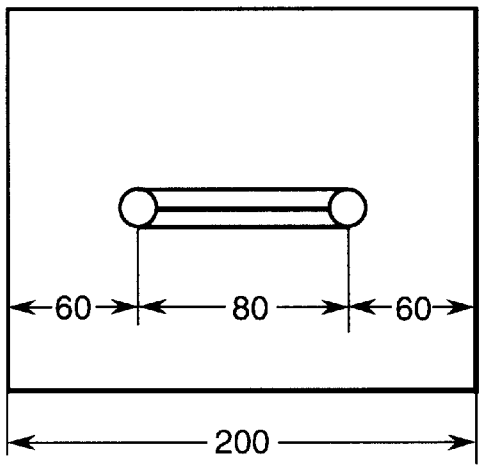
FIG. 13 ( b )
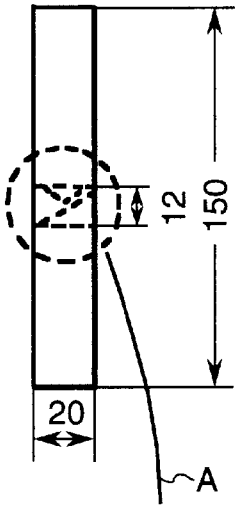
FIG. 13 ( c )
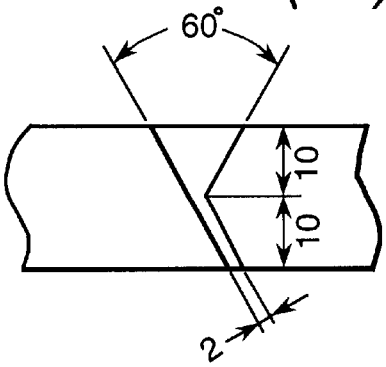

HIGH STRENGTH HEAT RESISTING CAST STEEL, STEAM TURBINE CASING, STEAM TURBINE POWER PLANT AND STEAM TURBINE

BACKGROUND OF THE INVENTION

The present invention relates generally to a novel heat resisting cast steel, a steam turbine casing and a manufacturing method thereof, a steam turbine power plant and a steam turbine. More particularly, the invention relates to a heat resisting cast steel which has a high creep rupture strength at a temperature above 621° C. and a good weldability, and is suitable for high pressure and intermediate pressure inner casings, a main steam stop valve and a control valve of an ultra-super critical steam turbine which is operated under a main steam temperature of 621° C. and pressure of 250 kgf/cm$^2$. The invention also relates to a steam turbine casing, a steam turbine power plant and a steam turbine in which the heat resisting steel is used.

A conventional steam turbine is operated under a condition of a maximum steam temperature of 566° C. and a maximum steam pressure of 246 kgf/cm$^2$. A material used for the casing is 1Cr—1Mo—¼V low carbon alloy cast steel or 11Cr—1Mo—V—Nb—N cast steel.

From the standpoint of conservation of fossil fuels, such as petroleum, coal and so on, and energy saving, it is required to improve the efficiency of a thermal power plant. The most effective means for increasing the thermal efficiency is to increase the steam temperature of the steam turbine. However, the strength of the conventional casing materials is insufficient for a highly efficient turbine material, and so a material having a higher strength is required.

In particular, conventional materials have an insufficient high temperature strength to be used for a high temperature steam turbine casing operated at a steam temperature of above 621° C. A casing made of 9%Cr steel is disclosed in Japanese Patent Application Laid-Open No. 7-118812, but it shows a deviation in high temperature strength.

The conventional steam turbine is operated under a maximum steam temperature of 566° C. and a maximum steam pressure of 246 kgf/cm$^2$.

However, from the standpoint of conservation of fossil fuels, such as petroleum, coal and so on, as well as energy saving and prevention of environmental pollution, it is required to improve the efficiency of a thermal power plant. The most effective means for increasing the thermal efficiency is to increase the steam temperature of a steam turbine. A known rotor material used for a high efficiency turbine is 1Cr—1Mo—¼V ferritic low carbon alloy forged steel or 11Cr—1Mo—V—Nb—N forged steel, and casing material used for the high efficiency turbine is 1Cr—1Mo—¼V ferritic low carbon alloy cast steel or 11Cr—1Mo—V—Nb—N cast steel. Further, as for materials having a higher high temperature strength, austenitic alloys are disclosed in Japanese Patent Application Laid-Open No. 62-180044 and in Japanese Patent Application Laid-Open No. 61-23749, and martensitic steels are disclosed in Japanese Patent Application Laid-Open No. 4-147948, Japanese Patent Application Laid-Open No. 2-290950 and Japanese Patent Application Laid-Open No. 4-371551.

As for a material having a high temperature strength higher than that of the above conventional casing materials, an austenitic cast steel has been developed by the inventors of the present invention and is disclosed in Japanese Patent Application Laid-Open No. 61-23749. Although this alloy is excellent in high temperature creep rupture strength, there are problems in that its cost is high and a large thermal stress occurs at starting-up and stopping of the turbine due to a large thermal expansion coefficient.

Although the aforementioned Japanese Patent Application Laid-Opens disclose the rotor materials and casing materials, no attention has been given to the steam turbine, nor to the thermal power plant, operating under a high temperature, as described above.

Further, an ultra-super high temperature and high pressure steam turbine is disclosed in Japanese Patent Application Laid-Open No. 62-248806, but no attention has been paid in this publication to a thermal power plant at all.

SUMMARY OF THE INVENTION

An object of the present invention is to provide a ferritic heat resisting cast steel turbine casing and a manufacturing method thereof in which the thermal expansion coefficient is equivalent to that of the conventionally used material, the creep rupture strength above 621° C. is high and the weldability is good.

Another object of the present invention is to provide a steam turbine having a high thermal efficiency attained by a high steam temperature of 610 to 660° C. by employing ferritic heat resisting steel, and a steam turbine power plant using the steam turbine.

A Further object of the present invention is to provide steam turbines having nearly the same basic structure at respective operating temperatures from 610 to 660° C. and a steam turbine power plant using the steam turbine.

In order to attain the above objects, a heat resisting cast steel turbine casing in accordance with the present invention is characterized by being made of a heat resisting cast steel which contains C of 0.06 to 0.16%, Si of not more than 1%, Mn of not more than 1%, Cr of 8 to 12%, Ni of 0.1 to 1.0%, V of 0.05 to 0.3%, Nb of 0.01 to 0.15%, N of 0.01 to 0.1%, Mo of not more than 1.5%, W of 1 to 3%, B of 0.0005 to 0.003% and O of not more than 0.015% in weight percentages and the remainder of Fe and inevitable impurities. Further, it is preferable that the content ratio of Ni/W in the heat resisting cast steel is 0.25 to 0.75.

Another heat resisting cast steel turbine casing in accordance with the present invention is characterized by being made of a heat resisting cast steel which contains C of 0.09 to 0.14%, Si of not more than 0.3%, Mn of 0.40 to 0.70%, Cr of 8 to 10%, Ni of 0.4 to 0.7%, V of 0.15 to 0.25%, Nb of 0.04 to 0.08%, N of 0.02 to 0.06%, Mo of 0.40 to 0.80%, W of 1.4 to 1.9%, B of 0.001 to 0.0025%, O of not more than 0.015% in weight percentages and the remainder of Fe and inevitable impurities.

It is preferable to add at least one kind of Ta of not more than 0.15% and Zr of not more than 0.1% to each of the above heat resisting cast steels for the turbine casing in accordance with the present invention. Further, it is preferable that Cr equivalent calculated by the following equation (1) is 4 to 10.

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}. \quad (1)$$

Furthermore, it is preferable that each of the above heat resisting cast steels for the turbine casing in accordance with the present invention has a creep rupture strength under 625° C. for 10 hours of not less than 9 kgf/mm2, an impact absorbing energy at room temperature of not less than 1 kgf-m and good weldability. Still further, in order to secure higher reliability, it is preferable that the creep rupture strength under 625° C. for $10^5$ hours is not less than 10 kgf/mm$^2$ and the impact absorbing energy at room temperature is not less than 2 kgf-m.

A method of manufacturing a heat resisting cast steel for a turbine casing is characterized by the steps of melting a raw alloy material having the composition among each of the above heat resisting cast steel using an electric furnace, degassing by ladle refining, and casting a sand mold. The method further comprises the steps of annealing the cast body at 1000 to 1150° C. after completion of the casting, performing normalizing treatment by heating to 1000 to 1100° C. and rapidly cooling, and then tempering twice at a temperature of 550 to 750° C. and at a temperature of 670 to 770° C.

A steam turbine power plant according to the present invention is characterized by having a high pressure turbine and an intermediate pressure turbine connected to two low pressure steam turbines connected to each other in tandem, wherein the inlet steam temperature to the rotating blades in the first stages of the high pressure steam turbine and the intermediate pressure steam turbine is 610 to 660° C. (preferably 615 to 640° C., and more preferably 620 to 630° C.); the inlet steam temperature to the rotating blades in the first stage of the low pressure steam turbine being 380 to 475° C. (preferably 400 to 430° C.); the metal temperature of a portion of the rotor shaft implanting first stage rotating blades and the first stage rotating blades of the high pressure steam turbine being maintained so as to become lower than a temperature of 40° C. below the inlet steam temperature to the first stage rotating blades of the high pressure steam turbine; the metal temperature of a portion of the rotor shaft implanting first stage rotating blades and the first stage rotating blades of the intermediate pressure steam turbine being maintained so as to not become lower than a temperature of 75° C. below the inlet steam temperature to the first stage rotating blades of the intermediate pressure steam turbine; the rotor shafts and some rotating blades of the high pressure steam turbine and the intermediate pressure steam turbine being made of a martensitic steel containing Cr of 9.5 to 13 weight %, other rotating blades at least in the first stage of the high pressure steam turbine and the intermediate pressure steam turbine being made of a combination of a Ni base alloy and the martensitic steel; the inner casing being made of a martensitic cast steel containing Cr of 8 to 12 weight % and having a creep rupture strength at a temperature corresponding to the steam temperature for $10^5$ hours of not less than 9 kg/mm$^2$ and an impact value at room temperature of not less than 3.2 kg-m.

A steam turbine according to the present invention is characterized by a rotor shaft, rotating blades implanted onto the rotor shaft, fixed blades for guiding steam flow to the rotating blades and an inner casing supporting the fixed blades, the steam flowing to the first stage of the rotating blades having a temperature of 610 to 660° C. and a pressure of not lower than 250 kg/cm$^2$ (preferably 246 to 316 kg/cm$^2$) or 170 to 200 kg/cm$^2$, wherein the rotor shafts, the rotating blades and fixed blades at least in the first stages are made of a high strength martensitic steel having a martensitic structure containing Cr of 9.5 to 13 weight % (preferably 10.5 to 11.5 %), the high strength martensitic steel having a creep rupture strength at a temperature corresponding to the steam temperature (preferably 610° C., 625° C., 640° C., 650° C., 660° C.) for $10^5$ hours of not less than 15 kg/mm$^2$ (preferably not less than 17 kg/mm$^2$), other rotating blades being made of a combination of the martensitic steel and a Ni base alloy having a tensile strength at room temperature which is not less than 90 kg/mm$^2$; the inner casing being made of a martensitic steel containing Cr of 8 to 9.5 weight % having a creep rupture strength at a temperature corresponding to the steam temperature for $10^5$ hours of not less than 9 kg/mm$^2$, preferably 10 kg/mm$^2$ (more preferably not less than 10.5 kg/mm$^2$) and an impact value at room temperature of not less than 3.2 kg-m.

Further, a steam turbine according to the present invention is characterized by a rotor shaft, rotating blades implanted onto said rotor shaft, fixed blades for guiding steam flow to the rotating blades and an inner casing supporting said fixed blades, wherein the rotor shaft and the fixed blades at least in the first stage are made of a high strength martensitic steel containing C of 0.05 to 0.20%, Si of not more than 0.15%, Mn of 0.05 to 1.5%, Cr of 9.5 to 13%, Ni of 0.05 to 1.0%, V of 0.05 to 0.35%, Nb of 0.01 to 0.20%, N of 0.01 to 0.06%, Mo of 0.05 to 0.5%, W of 1.0 to 4.0%, Co of 2 to 10%, B of 0.0005 to 0.03%, and having Fe of not less than 78% in weight percentages; the inner casing being made of a high strength martensitic steel containing C of 0.06 to 0.16%, Si of not more than 0.5%, Mn of not more than 1%, Ni of 0.2 to 1.0%, Cr of 8 to 12%, V of 0.05 to 0.35%, Nb of 0.01 to 0.15%, N of 0.01 to 0.8%, Mo of not more than 1.0%, W of 1 to 4%, B of 0.0005 to 0.003%, O of not more than 0.015%, and having Fe of not less than 85% in weight percentages.

At least the rotating blades in the first stage are preferably made of a Ni base alloy containing C of 0.03 to 0.20 %, Si of not more than 0.3% Mn of not more than 0.2%, Cr of 12 to 20%, Mo of 9 to 20% Al of 0.5 to 1.5%, Ti of 2 to 3 %, Fe of not more than 5%, B of 0.003 to 0.015% in weight percentage. It may be possible for it to further contain Co of not more than 12%.

Further, a high pressure steam turbine according to the present invention is characterized by having a rotor shaft, rotating blades implanted onto the rotor shaft, fixed blades for guiding steam flow to the rotating blades and an inner casing supporting the fixed blades, wherein the first stage of the rotating blades is of a double flow construction and more than ten stages of the rotating blades are provided, the rotor shaft having a distance (L) between bearing centers of not less than 5000 mm (preferably 5200 mm to 5500 mm) and a minimum diameter (D) at portions having the fixed blades of not less than 600 mm (preferably 620 to 700 mm), the ratio (L/D) being 8.0 to 9.0 (preferably 8.3 to 8.7), the rotating blades and said rotor shaft being made of a high strength martensitic steel containing Cr of 9 to 13 weight %; the inner casing being the same as described above.

Furthermore, an intermediate pressure steam turbine according to the present invention is characterized by having a rotor shaft, rotating blades implanted onto the rotor shaft, fixed blades for guiding steam flow to the rotating blades and an inner casing supporting the fixed blades, wherein more than six stages of the rotating blades are symmetrically provided on the right hand side and left hand side and the first stages of the rotating blades are implanted in the middle portion of the rotor shaft to form a double flow construction, the rotor shaft having a distance (L) between bearing centers of not less than 5200 mm (preferably 5300 to 5800 mm) and a minimum diameter (D) at portions having the fixed blades of not less than 620 mm (preferably 620 to 680 mm), the ratio (L/D) being 8.2 to 9.2 (preferably 8.5 to 9.0), the rotating blades being made of a high strength martensitic steel containing Cr of 9 to 13 weight %, the inner casing being the same as described above.

Further, a low pressure steam turbine according to the present invention is characterized by a rotor shaft, rotating blades implanted onto the rotor shaft, fixed blades for guiding steam flow to the rotating blades and an inner casing supporting said fixed blades, wherein the low pressure steam turbine has more than eight stages of rotating blades symmetrically arranged on the right hand side and left hand side, the first stages of the rotating blades being implanted in the middle portion of said rotor shaft to form a double flow construction, the rotor shaft having a distance (L) between bearing centers of not less than 7200 mm (preferably 7400 to 7600 mm) and a minimum diameter (D) at portions having the fixed blades of not less than 1150 mm (preferably 1200 to 1350 mm), said (L/D) being 5.4 to 6.3 (preferably 5.7 to 6.1), the rotor shaft being made of a Ni—Cr—Mo—V low alloy steel containing Ni of 3.25 to 4.25 weight %, the rotating blades in the last stage having a length of not shorter than 40 inches and being made of a Ti base alloy.

Further, a steam turbine power plant according to the present invention is characterized by having a high pressure turbine and an intermediate pressure turbine connected to two low pressure steam turbines which are connected to each other. in tandem, wherein the inlet steam temperature to the rotating blades in the first stages of the high pressure steam turbine and the intermediate pressure steam turbine is 610 to 660° C.; the inlet steam temperature to the rotating blades in the first stage of the low pressure steam turbine being 380 to 475° C.; the metal temperature of a portion of the rotor shaft implanting first stage rotating blades and the first stage rotating blades of the high pressure steam turbine being maintained so as to not become lower than a temperature of 40° C. below the inlet steam temperature to the first stage rotating blades of the high pressure steam turbine (preferably, maintained at a temperature being lower than the steam temperature by 20 to 35° C.); the metal temperature of a portion of the rotor shaft implanting first stage rotating blades and the first stage rotating blades of the intermediate pressure steam turbine being maintained so as to not become lower than a temperature of 75° C. below the inlet steam temperature to the first stage rotating blades of the intermediate pressure steam turbine (preferably, maintained at a temperature being lower than the steam temperature by 50 to 70° C.); the rotor shafts and the rotating blades of the high pressure steam turbine and the intermediate pressure steam turbine being made of a i martensitic steel containing Cr of 9.5 to 13 weight %, other rotating blades at least in the first stage of the high pressure steam turbine and the intermediate pressure steam turbine being made of a combination of a Ni base alloy and the martensitic steel; the inner casing being made of a martensitic cast steel containing Cr of 8 to 12 weight % and having a creep rupture strength at a temperature corresponding to the steam temperature for $10^5$ hours of not less than 9 kg/mm$^2$ and an impact value at room temperature of not less than 3.2 kg-m.

Further, a coal fired thermal power plant according to the present invention is characterized by a coal fired boiler, a steam turbine driven by the steam obtained by the boiler, a single or two electric power generators having an output power not less than 1000 MW obtained from a single or two units driven by the steam turbine, preferably by two units, wherein the steam turbine has a high pressure steam turbine, an intermediate pressure steam turbine and two low pressure steam turbines connected to the high pressure steam turbine; the inlet steam temperature to the rotating blades in the first stages of the high pressure steam turbine and the intermediate pressure steam turbine is 610 to 660° C.; the inlet steam temperature to the rotating blades in the first stage of the low pressure steam turbines being 380 to 475° C.; the steam heated to a temperature higher than the inlet steam temperature to the first stage rotating blades of the high pressure steam turbine by 3° C. (preferably 3 to 10° C., more preferably 3 to 7° C.) using a super-heater of the boiler being allowed to flow into the first stage rotating blades of the high pressure steam turbine; the inlet steam temperature heated to a temperature higher than the inlet steam temperature to the first stage rotating blades of the intermediate pressure steam turbine by 2° C. (preferably 2 to 10° C., more preferably 2 to 5° C.) by heating the steam flow out from the high pressure steam turbine using a re-heater of the boiler being allowed to flow into the first stage rotating blades of the intermediate pressure steam turbine; the inlet steam temperature heated to a temperature higher than the inlet steam temperature to the first stage rotating blades of the low pressure steam turbine by 3° C. (preferably 3 to 10° C., more preferably 3 to 6° C.) by heating the steam flow out from the intermediate pressure steam turbine using an economizer of the boiler being allowed to flow into the first stage rotating blades of the low pressure steam turbine; the rotor shafts and the rotating blades of the high pressure steam turbine and the intermediate pressure steam turbine being made of a martensitic steel containing Cr of 9.5 to 13 weight %, otherwise the rotating blades in at least in the first stage of the high pressure steam turbine and the intermediate pressure steam turbine being made of a combination of a Ni base alloy and the martensitic steel containing Cr of 9.5 to 13 weight %; the inner casing being made of a martensitic cast steel containing Cr of 8 to 12 weight % and having a creep rupture strength at a temperature corresponding to the steam temperature for $10^5$ hours of not less than 9 kg/mm$^2$ and an impact value at room temperature of not less than 3.2 kg-m.

Further, in the low pressure steam turbine according to the present invention described above, the inlet temperature of the steam to the rotating blades in the first stage being 380 to 475° C. (preferably 400 to 450° C.), the rotor shaft being made of a low alloy steel containing C of 0.2 to 0.3%, Si of not more than 0.05%, Mn of not more than 0.1%, Ni of 3.25 to 4.25%, Cr of 1.25 to 2.25%, Mo of 0.07 to 0.20%, V of 0.07 to 0.2%, and Fe of not less than 92.5% in weight percentages.

Further, in the high pressure steam turbine according to the present invention described above, the rotating blades are composed of more than seven stages (preferably 9 yo 12 stages) and the blade lengths are from 35 mm on the upstream side to 210 mm on the downstream side; a diameter of the rotor shaft in a portion implanting the rotating blade being larger than a diameter in a portion corresponding to the fixed blades; the width in the shaft direction of the implanting portion increasing stepwise from the upstream side to the downstream side by more than three steps (preferably 4 to 7 steps); the ratio of the width to the blade length decreasing from the upstream side to the downstream side by 0.6 to 1.0 (preferably 0.65 to 0.95).

Further, in the high pressure steam turbine according to the present invention described above, the rotating blades are composed of more than seven stages and the blade lengths are from 35 mm in the upstream side to 210 mm in the downstream side; the ratio of the blade length in a stage to the blade length in the adjacent stage being less than 1.2 (preferably 1.10 to 1.15), the ratio gradually increasing as the stage approaches to the downstream side; the blade length on the downstream side being larger than that on the upstream side.

Further, in the high pressure steam turbine according to the present invention described above, the rotating blades are composed of more than seven stages and the blade lengths are from 35 mm on the upstream side to 210 mm on the downstream side; the width in the shaft direction of the rotor shaft in a portion corresponding to the fixed blade decreasing from the downstream side to the upstream side stepwise by more than two steps (preferably 2 to 4 steps); the ratio of a blade length of the rotating blade in a stage to a blade length of the adjacent stage in the downstream side being in a range of 0.65 to 1.8 (preferably 0.7 to 1.7), the ratio decreasing stepwise as the stage approaches the downstream side.

In the intermediate pressure steam turbine according to the present invention, as described above, more than six stages (preferably 6 to 9 stages) of the rotating blades are symmetrically provided on the right hand side and the left hand side to form a double flow construction, the blade lengths of the rotating blades are 100 mm on the upstream side to 300 mm on the down stream side; the diameter of the rotor shaft in a portion implanting the rotating blades being larger than the diameter in a portion corresponding to the fixed blades; the width in the shaft direction of the implanting portion increasing stepwise from the upstream side to the downstream side by more than two steps (preferably 3 to 6 steps); the ratio of the width to the blade length decreasing from the upstream side to the downstream side by 0.45 to 0.75 (preferably 0.5 to 0.7).

Further, in the intermediate pressure steam turbine according to the present invention, as described above, more than six stages of the rotating blades are symmetrically provided on the right hand side and the left hand side to form a double flow construction, the blade lengths of the rotating blades are 100 mm on the upstream side to 300 mm on the down stream side; the ratio of the blade length in a stage to the blade length in the adjacent stage being less than 1.3 (preferably 1.1 to 1.2).

Further, in the intermediate pressure steam turbine according to the present invention, as described above, more than six stages of the rotating blades are symmetrically provided on the right hand side and the left hand side to form a double flow construction, the blade lengths of the rotating blades are 100 mm on the upstream side to 300 mm on the down stream side; the width in the shaft direction of the rotor shaft in a portion corresponding to the fixed blades decreasing from the downstream side to the upstream side stepwise by more than two steps (preferably 3 to 6 steps); the ratio of a blade length of the rotating blade in a stage to a blade length of the adjacent stage on the downstream side being in a range of 0.45 to 1.60 (preferably 0.5 to 1.5).

Further, in the rotating blades having more than eight stages (preferably 8 to 10 stages) symmetrically arranged on the right hand side and the left hand side to form a double flow construction, the blade lengths of the rotating blades increasing from 90 mm on the upstream side of the steam flow to 1300 mm on the down stream side; the diameter of the rotor shaft in a portion implanting the rotating blade being larger than the diameter in a portion corresponding to the fixed blades; the width in the shaft direction of the implanting portion increasing stepwise from the upstream side to the downstream side by more than three steps (preferably 4 to 7 steps); the ratio of the width to the blade length decreasing from the upstream side to the downstream side by 0.15 to 1.0 (preferably 0.15 to 0.91).

Further, in the low pressure steam turbine according to the present invention, as described above, the rotating blades have more than eight stages symmetrically arranged on the right hand side and the left hand side to form a double flow construction, the blade lengths of the rotating blades increasing from 90 mm on the upstream side of the steam flow to 1300 mm on the down stream side; the blade length in a stage in the downstream side being larger than that in the adjacent stage on the upstream side; the ratio of the blade length in a stage to the blade length in the adjacent stage being in the range of 1.2 to 1.7 (preferably 1.3 to 1.6); the ratio gradually increasing as the stage approaches the downstream side.

Further, in the low pressure steam turbine according to the present invention, as described above, the rotating blades have more than eight stages symmetrically arranged on the right hand side and the left hand side to form a double flow construction, the blade lengths of the rotating blades increasing from 90 mm on the upstream side of the steam flow to 1300 mm on the down stream side; the width in the shaft direction of the rotor shaft in a portion corresponding to the fixed blade decreasing from the downstream side to the upstream side stepwise by more than three steps (preferably 4 to 7 steps); the ratio of a blade length of the rotating blade in a stage to a blade length of the adjacent stage on the downstream side being in a range of 0.2 to 1.4 (preferably 0.25 to 1.25), the ratio decreasing stepwise as the stage approaches the downstream side.

A high pressure steam turbine according to the present invention is characterized by a rotor shaft, rotating blades implanted onto the rotor shaft, fixed blades for guiding steam flow to the rotating blades and an inner casing supporting the fixed blades, wherein the rotating blades are composed of more than seven stages; the diameter of the rotor shaft in a portion corresponding to the fixed blades being smaller than the diameter in a portion implanting the rotating blade; the width in the shaft direction of the portion corresponding to the fixed blades increasing stepwise by more than two steps (preferably 2 to 4 steps) on the downstream side of the steam flow compared with the width on the upstream side; the distance between the rotating blades in the last stage and the rotating blades in the preceding stage being 0.75 to 0.95 times (preferably 0.8 to 0.9 times, more preferably 0.84 to 0.88) the distance between the rotating blades in the second stage and the rotating blades in the third stage; the width in the shaft direction of the implanting portion of the rotor shaft increasing stepwise by more than three steps (preferably 4 to 7 steps) on the downstream side compared to the width on the upstream side; the width in the last stage being 1 to 2 times (preferably 1.4 to 1.7 time) the width in the shaft direction in the second stage; some rotating blades being made of a martensitic steel containing Cr of 9.5 to 13 weight %, other rotating blades at least in the first stage being made of a combination of a Ni base alloy and the martensitic steel containing Cr of 9.5 to 13 weight %; the inner casing being made of a martensitic cast steel containing Cr of 8 to 12 weight % and having a creep rupture strength at a temperature corresponding to the steam temperature for $10^5$ hours of not less than 9 $kg/mm^2$ and an impact value at room temperature of not less than 3.2 kg-m.

An intermediate pressure steam turbine according to the present invention is characterized by a rotor shaft, rotating blades implanted onto the rotor shaft, fixed blades for guiding steam flow to the rotating blades and an inner casing supporting the fixed blades, wherein the rotating blades are composed of more than six stages; the diameter of the rotor shaft in a portion corresponding to the fixed blades being smaller than the diameter in a portion implanting the rotating blade; the width in the shaft direction of the portion corresponding to the fixed blades increasing stepwise by more than two steps (preferably 3 to 6 steps) on the downstream side of the steam flow compared with the width on the upstream side; the distance between the rotating blades in the last stage and the rotating blades in the preceding stage being 0.55 to 0.8 times (preferably 0.6 to 0.7 time) the distance between the rotating blades in the first stage and the rotating blades in the second stage; the width in the shaft direction of the implanting portion of the rotor shaft increasing stepwise by more than two steps (preferably 3 to 6 steps) on the downstream side compared to the width on the upstream side; the width in the last stage being 0.8 to 2 times (preferably 1 to 1.5 times) the width in the shaft direction in the second stage; some rotating blades being made of a martensitic steel containing Cr of 9.5 to 13 weight %, other rotating blades at least in the first stage being made of a combination of a Ni base alloy and the martensitic steel containing Cr of 9.5 to 13 weight %; the inner casing being made of a martensitic cast steel containing Cr of 8 to 12 weight % and having a creep rupture strength at a temperature corresponding to the steam temperature for $10^5$ hours of not less than 9 kg/mm$^2$ and an impact value at room temperature of not less than 3.2 kg-m.

A low pressure steam turbine according to the present invention is characterized by a rotor shaft, rotating blades implanted onto the rotor shaft, fixed blades for guiding steam flow to the rotating blades and an inner casing supporting the fixed blades, the rotating blades having more than eight stages symmetrically arranged on the right hand side and the left hand side to form a double flow construction, the diameter of the rotor shaft in a portion corresponding to the fixed blades being smaller than the diameter in a portion implanting the rotating blades; the width in the shaft direction of the portion corresponding to the fixed blades increasing stepwise by more than three steps (preferably 4 to 7 steps) on the downstream side of the steam flow compared with the width on the upstream side; the width between the rotating blades in the last stage and the rotating blades in the preceding stage being 1.5 to 2.5 times (preferably 1.7 to 2.2) the distance between the rotating blades in the first stage and the rotating blades in the second stage; the width in the shaft direction of the implanting portion of the rotor shaft increasing stepwise by more than three steps (preferably 4 to 7 steps) on the downstream side compared to the width on the upstream side; the width in the last stage being 2 to 3 times (preferably 2.2 to 2.7 times) the width in the shaft direction in the second stage.

The constructions of the high pressure, the intermediate pressure and the low pressure steam turbines may be the same structures for any of the operating steam temperatures of 610 to 660° C., respectively.

For the rotor material according to the present invention, in order to attain a high high-temperature strength and a high low-temperature toughness and a high fatigue strength, components are preferably so adjusted that the Cr equivalent calculated by the following equation (2) becomes 4 to 8 to obtain a totally annealed martensitic structure.

For the casing material of a heat resisting cast steel according to the present invention, in order to attain a high high-temperature strength and a high low-temperature toughness and a high fatigue strength, it is preferable that components are adjusted so that the Cr equivalent calculated by the following equation (2) becomes 4 to 10 to obtain an above 95% annealed martensitic structure (δ ferrite less than 5%).

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}. \quad (2)$$

The 12Cr heat resisting steel according to the present invention, particularly in a case where it is used in a steam environment having a temperature above 621° C., it is preferable that the creep rupture strength at 625° C., $10^5$ h is not less than 10 kgf/mm$^2$, and the impact absorption energy at room temperature is not less than 1 kgf-m.

(1) The composite components of the heat resisting cast steel according to the present invention are limited as follows.

The element C needs to be added in an amount above 0.06% in order to obtain a high tensile strength. However, when the content exceeds 0.16%, in a case where the material is exposed to a high temperature for a long time, the metallic structure becomes unstable and accordingly the long term creep rupture strength is decreased. Therefore, the content of C is limited to 0.06 to 0.16%. Particularly, it is preferable that the content of C is limited to 0.09 to 0.14%.

The element N is effective for improving the creep rupture strength and for preventing the formation of a harmful (decreasing toughness and fatigue strength) δ-ferritic structure. However, when the content of N is lower than 0.01 %, the effect is insufficient, and when the content of N exceeds 0.1% the toughness is decreased and the creep rupture strength is also decreased. Therefore, it is preferable that the content of N is 0.02 to 0.06%.

The element Mn is an additive used as a deoxidizing agent, and the effect is attained by adding a small amount of Mn. When a large amount of Mn above 1% is added, the creep rupture strength is decreased. Particularly, it is preferable that the content of Mn is 0.4 to 0.7%.

Although the element Si is also an additive used as a deoxidizing agent, it is not necessary to deoxidize using Si when a steel manufacturing technology, such as a vacuum carbon deoxidizing method, is used. Further, suppressing the content of Si is effective for prevention of the formation of a harmful ferritic structure. Therefore, it is necessary to suppress the content of Si below 1% if Si is added, and it is preferable that the content of Si is below 0.4%, and more preferably below 0.3%.

The element V has an effect to increase the creep rupture strength. When the content of V is below 0.05%, the effect is insufficient, and when the content of V exceeds 0.3%, the fatigue strength is decreased due to formation of δ-ferrite. It is preferable that the content of V is 0.15 to 0.25%.

The element Nb is very effective to increase the high temperature strength. However, particularly in a large ingot, when Nb is excessively added, the strength is decreased due to formation of eutectic Nb carbide having large grains or the fatigue strength is decreased due to deposition of δ-ferrite. Therefore, it is necessary to suppress the content of Nb below 0.15%. On the other hand, when the content of Nb is lower than 0.01%, the effect is insufficient. In a case of a large ingot, it is preferable that the content of Nb is 0.02 to 0.1 %, and more preferably 0.04 to 0.08%.

The element Ni is very effective for increasing the toughness and for preventing formation of δ-ferrite. However, when the content of Ni is lower than 0.1%, the effect is insufficient, and when the content of Ni exceeds 1%, the creep rupture strength is undesirably decreased. It is preferable that the content of Ni is 0.2 to 0.9%, and more preferably 0.4 to 0.7%.

The element Cr has an effect for improving the high temperature strength and the high temperature oxidization. When the content of Cr exceeds 12%, a harmful δ-ferritic structure is formed, and when the content of Cr is below 8%, the resistivity to oxidation against high temperature high pressure steam is insufficient. On the other hand, although Cr addition has an effect for increasing the creep rupture strength, excessive addition causes formation of a harmful δ-ferritic structure and decreases the toughness. It is preferable that the content of Cr is 8.0 to 10%, and more preferably 8.5 to 9.5%.

The element W has an effect for extremely increasing the high temperature long term strength. When the content of W is below 1%, the effect is insufficient for a heat resisting steel used at a temperature of 621 to 650° C. When the content of W exceeds 3%, the toughness decreases. It is preferable that the content of W is 1.2 to 2.0%, and more preferably 1.4 to 1.8%.

The element Mo is added for improving the high temperature strength. However, in a case where a steel contains W of above 1% as the cast steel according to the present invention, addition of Mo above 1% decreases the toughness and the fatigue strength. Therefore, the content of Mo is limited below 1.5%. Particularly, it is preferable that the content of Mo is 0.4 to 0.8%, and more preferably 0.55 to 0.70%.

When content of the element O exceeds 0.015%, the high temperature strength and the toughness are decreased. Therefore, the content of O should be 0.015%. Particularly, it is preferable that the content of O is lower than 0.010%.

One of the important points in the present invention is in adjusting the ratio Ni/W. By adjusting the ratio Ni/W to 0.25 to 0.75, it is possible to obtain a heat resisting cast steel for a casing material having a creep rupture strength of above 9 kgf/mm$^2$ at 625° C. for $10^5$ hours and an impact absorption energy of above 1 kgf-m at 0° C. which is required for a high pressure steam turbine inner casing, an intermediate pressure steam turbine inner casing, a main steam stop valve and a control valve for an ultra-high critical pressure steam turbine operated at above 621° C., 250 kgf/cm$^2$.

Addition of the elements Ta and Zr is effective for increasing the low temperature toughness. The effect can be sufficiently obtained by adding Ta of below 0.15% or Zr of below 0.1%, or adding both together. When Ta is added above 0.1%, the use of Nb may be omitted.

Since the heat resisting cast steel for a casing material according to the present invention has a decreased high temperature creep rupture strength and low temperature toughness when a δ-ferritic structure exists, a uniform annealed martensitic structure is preferable. In order to obtain an annealed martensitic structure, the Cr equivalent calculated by Equation (1) is set to a value below 10 by adjusting the composition. Since the high temperature creep rupture strength is decreased when the Cr equivalent is excessively low, the Cr equivalent must be above 4. Particularly, it is preferable that the Cr equivalent is 6 to 9.

Addition of the element B extremely increases the high temperature (above 621° C.) creep rupture strength. Since the weldability becomes degraded when the content of B exceeds 0.0030%, the upper limit of the B content is limited to 0.0030 %. The content of B for a large casing is preferably 0.0005 to 0.0025%, and more preferably 0.001 to 0.002%.

Since the turbine casing is exposed to high pressure steam having a temperature above 621° C., the turbine casing suffers high stress due to inner pressure. Therefore, from the viewpoint of prevention of creep rupture, the casing material is required to have a creep rupture strength at 625° C. for $10^5$ hours of above 9 kgf/mm$^2$. Further, since a thermal stress acts on the turbine casing when the metal temperature is low during the starting period of the turbine, from the viewpoint of prevention of brittle fracture, the casing material is required to have an impact absorption energy at 0° C. of above 1 kgf-m. Especially, in order to maintain a higher reliability, it is preferable that the creep rupture strength at 625° C. for $10^5$ hours is above 10 kgf/mm$^2$, and the impact absorption energy at 0° C. is above 2 kgf-m or the impact absorption energy at 20° C. is above 3.2 kgf-m.

In order to manufacture an ingot having few defects, a high level manufacturing technology is required, since the ingot becomes as large as 50 tons in weight. A sound ferritic heat resisting cast steel according to the present invention can be manufactured by melting a raw alloy material having the target composition for the heat resisting cast steel using an electric furnace, degassing by ladle refining, and then casting a sand mold. By performing sufficient refining and deoxidizing before casting, an ingot without cast defects, such as shrinkage, can be obtained.

Further, a large ingot such as a steam turbine casing capable of operating in a steam environment having a temperature above 621° C. can be manufactured by annealing the cast body at 1000 to 1150° C. after casting, performing normalizing treatment by heating at 1000 to 1100° C. and rapidly cooling, and then tempering twice at a temperature of 550 to 750° C. and at a temperature of 670 to 770° C. When the annealing temperature and the normalizing temperature are below 1000° C., carbo-nitride cannot be sufficiently dissolved, and when the annealing temperature and the normalizing temperature are excessively high, grain coarsening takes place. By performing tempering twice, the remaining austenite can be perfectly dissolved and a martensitic structure can be formed. By manufacturing an ingot through the above method, it is possible to obtain an ingot which has a creep rupture strength at 625° C. for $10^5$ hours above 9 kgf/mm$^2$, and the impact absorption energy at 0° C. is above 2 kgf-m or the room temperature impact absorption energy at 20° C. is above 3.2 kgf-m, and to produce a steam turbine casing capable of operating in a steam environment having a temperature above 621° C.

(2) The reason for restricting the composition of the ferritic heat resisting steel according to the present invention will be described below. The ferritic heat resisting steel is used for constructing the high pressure and intermediate pressure rotors, blades, nozzles, and tightening bolts of the inner casings and diaphragms in the first stage of an intermediate pressure portion of the steam turbine.

The element C is an inevitable element to increase the high temperature strength by depositing carbide in a process of annealing heat treatment. A content of C more than 0.05% is required to attain a high tensile strength. However, when the content of C exceeds 0.20% and the steel is exposed to high temperature for a long time, the metallic structure becomes unstable and the long term creep rupture strength is decreased. Therefore, the content of C is limited to 0.05 to 0.20%. It is preferable that the content of C is 0.08 top 0.14%, and particularly more preferable 0.09 to 0.14%.

The element Mn is an additive serving as a deoxidizing agent, and the effect is attained by adding a small amount Mn. When a large amount of Mn above 1.5% is added, the creep rupture strength is decreased. Particularly, it is preferable that the content of Mn is 0.03 to 0.20% or 0.3 to 0.7%. For a larger range, a range of 0.35 to 0.65 is preferable. When the content of Mn is in the smaller range, a higher strength can be attained, and when the content of Mn is in the larger range, a better workability can be attained.

Although the element Si is also an additive serving as a deoxidizing agent, it is not necessary to deoxidize using Si when a steel manufacturing technology, such as a vacuum carbon deoxidizing method, is used. Further, suppressing the content of Si is effective for prevention of a decrease in the toughness due to formation of a harmful δ-ferritic structure and segregation of grain boundaries. Therefore, it is necessary to suppress the content of Si below 1% if Si is added, and it is preferable that the content of Si should be below 0.15%, and preferably below 0.07%, and a particularly more preferable content of Si is below 0.05%.

The element Ni is effective to increase the toughness and to prevent formation of δ-ferrite. However, when the content of Ni is lower than 0.05%, the effect is insufficient, and when the content exceeds 1.0%, the creep rupture strength is undesirably decreased. Therefore, it is preferable that the content of Ni is 0.3 to 0.7%, and a more preferable content of Ni is 0.4 to 0.65%.

The element Cr is an inevitable element for increasing the high temperature strength and the high temperature oxidization. The content of Cr is required to be at least 9%. However, when the content of Cr exceeds 13%, a harmful δ-ferritic structure is formed, and accordingly the high temperature strength and the toughness are decreased. Therefore, the content of Cr is limited in 9 to 12%. Particularly, it is preferable that the content of Cr is 10 to 12%, and more preferably 10.8 to 11.8%.

The element Mo is added for improving the high temperature strength. However, in a case where a steel contains W of above 1% as the cast steel according to the present invention, addition of Mo above 1% decreases the toughness and the fatigue strength. Therefore, the content of Mo is limited below 0.5%. Particularly, it is preferable that the content of Mo is 0.05 to 0.45%, and more preferably 0.1 to 0.3%.

The element W has a strong effect to increase the high temperature long term strength at a temperature above 620° C. by suppressing coarsening of carbide due to agglomeration at the high temperature and strengthening the matrix by solution. It is preferable that the content of W is 1 to 1.5% for a temperature of 620° C., the content is 1.6 to 2.0% for a temperature of 630° C., the content is 2.1 to 2.5% for a temperature of 640° C., the content is 2.5 to 3.0% for a temperature of 650° C., and the content is 3.1 to 3.5% for a temperature of 660° C. When the content of W exceeds 3.5%, the toughness decreases due to formation of δ-ferrite. The content of W is limited in the range of 1 to 3.5%. Particularly, it is preferable that the content of W is 2.4 to 3.0%, and more preferably 2.4 to 2.8%.

The element V has an effect to increase the creep rupture strength by forming carbo-nitride. When the content of V is below 0.05%, the effect is insufficient, and when the content of V exceeds 0.3%, the fatigue strength is decreased due to formation of δ-ferrite. It is preferable that the content of V is 0.10 to 0.25%, and more preferably 0.15 to 0.25%.

The element Nb is very effective to increase the high temperature strength by forming the carbide NbC. However, particularly in a large ingot, when Nb is excessively added, the strength is decreased due to formation of eutectic NbC carbide having large grains or the fatigue strength is decreased due to deposition of δ-ferrite. Therefore, it is necessary to suppress the content of Nb below 0.20%. On the other hand, when the content of Nb is lower than 0.01%, the effect is insufficient. It is preferable that the content of Nb is 0.02 to 0.15%, and more preferably 0.04 to 0.10%.

The element Co is an important element which characterizes and distinguishes the present invention from the prior art. In the present invention, adding Co substantially improves the high temperature strength as well as the toughness. It is thought that the effect is caused by an interaction with the element W and a particular phenomenon in the alloy containing W of more than 1% according to the present invention. The limit content of Co to provide the Co effect in the alloy according to the present invention is 2.0%. An additional larger effect cannot be attained even if Co is excessively added, but the ductility is decreased. Therefore, the upper limit of the Co content is 10%. It is preferable that the content of Co is 2 to 3% for a temperature of 620° C., the content is 3.5 to 4.5% for a temperature of 630° C., the content is 5 to 6% for a temperature of 640° C., the content is 6.5 to 7.5% for a temperature of 650° C., and the content is 8 to 9% for a temperature of 660° C. However, a sufficient strength can be attained at any temperature below 650° C. by adding Co above 2 %.

The element N is an important element which characterizes and distinguishes the present invention from the prior art. The element N is effective for improving the creep rupture strength and for prevention of formation of a δ-ferritic structure. However, when the content of N is lower than 0.01% the effect is insufficient, and when the content of N exceeds 0.1% the toughness is decreased and the creep rupture strength is also decreased. Therefore, it is preferable that the content of N is 0.01 to 0.03%, and more preferably 0.01 to 0.025%.

The element B has an effect to increase the high temperature strength by strengthening the grain boundary and preventing a coarsening due to agglomeration of $M_{23}C_6$ carbide by dissolving in the $M_{23}C_6$ carbide. Although the addition of B above 0.001% is effective, the weldability and the forging ability are degraded when the content of B exceeds 0.03%. Therefore, the content of B is limited in the range of 0.001 to 0.03%. It is preferable that the content of B is 0.001 to 0.01%, and a more preferable content of B is 0.01 to 0.02%.

Addition of the elements Ta, Ti and Zr is effective for increasing the toughness. The effect can be sufficiently obtained by adding Ta of below 0.15%, Ti of below 0.1% or Zr of below 0.1%, or adding them together. When Ta is added above 0.1%, the use of Nb may be omitted.

It is preferable that the rotor shaft and the rotating blades and fixed blades at least in the first stage according to the present invention, for steam temperatures of 620 to 630° C., are made of a totally annealed steel having a martensitic structure which contains C of 0.09 to 0.20%, Si of not more than 0.15%, Mn of 0.05 to 1.0%, Cr of 9.5 to 12.5%, Ni of 0.1 to 1.0%, V of 0.05 to 0.30%, N of 0.01 to 0.06%, Mo of 0.05 to 0.5%, W of 2 to 3.5%, Co of 2 to 4.5%, B of 0.001 to 0.030%, and having Fe of not less than 77%. Further, for steam temperatures of 635 to 660° C., it is preferable that the content of Co is changed to 5 to 8% and Fe is changed to not less than 78% in the totally annealed steel having a martensitic structure as described above. Especially, by decreasing the Mn content to 0.03 to 0.2% and the B content to 0.001 to 0.01% for both of the above temperature ranges, a high strength can be attained. Particularly, it is preferable that the content is set to C of 0.09 to 0.20%, Mn of 0.1 to 0.7%, Ni of 0.1 to 1.0%, V of 0.10 to 0.30%, N of 0.02 to 0.05%, Mo of 0.05 to 0.5%, W of 2 to 3.5%, and Co of 2 to 4 %, B of 0.001 to 0.01% for the material for a steam temperature of below 630° C., and Co of 5.5 to 9.0%, B of 0.01 to 0.03% for the material for steam temperatures of 630 to 660° C. However, a material having even the former Co content can be used in the temperature range of 620 to 650° C.

For the material for the rotor shaft, the Cr equivalent obtained from an equation to be described later is preferably set to 4 to 10.5, and more preferably set to 6.5 to 9.5. The same can be applied to the other components.

Since the fatigue strength and the toughness of the rotor material for the high pressure and the intermediate pressure steam turbines according to the present invention are decreased when the &-ferritic structure is mixed, the structure is preferably a uniform martensitic structure. In order to obtain an annealed martensitic structure, the Cr equivalent calculated by Equation (1) must be set to below 10 by adjusting the components. When the Cr equivalent is excessively small, the creep rupture strength is decreased.

Therefore, the Cr equivalent must be set to above 4. Particularly, it is preferable that the Cr equivalent is 5 to 8.

At least one of the rotor shaft, the rotating blade and the fixed blade according to the present invention is made of a material which contains a B+N content of not more than 0.050%, and has at least one of the relationships that a ratio of (N/B) is not less than 1.5 (preferably 1.5 to 2.0), a ratio of (B/Co) is not less than 0.0035 (preferably 0.0035 to 0.008, and more preferably 0.04 to 0.006), a ratio of (Co/Mo) is not more than 18 (preferably 8 to 18, more preferably 11 to 16), and a ratio of (Co/Nb) is not less than 30 (preferably 30 to 70). It is preferable when all the above relationships are satisfied. These elements are organically related to one another.

(3) The reason for restricting the composition of the aforementioned Ni base deposition strengthened alloy according to the present invention will be described below. The Ni base deposition strengthened alloy is used for the rotating blades at least in the first stage of the high pressure and intermediate pressure steam turbine according to the present invention.

Addition of the element C above 0.03% increases the yield strength and the creep strength at a high temperature by dissolving in the alloy or by depositing carbide when being used at high temperature. However, the addition of C in an amount exceeding 0.2% excessively forms a deposit of carbide when being used at high temperature resulting in a decrease in the high temperature tensile contraction ratio. It is preferable that the content of C is 0.03 to 0.15%.

The element Cr increases the yield strength and the creep strength at a high temperature by dissolving into an alloy, and further increases the high temperature oxidizing resistivity and the sulfuric corrosion resistivity. Therefore, it is necessary to add Cr above 12%. However, the σ-phase is deposited when the content of Cr exceeds 20%, and the contraction ratio in a high temperature tensile test is decreased. It is preferable that the content of Cr is in the range of 12 to 20%.

Addition of the element Mo above 9% increases the yield strength and the creep rupture strength at a high temperature by dissolving in the alloy. However, the addition of Mo exceeding 20% rapidly decreases the yield strength, and further the σ-phase is deposited and the contraction ratio in a high temperature tensile test is decreased. It is preferable that the content of Mo is in the range of 12 to 20%.

Addition of the element Co above 12% substantially increases the yield strength and the creep rupture strength at room temperature and at a high temperature by dissolving in the alloy. However, the addition of Co exceeding 12% rapidly decreases the high temperature ductility, and further the σ-phase is deposited and the contraction ratio in a high temperature tensile test is decreased. It is preferable that the content of Co is in the range of 5 to 12%.

Addition of the element Al of 0.5 to 1.5% increases the yield strength and the creep rupture strength in a high temperature tensile test by dissolving in the alloy and further by depositing the γ-prime phase when being used at a high temperature. However, the addition of Al exceeding 1.5% decreases the high temperature tensile contraction ratio. It is preferable that the content of Al is 0.5 to 1.2%.

Addition of the element Ti of 2 to 3% increases the yield strength and the creep rupture strength in a high temperature tensile test by dissolving in the alloy and further by depositing the γ-prime phase when being used at a high temperature. However, the addition of Ti exceeding 3% decreases the high temperature tensile contraction ratio.

Since the element Fe decreases the creep rupture strength, the content of Fe must be suppressed to as low a level as possible. Even if Fe is contained as an impurity, the content of Fe must be decreased to below 5%.

The elements Si and Mn are added as deoxidizing agents and for improving the hot workability to below 0.3% and below 0.2 %, respectively. However, it is preferable that both elements are not added.

Addition of a small amount of the element B increases the creep rupture strength and the high temperature ductility by locally depositing in the austenitic grain boundary. The effect is attained by adding B of above 0.003%. However, the hot workability as well as the high temperature ductility are degraded when the content of B exceeds 0.015%. Therefore, the content of B must be 0.003 to 0.015%.

The element Mg and the rare-earth elements increase the creep rupture strength by locally depositing in the austenitic grain boundary. The element Zr is a strong carbide forming element, and addition of a small amount of the element Mg increases the creep rupture strength by a multiplier effect with formation of the other carbides, such as Ti carbide. However, since excessive addition of these elements decreases the ductility at a high temperature by decreasing the bonding force between the grain boundaries and by forming coarse carbides, it is preferable to add Mg of not more than 0.1%, rare-earth elements of not more than 0.5% and zr of not more than 0.5%, it is and particularly preferable to add Mg of 0.005 to 0.05%, rare-earth elements of 0.005 to 0.1% and Zr of 0.01 to 0.2%.

Aging treatment is performed on the alloy according to the present invention after solution treatment.

The solution treatment is performed by maintaining the alloy at a temperature of 1050 to 1200° C. for 30 minutes to 10 hours and then by cooling the alloy using cold water or air. The water cooling is performed by immersing the alloy having a desired temperature into water, and in a case where the alloy is of a plate-shape, the water cooling is performed by spraying water onto the surface of the alloy having a desired temperature.

The aging treatment after the solution treatment described above is performed by maintaining the alloy at a temperature of 700 to 870° C. for 4 to 24 hours.

The alloy according to the present invention is preferably melted in a non-oxidizing environment. Since the raw materials used for the alloy according to the present invention are pure metals, in order to improve the production yield of the alloy elements and reduce any deviation of the compositions, it is preferable that the alloy elements are heated in a vacuum just before being melted down and then exposed to a non-oxidizing gas during melting.

Further, the elements melted in such a manner are remelted by a vacuum arc or electroslug to obtain the alloy.

The Ni base deposition strengthening alloy in accordance with the present invention preferably has a tensile strength of above 90 kg/mm$^2$ at room temperature, more preferably above 100 kg/mm$^2$, and a tensile strength of above 80 kg/mm$^2$ at 732° C., and an elongation above 10%.

(4) The rotor according to the present invention is manufactured by melting an alloy raw material having a target composition using an electric furnace, deoxidizing the material through carbon vacuum deoxidation, casting it in a metallic mold, and forging it to form an electrode. The electrode is remelted by electroslug and forged to form a rotor-shape. The forging must be performed under a temperature below 1150° C. in order to prevent forging cracks. After annealing heat treatment of the forged steel, the forged steel is subjected to quenching treatment by heating at 1000 to 1100° C. and rapidly cooling, and then it is annealed twice at a temperature of 550 to 650° C. and then at a temperature of 670 to 770° C. Thus, a steam turbine rotor capable of operating in a steam environment having a temperature above 620° C. can be manufactured.

The blades, the nozzles, the tightening bolts of the inner casings and the diaphragms in the first stage of the intermediate pressure portion according to the present invention are manufactured as follows. An ingot is manufactured by melting the raw material by vacuum melting and casting it into a metal mold under a vacuum environment. The ingot is hot forged to a predetermined shape at the same temperature described above, and water-quenched or oil-quenched after being heated to a temperature of 1050 to 1150° C., tempered at a temperature of 700 to 800° C., and then machined into a desired shape, such as a blade-shape. The vacuum melting is performed under a pressure of $10^{-1}$ to $10^{-4}$ mmHg. Although the heat resisting steel in accordance with the present invention may be used for the blades in the high pressure portion and the intermediate pressure portion in all of the stages and the nozzles, the heat resisting steel is particularly required for the blades in the first stages of the high pressure and the intermediate pressure steam turbines.

(5) In the steam turbine rotor shaft made of the 12 weight % Cr martensitic steel according to the present invention, it is preferable that build-up welding layers having a high bearing characteristic are formed on the surface of the base material forming the journal portion of the rotor shaft, the build-up welding layers being formed as at least three layers, preferably 5 layers to 10 layers, using a welding material of steel, the Cr content in the welding material being successively decreased from the first layer to any layer of the second layer to the fourth layer, the welding material of a steal having the same Cr content which is used in welding on the layers after the fourth layer, the Cr content in the welding material used in welding the first layer being less than the Cr content of the base material by 2 to 6 weight %, the Cr content in the welded layers after the fourth layer being 0.5 to 3 weight % (preferably 1 to 2.5 weight %).

Although build-up welding provides the highest safety for improving the bearing characteristic of the journal portion in accordance with the present invention, it becomes difficult to perform build-up welding as the content of B in the steel increases. Therefore, in order to add B above 0.02% to the steel to attain higher strength, it is preferable to choose a construction where a sleeve made of a low carbon steel having Cr of 1 to 3% is shrunk in or inserted with the journal portion. The composition of the material for the sleeve is the same as the composition of the build-up welded layer to be described later.

It is preferable when the build-up welding layers obtained by the present invention are composed of 5 layers to 10 layers. As described above, if the content of Cr is rapidly decreased in the first build-up welding layer, a high tensile residual stress is caused or welding cracks are caused. That is, the content of Cr in the welding material cannot be largely reduced. Therefore, the number of the build-up welding layers is increased and it is necessary for the content of Cr in each of the build-up welding layers to be gradually reduced, and it is also necessary that a desired content of Cr in the surface layer and a desired thickness of the surface layer are maintained. This means that five or more layers are required as the surface layers. However, an additional effect cannot be obtained even if ten or more layers are welded. In a large sized structural member, such as a steam turbine rotor shaft, it is necessary that the build-up welding layer is not affected by the composition of the base material, and has a desired composition and a desired thickness. That is, the build-up welding layers need to have three layers for the thickness not affected by the composition of the base material and upper layers having the desired composition and the desired thickness provided on the three layers. The upper layers are required to be composed of more than two layers, and the required thickness is, for example, 18 mm as the final finishing. In order to form layers having such a thickness, five build-up welding layers are required even if the thickness for the final finishing by machining is excluded. It is preferable that the layers after the third layer mainly have an annealed martensitic structure and deposited carbide. Particularly, the composition of the build-up welding layers after the fourth layer is preferably composed of C of 0.01 to 0.1%, Si of 0.3 to 1%, Mn of 0.3 to 1.5%, Cr of 0.5 to 3%, Mo of 0.1 to 1.5 %, and the remainder of Fe.

In the build-up welding layers, the Cr content in the welding material is successively decreased from the first layer to any layer of the second layer to the fourth layer. By forming each of the build-up layers using each of a plurality of welding rods containing a successively decreasing Cr content, it is possible to solve the problem in that the ductility of the welded portion in the first layer is decreased due to a large difference in Cr content in the welded portion in the first layer, and accordingly it is possible to form the build-up welding layers having the desired composition without occurrence of any cracks. By doing so, according to the present invention, the difference of the chromium contents between the base material and the portion near the first layer can be made small, and at the same time the build-up welding layer having the high bearing characteristic described above can be formed in the final layer.

The Cr content in the welding material used in welding the first layer is less than the Cr content of the base material by 2 to 6 weight %. When the Cr content in the welding material used in welding the first layer is less than the Cr content of the base material by below 2%, it is difficult to decrease the Cr content in the build-up welding layers sufficiently to obtain the effect of improving the bearing characteristic. On the contrary, when the Cr content in the welding material used in welding the first layer is less than the Cr content of the base material by above 6%, the change in the chromium content between the base material and each of the build-up welding layers becomes extremely large. The difference causes a difference in thermal expansion coefficients and consequently the difference in thermal expansion coefficients causes a high tensile residual stress or causes welding cracks. Since the thermal expansion coefficient becomes small as the content of Cr is high, the build-up welding layer having a low Cr content has a thermal expansion coefficient smaller than that of the base material and consequently a high tensile residual stress is formed in the build-up welding layer after welding. As a result, the lower the Cr content in the steel used in the welding is, the harder will be the welding portion due to the higher tensile residual stress. This causes welding cracks. Therefore, it is necessary that the Cr content in the welding material used in welding the first layer is less than the Cr content of the base material by below 6%. By using such welding materials, the Cr content of the welding portion in the first layer is maintained at a content less than the Cr content of the base material by nearly 1 to 3% because of mixing with the base material, which results in a better welding.

In accordance with the present invention, the layers after the fourth welding layer need to be formed using a welding material made of a steel having the same Cr content as the content of Cr in the welding material for the fourth layer. In the build-up welding, the layers up to the third layer are affected by the composition of the base material, but the composition of the build-up welding layers after the fourth layer is determined by the composition of the welding material being used. Therefore, it is possible to form layers which satisfy the required characteristic as the journal portion of the steam turbine rotor shaft. The thickness of the build-up welding layers required for the large sized structure of the steam turbine rotor shaft is 18 mm as described above. In order to obtain the required alloying constituent and the required thickness with the composition as the final layer, more than two of the build-up welding layers after the fourth layer are welded using the welding material having the same content of Cr. Thereby, it is possible to form the build-up welding layer which satisfies the aforementioned required characteristic as a journal having a sufficient thickness.

(6) Reason for restricting the composition of the ferritic heat resisting steel according to the present invention will be described below. The ferritic heat resisting steel is used for constructing the valve boxes of the inner casing control valve for the high pressure and intermediate pressure steam turbines, the valve boxes of the combining reheater valve, the main steam lead pipe, the main steam inlet pipe, the reheater inlet pipe, the high pressure steam turbine nozzle box, the intermediate pressure steam turbine first diaphragm, the high pressure steam turbine main steam inlet flange, the elbows, and the main steam stop valve.

In the ferritic heat resisting cast steel, by adjusting the ratio Ni/W to 0.25 to 0.75, it is possible to obtain a heat resisting cast steel for a casing material having a creep rupture strength of above 9 kgf/mm$^2$ at 625° C. for $10^5$ hours and an impact absorption energy of above 1 kgf-m at 0° C. which is required for a high pressure steam turbine inner casing, an intermediate pressure steam turbine inner casing, a main steam stop valve and a control valve for an ultra-high critical pressure steam turbine operated at above 621° C., 250 kgf/cm$^2$.

For the heat resisting casting steel according to the present invention, in order to attain a high high-temperature strength and a high low-temperature toughness and a high fatigue strength, it is preferable that components are adjusted so that the Cr equivalent calculated by each of the compositions (weight %) in the following equation (3) becomes 4 to 10.

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}. \quad (3)$$

The 12Cr heat resisting steel according to the present invention, particularly for use in a steam environment having a temperature above 621° C., it is preferable that the creep rupture strength at 625° C., $10^5$ h is not less than 10 kgf/mm$^2$, and the impact absorption energy at room temperature is not less than 1 kgf-m. Further, in order to maintain a higher reliability, it is preferable that the creep rupture strength at 625° C. for $10^5$ hours is above 10 kgf/mm$^2$, and the impact absorption energy at 0° C. is above 2 kgf-m.

The element C needs to be added in an amount above 0.06% in order to obtain a high tensile strength. However, when the content of C exceeds 0.16%, in a case where the material is exposed to a high temperature for a long time, the metallic structure becomes unstable, and accordingly the long term creep rupture strength is decreased. Therefore, the content of C is limited to 0.06 to 0.16%. Particularly, it is preferable that the content of C is limited to 0.09 to 0.14%.

The element N is effective for improving the creep rupture strength and for prevention of formation of a δ-ferritic structure. However, when the content of N is lower than 0.01% the effect is insufficient, and when the content of N exceeds 0.1% the toughness is decreased and the creep rupture strength is also decreased. Therefore, it is preferable that the content of N is 0.02 to 0.04%.

The element Mn is an additive serving as a deoxidizing agent, and the effect is attained by adding a small amount of Mn. When a large amount of Mn above 1% is added, the creep rupture strength is decreased. Particularly, it is preferable that the content of Mn is 0.4 to 0.7%.

Although the element Si is also an additive serving as a deoxidizing agent, it is not necessary to deoxidize using Si when a steel manufacturing technology, such as a vacuum carbon deoxidizing method, is used. Further, suppressing the content of Si is effective for prevention of the formation of a harmful co δ-ferritic structure. Therefore, it is necessary to suppress the content of Si below 1% if Si is added, and it is preferable that the content of Si is below 0.5%, and more preferably below 0.1 to 0.4%.

The element V has an effect to increase the creep rupture strength. When the content of V is below 0.05%, the effect is insufficient, and when the content of V is exceeds 0.35%, the fatigue strength is decreased due to formation of δ-ferrite. It is preferable that the content of V is 0.15 to 0.25%.

The element Nb is very effective to increase the high temperature strength. However, particularly in a large ingot, when Nb is excessively added, the strength is decreased due to formation of eutectic Nb carbide having large grains or the fatigue strength is decreased due to deposition of δ-ferrite. Therefore, it is necessary to suppress the content of Nb below 0.15%. On the other hand, when the content of Nb is lower than 0.01%, the effect is insufficient. In a case of a large ingot, it is preferable that the content of Nb is 0.02 to 0.1 %, and more preferably 0.04 to 0.08%.

The element Ni is very effective for increasing toughness and for preventing formation of δ-ferrite. However, when the content of Ni is lower than 0.1%, the effect is insufficient, and when the content of Ni exceeds 1.0%, the creep rupture strength is undesirably decreased. It is preferable that the content of Ni is 0.2 to 0.9%, and more preferably 0.4 to 0.8

The element Cr has an effect for improving the high temperature strength and the high temperature oxidization. When the content exceeds 12%, a harmful δ-ferritic structure is formed, and when the content is below 8%, the resistivity to oxidation against high temperature high pressure steam is insufficient. On the other hand, although Cr addition has an effect for increasing the creep rupture strength, excessive addition of Cr causes formation of a harmful δ-ferritic structure and decreases the toughness. It is preferable that the content of Cr is 8.0 to 10%, and more preferably 8.5 to 9.5%.

The element W has an effect of extremely increasing the high temperature long term strength. When the content of W is below 1%, the effect is insufficient for a heat resisting steel used under temperatures of 620 to 660° C. When the content of W exceeds 4%, the toughness decreases. It is preferable that the content of W is selected depending on the temperature so that the content is 1.0 to 1.5% for a temperature of 620° C., the content is 1.6 to 2.0% for a temperature of 630° C., the content is 2.1 to 2.5% for a temperature of 640° C., the content is 2.6 to 3.0% for a temperature of 650° C. and the content is 3.1 to 3.5% for a temperature of 660° C. However, it is possible to select the content of W to be 1.5 to 1.9% when the temperature is below 650° C.

There is a correlation between W and Ni, and a higher strength and a higher toughness can be obtained by selecting the ratio Ni/W in the range of 0.25 to 0.75.

The element Mo is added for improving the high temperature strength. However, in a case where a steel contains W of above 1% as the cast steel according to the present invention, addition of Mo above 1.5% decreases the toughness and the fatigue strength. Therefore, the content of Mo is limited below 1.5%. Particularly, it is preferable that the content is 0.4 to 0.8%, and more preferably 0.55 to 0.70%.

Addition of the elements Ta, Ti and Zr is effective for increasing the toughness. The effect can be sufficiently obtained by adding Ta of below 0.15%, Ti of below 0.1% or Zr of below 0.1%, or adding them together. When Ta is added above 0.1%, the use of Nb may be omitted.

Since the fatigue strength and the toughness of the casing material of the heat resisting cast steel according to the present invention are decreased when the δ-ferritic structure is mixed, the structure is preferably a uniform martensitic structure. In order to obtain an annealed martensitic structure, the Cr equivalent calculated by Equation (1) must be set to below 10 by adjusting the components. When the Cr equivalent is excessively small, the creep rupture strength is decreased. Therefore, the Cr equivalent must be set to above 4. Particularly, it is preferable that the Cr equivalent is 6 to 9.

Addition of the element B extremely increases the high temperature (above 621° C.) creep rupture strength. Since the weldability becomes degraded when the content of B exceeds 0.0030%, the upper limit of the B content is limited to 0.003 %. Especially, the upper limit of B for a large casing is 0.0028%, the content of B is preferably 0.0005 to 0.0025%, and more preferably 0.001 to 0.002%.

Since the turbine casing covers high pressure steam having a temperature above 620° C., the turbine casing suffers high stress due to the inner pressure. Therefore, from the viewpoint of prevention of creep rupture, the casing material is required to have a creep rupture strength at 625° C. for $10^5$ hours of above 10 kgf/mm$^2$. Further, since a thermal stress acts on the turbine casing when the metal temperature is low at the starting-up period of the turbine, from the viewpoint of prevention of brittle fracture, the casing material is required to have an impact absorption energy at room temperature of above 1 kgf-m. Particularly, the impact absorption energy at a higher temperature can be increased by reducing the content of Co. Especially, it is preferable to select the content of Co to be 1 to 2% for 620° C., the content to be 2.5 to 3.5% for 630° C., the content to be 4 to 5% for 640° C., the content to be 5.5 to 6.5% for 650° C. and the content to be 7 to 8% for 660° C. However, Co free casting steel may be used at each of the above temperatures.

The casing according to the present invention is made of a material which has at least one of the relationships wherein a ratio of (W/Mo) is not less than 2.85 (preferably 2.85 to 4.50, and more preferably 3 to 4), and a ratio of (Mo/Cr) is 0.04 to 0.08 (preferably 0.05 to 0.06). It is preferable when all of the above relationships are satisfied.

In order to manufacture a casing having few defects, a high level manufacturing technology is required, since the casing becomes as large as 50 tons in weight. A sound ferritic heat resisting cast steel of casing material according to the present invention can be manufactured by melting a raw alloy material having the target composition using an electric furnace, degassing by ladle refining, and then casting a sand mold. By performing sufficient refining and deoxidizing before casting, a casing without cast defects, such as shrinkage, can be obtained.

Further, a steam turbine casing capable of operating in a steam environment having a temperature above 621° C. can be manufactured by annealing the cast body at 1000 to 1150° C. after casting, performing normalizing treatment by heating at 1000 to 1100° C. and rapidly cooling, and then tempering twice at a temperature of 550 to 750° C. and at a temperature of 670 to 770° C. When the annealing temperature and the normalizing temperature are below 1000° C., carbo-nitride cannot be sufficiently dissolved, and when the annealing temperature and the normalizing temperature are excessively high, grain coarsening takes place. By performing tempering twice, any remaining austenite can be perfectly dissolved and a martensitic structure can be formed. By manufacturing an ingot through the above method, it is possible to obtain an ingot having a creep rupture strength at 625° C. for $10^5$ hours which is above 10 kgf/mm$^2$, and an impact absorption energy at 0° C. which is above 1 kgf-m or an impact absorption energy at room temperature which is above 3.2 kgf-m, and to provide a steam turbine casing which is capable of operating in a steam environment having a temperature above 620° C.

The casing in accordance with the present invention is preferably made of cast steel having the aforementioned amount of Cr equivalent and an amount of δ-ferrite preferably not more than 5%, and more preferably 0%.

It is also preferable that the inner casing for the intermediate pressure steam turbine is made of a forged steel instead of cast steel.

(7) Others (a) The low pressure steam turbine rotor shaft is preferably made of a low carbon steel having a totally annealed bainitic structure containing C of 0.2 to 0.3%, Si of not more than 0.1%, Mn of not more than 0.2%, Ni of 3.2 to 4.0%, Cr of 1.25 to 2.25%, Mo of 0.1 to 0.6% and V of 0.05 to 0.25%, and is preferably manufactured through the same method as used for the high pressure and the intermediate pressure rotor shafts, as described above. Particularly, it is preferable to manufacture the rotor through a super-clean process in which the raw material has Si of not more than 0.05%, Mn of not more than 0.1% and a small amount of impurities, such as P, S, As, Sb, Sn and so on. That is, it is preferable that the contents of P and S are not more than 0.01%, respectively, and the contents of Sn, As are not more than 0.005%, respectively, and the content of Sb is not more than 0.001%.

(b) The low pressure steam turbine blades, except for the blades in the last stage and the nozzle, are preferably made of a totally annealed martensitic steel containing C of 0.05 to 0.2%, Si of 0.1 to 0.5%, Mn of 0.2 to 1.0%, Cr of 10 to 13 %, Mo of 0.04 to 0.2%.

(c) Both of the low pressure steam turbine inner casing and the low pressure steam turbine outer casing are preferably made of a carbon steel containing C of 0.2 to 0.3%, Si of 0.3 to 0.7%, Mn of not more than 1%.

(d) The main steam stop valve casing and the steam control valve casing are preferably made of a totally annealed martensitic steel containing C of 0.1 to 0.2%, Si of 0.1 to 0.4%, Mn of 0.2 to 1.0%, Cr of 8.5 to 10.5%, Mo of 0.3 to 1.0%, W of 1.0 to 3.0%, V of 0.1 to 0.3%, Nb of 0.03 to 0.1 %, N of 0.03 to 0.08% and B of 0.0005 to 0.003%.

(e) A Ti alloy is used for the low pressure steam turbine blades in the last stage, and especially blades having a length above 40 inches are made of a Ti alloy containing Al of 5 to 8 weight % and V of 3 to 6 weight %. The contents of these elements are increased as the length becomes longer. It is preferable to use a high strength material which contains Al of 5.5 to 6.5% and V of 3.5 to 4.5 for 43 inch length blade, and contains Al of 4 to 7%, V of 4 to 7% and Sn of 1 to 3% for a 46 inch length blade.

(f) The high pressure and the intermediate pressure steam turbine outer casings are preferably made of a cast steel having a totally annealed bainitic structure and containing c of 0.05 to 0.20%, Si of 0.05% to 0.5%, Mn of 0.1 to 1.0%, Ni of 0.1 to 0.5%, Cr of 1 to 2.5%, Mo of 0.5 to 1.5%, V of 0.1 to 0.3%, and preferably further containing at least one of B of 0.001 to 0.01% and Ti of not more than 0.2%.

BRIEF DESCRIPTION OF THE DRAWINGS

FIG. 12 is a side view partly in section showing a main steam stop valve and a control valve.

FIG. 13(*a*) is a plan view showing the construction of a welding crack test piece.

FIG. 13(*b*) is a side view of FIG. 13(*c*).

FIG. 13(*c*) is an enlarged view of a part A of FIG. 13(*b*).

Figure 1:
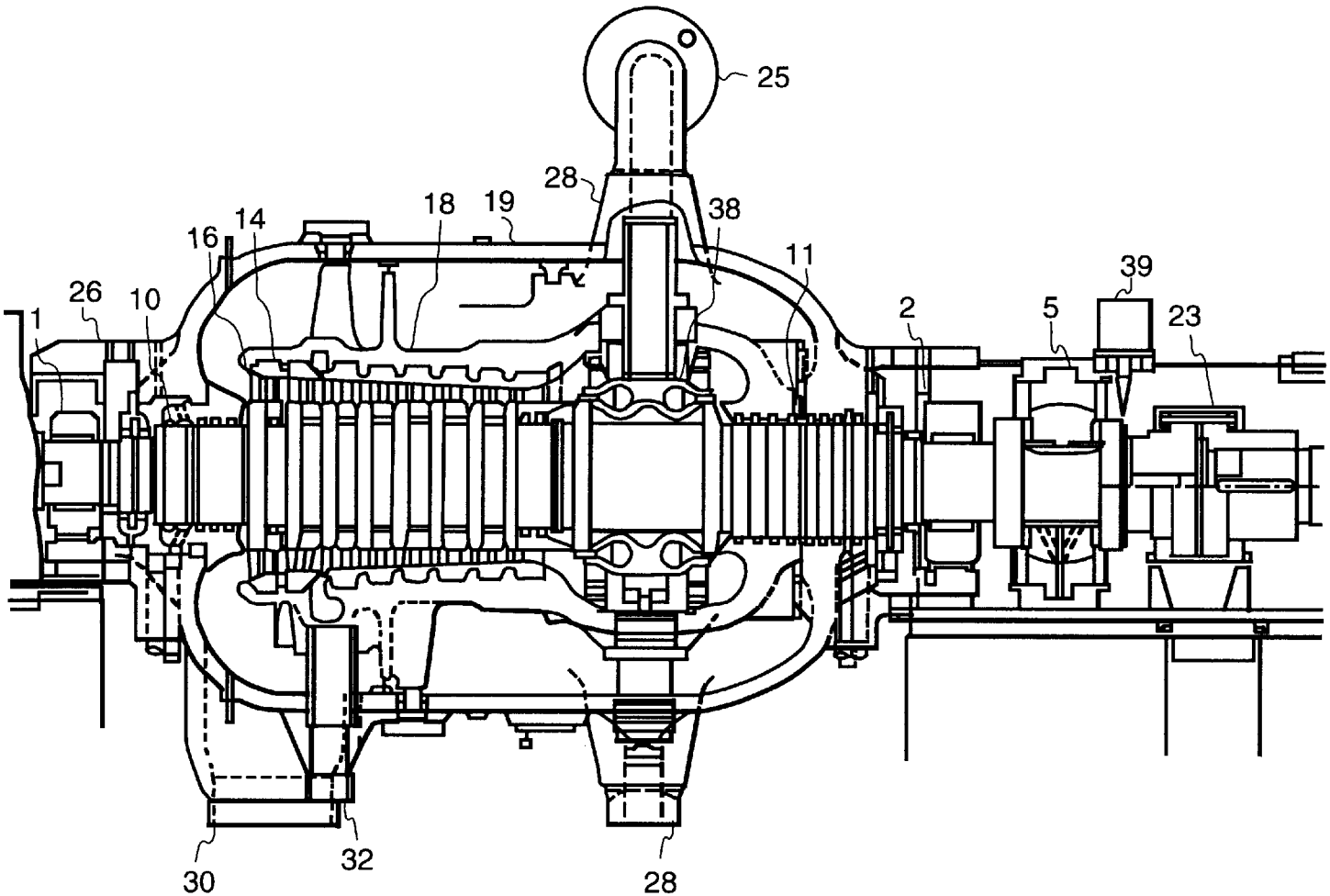
FIG. 1 is a longitudinal cross-sectional view showing the construction of an embodiment of a high pressure steam turbine made of a ferritic steel in accordance with the present invention.

DESCRIPTION OF EMBODIMENTS OF THE INVENTION (Embodiment 1)

With a steep rise in fuel prices after the oil crisis, there has been a need for a pulverized coal direct fired boiler and a steam turbine having a steam temperature of 600° C. to 649° C. in order to increase the thermal efficiency through an improvement in the steam condition. Table 1 defines an example of a boiler having such a steam condition.

TABLE 1

| PLANT OUTPUT<br>OPERATION TYPE | | 1050 MW<br>CONSTANT PRESSURE |
|---|---|---|
| SPECIFICATION OF BOILER | TYPE | Radiant Reheating Ultra-High Critical Pressure Once-through Boiler |
| | STEAM GENERATING RATE | 3170 t/h |
| | STEAM PRESSURE | 24.12 MPa[G] |
| | STEAM TEMPERATURE | 630° C./630° C. |
| PERFORMANCE | COMBUSTION CHARACTERISTIC | |
| | $NO_x$ | 120 ppm |
| | UNBURNED ASH | 3.2% |
| | LOAD CHANGE RATE (50–100%) | 4%/min |
| | MINIMUM LOAD | 33%ECR (Whitbank coal) |

Since steam oxidation occurs with such a high temperature, 8–10% Cr steel is used instead of conventional 2.25% Cr steel. As for high temperature corrosion, pulverized coal direct combustion gas contains a sulfurous composition of 1% at maximum and a chloric composition of 0.1% at maximum. Therefore, the super-heater pipe employs an austenitic stainless steel which contains Cr of 20 to 25%, Ni of 20 to 35%, small amounts of Al and Ti each being less than 0.5%, Mo of 0.5 to 3%, and Nb of preferably not more than 0.5%. Since the pulverized coal direct combustion produces a high temperature, in order to reduce the amount of $NO_x$ it is preferable to employ a burner which will form a burning flame with primary air and pulverized coal, a reduced flame being formed in the periphery of the burning flame by inner peripheral air, and a high temperature flame formed around the reduced flame by blowing secondary air.

The pulverized coal fired furnace becomes large in size with an increase in the capacity. In a 1050 MM class pulverized coal fired boiler, the width of the furnace is 31 m and the depth of the furnace is 16 m. In a 1400 MM class pulverized coal fired boiler, the width of the furnace is 34 m and the depth of the furnace is 18 m.

Table 2 shows the main specification of a 1050 MW steam turbine operating at a steam temperature of 625° C. The turbine of this embodiment is of the cross-compound 4 flow exhaust type, the blade length in the last stage of the low pressure steam turbine being 43 inches, the high pressure steam turbine and the intermediate pressure steam turbine rotating at a speed of 3600 r/min, the two low pressure steam turbines rotating at a speed of 1800 r/min, and the high temperature components being constructed of the main materials shown in the table. The high pressure (HP) turbine is operated at a steam temperature of 625° C. and a pressure of 250 kg/cm$^2$. The intermediate pressure (IP) turbine is operated at a steam temperature of 625° C. by being heated with a reheater and at a pressure of 170 to 180 kg/cm$^2$. Steam having a temperature of 450° C. enters into the low pressure (LP) turbines and is exhausted to the condenser with a temperature of below 100° C. and a pressure of 722 mmHg.

TABLE 2

Figure 15:
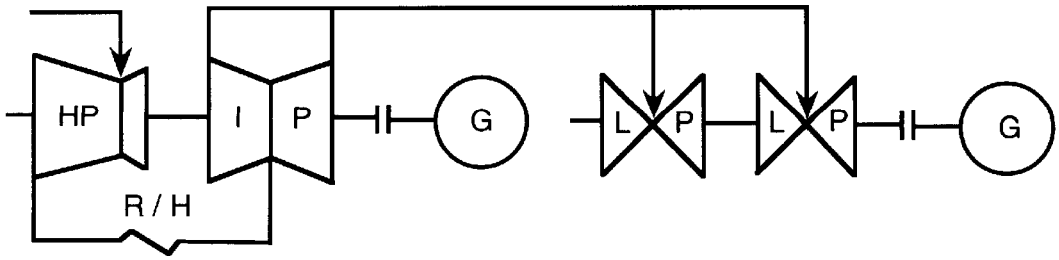
FIG. 15 is a schematic block diagram of a turbine construction according to Table 2.

| | |
|---|---|
| TURBINE TYPE | CC4F-43 |
| TURBINE SPEED | 3600/1800 r/min |
| STEAM CONDITION | 24.1 MPa—625° C./625° C. |
| CONSTRUCTION OF | Shown in FIG. 15 |

TABLE 2-continued

| | | |
|---|---|---|
| TURBINE | | |
| FIRST STAGE BLADE CONSTRUCTION | | Double Flow 2 Tenon Tangential Entry Dovetail Blade |
| LAST-STAGE BLADE | | Titanium Alloy 43 inch Length Blade |
| TOTAL LENGTH OF TURBINE | | HP-IP:13.2 m, LP-LP:22.7 m |
| MAIN STEAM STOP VALVE BODY, and STEAM CONTROL VALVE BODY | | High Strength 12Cr Forged Steel |
| HIGH PRESSURE ROTOR | | High Strength 12Cr Forged Steel |
| INTERMEDIATE PRESSURE ROTOR | | High Strength 12Cr Forged Steel |
| LOW PRESSURE ROTOR | | Super-clean type 3.5Ni—Cr—Mo—V Forged Steel |
| ROTATING BLADE IN HIGH TEMPERATURE PORTION | | First stage, High Strength 12Cr Forged Steel |
| HIGH PRESSURE ROTOR | | |
| CHAMBER | INNER | High Strength 9Cr Cast Steel |
| | OUTER | High Strength Cr—Mo—V—B Cast Steel |
| INTERMEDIATE PRESSURE | | |
| ROTOR CHAMBER | INNER | High Strength 9Cr Cast Steel |
| | OUTER | High Strength Cr—MO—V—B Cast Steel |
| THERMAL EFFICIENCY (RATED, GENERATOR OUTPUT) | | 47.1% |

(CC4F-43: Cross-Compound 4 flow Exhaust Type, employing 43 inch length blades; HP:High Pressure Portion; IP:Intermediate Pressure Portion; LP:Low Pressure Portion; R/H:Reheater (Boiler)).

FIG. 1 is a cross-sectional view showing the construction of a high pressure steam turbine. The high pressure steam turbine comprises a high pressure inner rotor chamber 18, a high pressure outer rotor chamber 19 arranged in the outside of the high pressure inner rotor chamber, and a high pressure rotor shaft 23 having high pressure rotating blades 16. The high temperature and high pressure steam described above is generated by the boiler, flows through a main steam pipe, a flange and an elbow 25 serving as a main steam inlet, and is guided to double flow rotating blades in the first stage from a nozzle box 38 through the main steam inlet 28. The first stage is of a double flow construction and eight stages are provided on the one side. Fixed blades are provided corresponding to the rotating blades in each of the stages. The rotating blade is of the tangential entry dovetail type, double-tenon and has a first stage blade length of nearly 35 mm. The length between bearings is approximately 5.25 m, and the minimum diameter of the rotor shaft at a portion corresponding to the fixed blade portion is approximately 620 mm, the ratio of the length to the diameter is approximately 8.5.

In FIG. 1, the steam turbine includes a first bearing 1, a second bearing 2, a thrust bearing 5, a first shaft packing 10, a second shaft packing 11, a high pressure spacer 14, a front side bearing box 26, a high pressure steam outlet port 30, and a thrust bearing wearing preventing unit 39.

The width of the implanting portion of the rotating blade in the first stage of the rotor shaft is nearly equal to the width of the implanting portion of the rotating blade in the last stage. The width of the implanting portion of the rotating blade decreases stepwise in five steps in the second stage, the third stage to the fifth stage, the sixth stage and the seventh stage to the eighth stage toward the downstream side. The width in the shaft direction of the implanting portion of the rotating blade in the second stage is 0.64 time as small as that in the last stage.

The diameter of the rotor shaft is small in the portion corresponding to the fixed blade portion. The width in the shaft direction of the small diameter portion is decreased compared to the width between the rotating blades in the second stage and the rotating blades in the third stage stepwise up to the width between the rotating blades in the last stage and the rotating blades in the precedent stage, and the latter width is 0.86 times as small as the former width. The width is decreased in two steps, that is, from the second stage to the sixth stage and from the seventh stage to the ninth stage.

The blades in this embodiment are made of 12Cr steel not containing W, Co, B except for the blades in the first stage and the nozzle, which are made of the material shown in Table 3 to be described later. The blade lengths of the rotating blades in this embodiment are 35 to 50 mm in the first stage, and increase gradually from the second stage to the last stage. The blade lengths are from 65 mm to 210 mm in the second stage to the last stage and the number of stages is 9 to 12, varying depending on the output of the steam turbine. The ratio of the blade length in a stage to the blade length in the adjacent stage is 1.10 to 1.15, and the ratio gradually increases as the stage approaches the downstream side.

The diameter of the rotor shaft in a portion implanting the rotating blade is larger than the diameter in a portion corresponding to the fixed blades, and the width in the shaft direction of the implanting portion is larger as the blade length of the rotating blade is longer. The ratio of the width to the blade length of the rotating blade is 0.65 in the second stage to 0.95 in the last stage, and decreases stepwise from the second stage to the last stage.

Further, each width of the rotor shaft in a portion corresponding to each portion of the fixed blades decreases stepwise from the portion between the second stage and the third stage to the portion between the last stage and the precedent stage. The ratio of the width to the blade length of the rotating blade is 0.7 to 1.7, and decreases from the upstream side to the downstream side.

Figure 2:
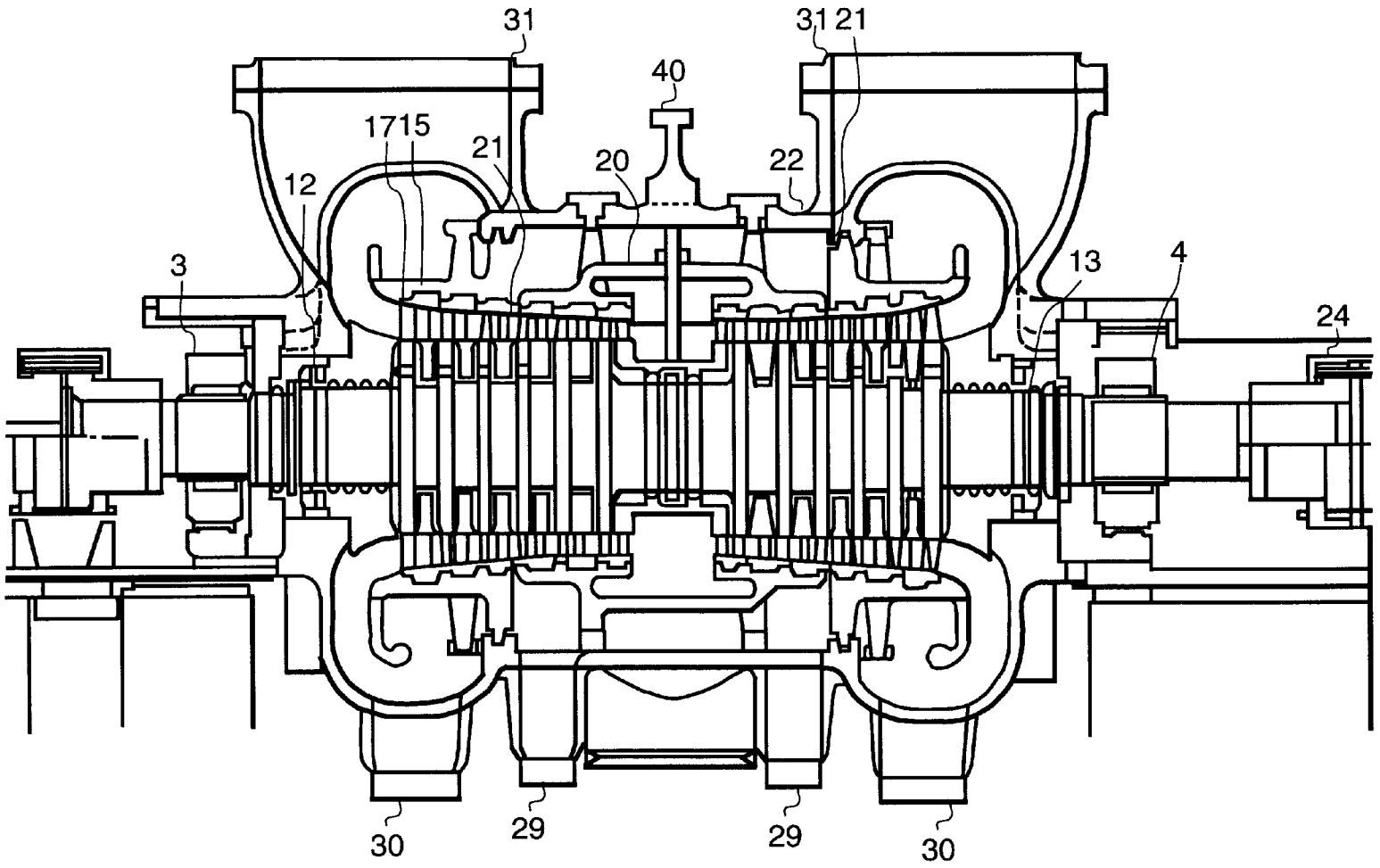
FIG. 2 is a longitudinal cross-sectional view showing the construction of an embodiment of an intermediate pressure steam turbine made of a ferritic steel in accordance with the present invention.

FIG. 2 is a cross-sectional view showing the construction of an intermediate pressure steam turbine. The intermediate pressure steam turbine rotates the generator, together with the high pressure steam turbine, using the steam exhausted from the high pressure steam turbine and heated again up to 625° C. by a reheater, and operates at speed of 3600 rotation/minute. The intermediate pressure steam turbine comprises an intermediate pressure inner rotor chamber 21 and an outer rotor chamber 22, and fixed blades are provided corresponding to intermediate pressure rotating blades 17. The rotating blades are composed of 6 stages and have a double flow construction, and are provided on the right hand side and the left hand side nearly symmetrically in the longitudinal direction of the intermediate pressure rotor shaft. The length between the centers of the bearings is approximately 5.5 m, and the blade length in the first stage is approximately 92 mm and the blade length in the last stage is approximately 235 mm. The dovetail is of inverse Christmas tree-shape. The diameter of the rotor shaft at a portion corresponding to the fixed blade portion just upstream of the rotating blade in the last stage is approximately 630 mm, and the ratio of the length between the bearings to the diameter is approximately 8.7.

In FIG. 2, there is seen a third bearing 3, a fourth bearing 4, a third shaft packing 12, a fourth shaft packing 13, an intermediate pressure spacer 15, an intermediate pressure first rotor chamber 20, an intermediate pressure turbine rotor shaft 24, a re-heating steam inlet port 29, a high pressure steam outlet port 30, a crossover pipe 31, and a warming steam inlet 40.

In the rotor shaft of the intermediate pressure steam turbine of the present embodiment, the width in the shaft direction of the implanting portion of the rotating blade increases stepwise in three steps in the first stage to the fourth stage, the fifth stage and the last stage. The width in the last stage is approximately 1.4 times as large as that in the first stage.

The diameter of the rotor shaft of this steam turbine is small in the portion corresponding to the fixed blade portion. The width of the small diameter portion is decreased stepwise in four steps, from the first stage, the second stage and the third stage, to the last stage, and the latter width is approximately 0.7 times as small as the former width.

The blades in this embodiment are made of 12Cr steel not containing W, Co, B except for the blades in the first stage and the nozzle, which are made of the material shown in Table 3 to be described later. The blade lengths of the rotating blades in this embodiment increase gradually from the first stage to the last stage. The blade lengths are from 90 mm to 350 mm in the first stage to the last stage and the number of stages is 6 to 9, varying depending on the output of the steam turbine. The ratio of the blade length in a stage to the blade length in the adjacent stage is 1.1 to 1.2, and the ratio gradually increases as the stage approaches the downstream side.

The diameter of the rotor shaft in a portion implanting the rotating blade is larger than the diameter in a portion corresponding to the fixed blades, and the width in the shaft direction of the implanting portion is larger as the blade length of the rotating blade is longer. The ratio of the width to the blade length of the rotating blade is 0.5 in the first stage to 0.7 in the last stage, and decreases stepwise from the first stage to the last stage.

Further, each width of the rotor shaft in a portion corresponding to each portion of the fixed blades decreases stepwise from the portion between the first stage and the second stage to the portion between the last stage and the precedent stage. The ratio of the width to the blade length of the rotating blade is 0.5 to 1.5, and decreases from the upstream side to the downstream side.

Figure 3:
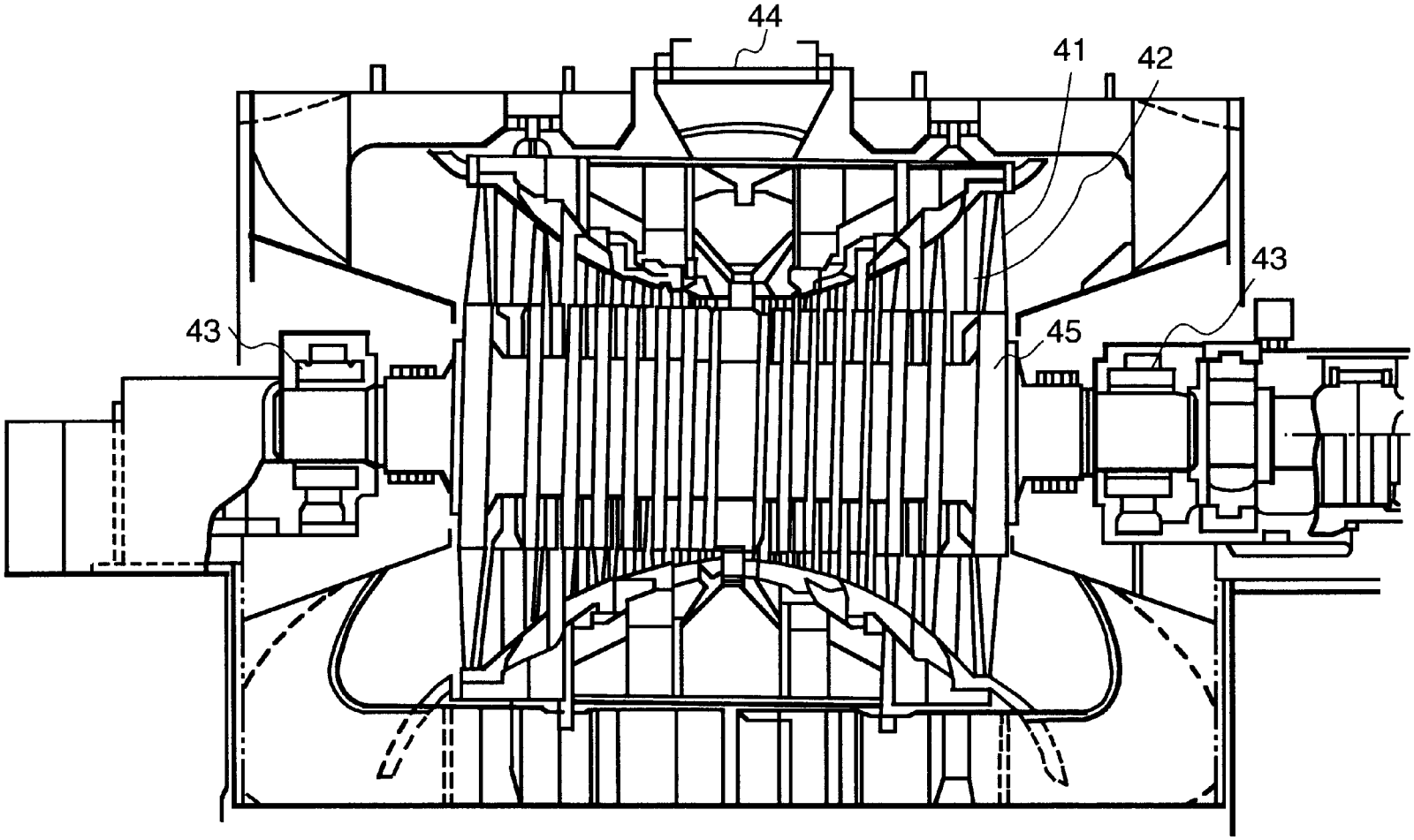
FIG. 3 is a longitudinal cross-sectional view showing the construction of an embodiment of a low pressure steam turbine made of a ferritic steel in accordance with the present invention.

FIG. 3 is a cross-sectional view showing a low pressure steam turbine. Two low pressure steam turbines are connected in tandem and have the same construction. The low pressure steam turbine has 8 stages of rotating blades 41 in each of the right hand side and the left hand side, both being arranged nearly symmetrically, and fixed blades 42 are provided corresponding to the rotating blades. The rotating blades in the last stage have a length of 43 inches and are made of a Ti base alloy. The rotating blades have a double-tenon and tangential entry dovetail, and a nozzle box 44 is of the double flow type. The Ti base alloy is subjected to ageing treatment and contains Al of 6% and V of 4% in weight. The rotor shaft 45 is made of a forged steel having a totally annealed bainitic structure of super-clean material containing Ni of 3.75%, Cr of 1.75%, Mo of 0.4%, V of 0.15%, C of 0.25%, Si of 0.05%, Mn of 0.10% and the remainder of Fe. The rotating blades and the fixed blades, except for those in the last stage, are made of 12% Cr steel containing Mo of 0.1%. The length between the centers of the bearings 43 in this embodiment is 7500 mm, the diameter of the rotor shaft in a portion corresponding to the fixed blade position is approximately 1280 mm, and the diameter of the rotor shaft in a portion of the rotating blade implanting position is 2275 mm. The ratio of the length between the bearings to the diameter of the rotor shaft is approximately 5.9.

In the rotor shaft of the low pressure steam turbine of the present embodiment, the width in the shaft direction of the implanting portion of the rotating blade increases stepwise in four steps in the first stage to the third stage, the fourth stage, the fifth stage, the sixth stage to the seventh stage and the eighth stage. The width in the last stage is approximately 2.5 times as large as that in the first stage.

The diameter of the rotor shaft of this steam turbine is small in the portion corresponding to the fixed blade portion. The width of the small diameter portion is decreased stepwise in three steps, from the first stage to the fifth stage, the sixth stage, to the seventh stage, and the latter width is approximately 1.9 times as small as the former width.

The blade lengths of the rotating blades in this embodiment increase gradually from the first stage to the last stage. The blade lengths are from 90 mm to 1270 mm in the first stage to the last stage and the number of stages is 8 to 9, varying depending on the output of the steam turbine. The ratio of the blade length in a stage to the blade length in the adjacent stage is 1.3 to 1.6, and the ratio gradually increases as the stage approaches the downstream side.

The diameter of the rotor shaft in a portion implanting the rotating blade is larger than the diameter in a portion corresponding to the fixed blades, and the width in the shaft direction of the implanting portion is larger as the blade length of the rotating blade is longer. The ratio of the width to the blade length of the rotating blade is 0.15 in the first stage to 0.91 in the last stage, and decreases stepwise from the first stage to the last stage.

Further, each width of the rotor shaft in a portion corresponding to each portion of the fixed blades decreases stepwise from the portion between the first stage and the second stage to the portion between the last stage and the precedent stage. The ratio of the width to the blade length of the rotating blade is 0.25 to 1.25, and decreases from the upstream side to the downstream side.

In addition to this embodiment, the same construction can be applied to a 1000 MW class large capacity power plant in which the steam inlet temperature to the high pressure steam turbine and the intermediate pressure steam turbine is 610° C. and the steam inlet temperature to the two low pressure steam turbines is 385° C.

Figure 4:
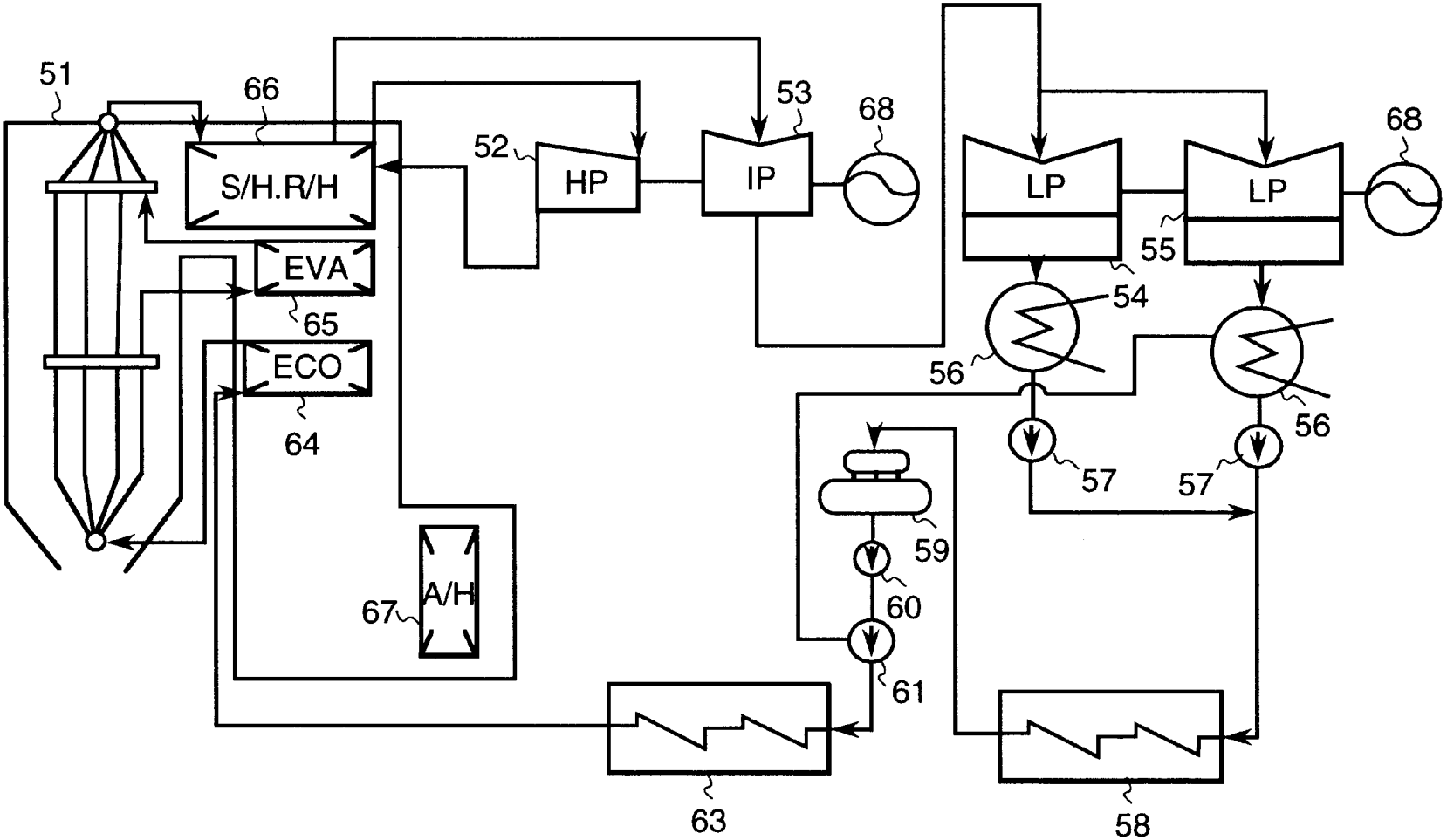
FIG. 4 is a schematic diagram showing the elements of a coal fired power plant in accordance with the present invention.

FIG. 4 is a diagram showing the typical construction of a coal fired high temperature high pressure steam turbine power plant. The high temperature high pressure steam turbine power plant of this embodiment mainly comprises a coal only fired boiler 51, a high pressure steam turbine 52, an intermediate pressure steam turbine 53, a low pressure steam turbine 54, a low pressure steam turbine 55, a condenser 56, a condensate pump 57, a low pressure feed water heater system 58, a deaerator 59, a pressurizing pump 60, a feed pump 61, and a high pressure feed water heater system 63. That is, ultra-high temperature high pressure steam generated in the boiler 51 enters into the high pressure turbine 52 to generate power, and after being reheated in the boiler 51 the steam again enters into the intermediate pressure steam turbine 53 to generate power. The steam exhausted from the intermediate pressure steam turbine enters the low pressure steam turbines 54, 55 to generate power, and then is condensed in the condensers 56. The condensed water is pumped to the low pressure feed water heater system 58 and the deaerator 59 by the condensate pumps 57. The water deaerated in the deaerator 59 is transmitted to the high pressure water heater system 63 by the pressurizing pump 60 and the feed pump 61, and after being heated, the feed water is returned to the boiler 51.

Here, in the boiler 51, the feed water is turned to a high temperature high pressure steam by passing through an economizer 64, an evaporator 65 and a super heater 66. On the other hand, boiler burned gas having heated the steam flows out of the economizer 64 and then enters into an air heater 67 to heat air. Therein, the feed water pump 61 is driven by a feed water pump driving turbine which is operated by extraction of steam from the intermediate pressure steam turbine.

In the high pressure high temperature steam turbine plant having such a construction, since the temperature of the feed water flowing out of the high pressure feed water heater system 63 is higher than the feed water temperature in a conventional thermal power plant, the temperature of the burned gas flowing out of the economizer 64 in the boiler 51 is accordingly substantially higher than that in a conventional thermal power plant. Therefore, heat is recovered from the boiler exhausting gas so that the gas temperature is not reduced.

In addition to this embodiment, it is possible to apply the above rotor shaft to a tandem compound type power plant constructed by connecting the high pressure steam turbine, the intermediate pressure steam turbine and the two low pressure steam turbines which rotate a single generator 68 to generate electricity. In a 1050 MW class generator, as in this embodiment, a higher strength material is used for the generator shaft. Particularly, it is preferable that the material has a totally annealed bainitic structure containing C of 0.15 to 0.30%, Si of 0.1 to 0.3%, Mn of not more than 0.5 %, Ni of 3.25 to 4.5%, Cr of 2.05 to 3.0%, Mo of 0.25 to 0.60 %, V of 0.05 to 0.20%, and having a tensile strength at room temperature of not smaller than 93 kg/mm$^2$, more preferably not smaller than 100 kg/mm$^2$, 50% FATT of not higher than 0° C., more preferably not higher than −20° C., a magnetizing force at 21.2 kG of not larger than 985 AT/cm, a total amount of impurities of P, S, Sn, Sb, As of not more than 0.025%, and a ratio Ni/Cr of not more than 2.0.

Figure 5:
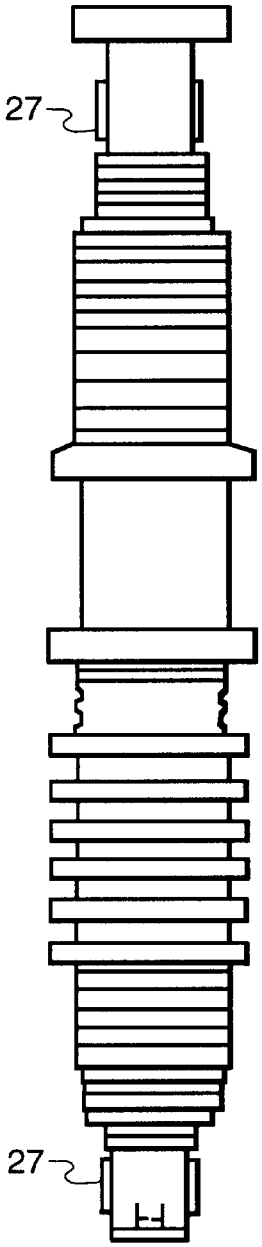
FIG. 5 is a plan view showing an embodiment of a rotor shaft for a high pressure steam turbine in accordance with the present invention.
Figure 6:
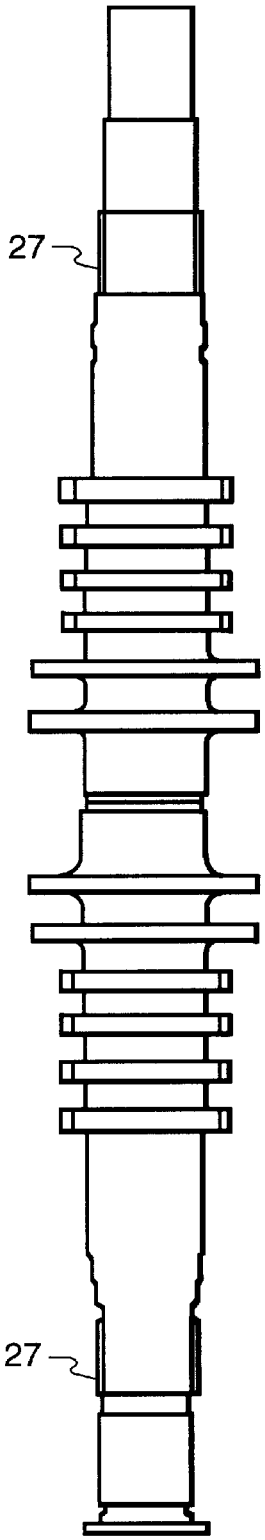
FIG. 6 is a plan view showing an embodiment of a rotor shaft for an intermediate pressure steam turbine in accordance with the present invention.

FIG. 5 is a front view showing a high pressure steam turbine rotor shaft and FIG. 6 is a front view showing an intermediate pressure steam turbine rotor shaft. The high pressure steam turbine rotor shaft has an implanting portion for the first stage blade in the multi-stage side in the middle of the shaft, and 8 stages of blades are implanted. In the intermediate pressure steam turbine rotor shaft, blade implanting portions are provided on the right hand side and on the left hand side from nearly the middle of the rotor shaft so that multi-stages of blades each having 6 stages may be nearly symmetrically implanted. Although a low pressure steam turbine rotor shaft is not shown in the figure, all the high pressure, intermediate pressure and low pressure rotor shafts each have a center hole through which the presence or absence of defects is inspected by ultrasonic inspection, visual inspection or fluorescent penetrant inspection.

In FIGS. 5 and 6, number 27 represents a journal unit.

Table 3 shows the chemical composition (weight %) of materials used for the main components of the high pressure steam turbine, the intermediate pressure steam turbine and the low pressure steam turbine in this embodiment. In this embodiment, since all high temperature portions of the high pressure steam turbine rotor shaft and the intermediate pressure rotor shaft were made of materials having a ferritic crystal structure and a thermal expansion coefficient of $12\times10^{-6}$° C., there occurred no problem due to any difference in the thermal expansion coefficients.

The high pressure steam turbine rotor shaft and the intermediate pressure steam turbine rotor shaft were manufactured by melting heat resisting steel of 30 tons described in Table 3 using an electric furnace, deoxidizing it by carbon vacuum deoxidation, casting it into a metal mold, forging it to form an electrode, remelting the electrode of cast steel so as to be melted from the upper portion to the lower portion through electroslug remelting, and forging to form it in a rotor-shape (1050 mm maximum diameter, 5700 mm length). The forging was performed at a temperature below 1150° C. in order to prevent occurrence of forging cracks. After annealing heat treatment, the forged steel was heated to 1050° C. and subjected to cooling by water spray cooling quenching treatment, and then annealing was carried out twice at a temperature of 570° C. and at a temperature of 690° C., and then machining was performed to form the shapes shown in FIG. 5 and FIG. 6. In this embodiment, the upper side portion of the electroslug ingot was used for the first stage blade side and the lower portion was used for the last stage blade side.

The high pressure steam turbine blades and nozzles and the intermediate pressure steam turbine blades and nozzles were manufactured by melting the heat resisting steel described in Table 3 using a vacuum arc melting furnace, and forging to form it in a blade workpiece shape and a nozzle workpiece shape (150 mm wide, 50 mm height, 1000 mm length). The forging was performed at a temperature below 1150° C. in order to prevent occurrence of forging cracks. The forged steel was heated to 1050° C., and then cooling-by-oil-quenched, annealed at a temperature 690° C., and then machined to form the desired shapes.

The high pressure steam turbine and the intermediate pressure steam turbine inner casings, main steam stop valve casings and steam control valve casings were manufactured by melting the heat resisting steel described in Table 3 using an electric furnace, degassing by ladle refining, and then casting a sand mold. By performing sufficient refining and deoxidizing before casting, casings without cast defects, such as a shrinkage cavity, could be obtained. A weldability evaluation using these casing materials was performed based on JIS Z3158. Temperatures for preheating, inter-pass and initiation of post-heating were set to 200° C. and post-heating treatment was performed in a condition of 400° C.×30 minutes. No welding cracks were observed in the materials according to the present invention, and the weldability was excellent. The oxygen content of the heat resisting steel according to the present invention was 0.0042%.

TABLE 3

| NAME OF MAIN COMPONENT | C | Si | Mn | Ni | Cr | Mo | W | V | Nb | N | Co | B | (wt. %) OTHER | Cr EQUIVALENT | psil-14 RMK |
|---|---|---|---|---|---|---|---|---|---|---|---|---|---|---|---|
| HP PORTION & IP PORTION | | | | | | | | | | | | | | | |
| ROTOR | 0.11 | 0.03 | 0.52 | 0.49 | 10.98 | 0.19 | 2.60 | 0.21 | 0.07 | 0.019 | 2.70 | 0.015 | — | 5.11 (≦9.5) | FS |
| BLADE (FIRST STAGE) | 0.10 | 0.04 | 0.47 | 0.51 | 11.01 | 0.15 | 2.62 | 0.19 | 0.08 | 0.020 | 2.81 | 0.016 | — | 5.07 (≦10) | " |
| NOZZLE (FIRST STAGE) | 0.09 | 0.04 | 0.55 | 0.59 | 10.50 | 0.14 | 2.54 | 0.18 | 0.06 | 0.015 | 2.67 | 0.013 | — | 4.54 (≦10) | " |
| INNER CASING | 0.12 | 0.19 | 0.50 | 0.68 | 8.95 | 0.60 | 1.68 | 0.18 | 0.06 | 0.040 | — | 0.002 | — | 7.57 | CS |
| OUTER CASING | 0.12 | 0.21 | 0.32 | 0.25 | 1.51 | 1.22 | — | 0.22 | — | — | — | 0.005 | Ti 0.05 | — | " |
| INNER CASING FASTENING BOLT | 0.11 | 0.10 | 0.50 | 0.60 | 10.82 | 0.23 | 2.80 | 0.23 | 0.08 | 0.021 | 3.00 | 0.020 | — | 4.72 | FS |
| LP PORTION | | | | | | | | | | | | | | | |
| ROTOR | 0.25 | 0.03 | 0.04 | 3.68 | 1.75 | 0.36 | — | 0.13 | — | — | — | — | — | — | " |
| BLADE | 0.11 | 0.20 | 0.53 | 0.39 | 12.07 | 0.07 | — | — | — | — | — | — | — | — | " |
| NOZZLE | 0.12 | 0.18 | 0.50 | 0.43 | 12.13 | 0.10 | — | — | — | — | — | — | — | — | " |
| INNER CASING | 0.25 | 0.51 | — | — | — | — | — | — | — | — | — | — | — | — | CS |
| OUTER CASING | 0.24 | 0.50 | — | — | — | — | — | — | — | — | — | — | — | — | " |
| MAIN STEAM STOP VALVE CASING | 0.10 | 0.19 | 0.48 | 0.65 | 8.96 | 0.60 | 1.62 | 0.20 | 0.05 | 0.042 | — | 0.002 | — | 8.56 | " |
| STEAM CONTROL VALVE | 0.12 | 0.21 | 0.52 | 0.63 | 9.00 | 0.63 | 1.70 | 0.17 | 0.06 | 0.039 | — | 0.001 | — | 7.97 | " |

| | B + N | N/B | B/Co | Co/Mo | Co/Nb | W/Mo | Mo/Cr |
|---|---|---|---|---|---|---|---|
| HP PORTION & IP PORTION | | | | | | | |
| ROTOR | 0.034 | 1.27 | 0.0056 | 14.2 | 38.6 | 13.7 | 0.0173 |
| BLADE | 0.036 | 1.25 | 0.0057 | 18.7 | 35.1 | 17.5 | 0.0136 |
| NOZZLE | 0.028 | 1.15 | 0.0049 | 19.1 | 44.5 | 18.1 | 0.0133 |
| INNER CASING | — | — | — | — | — | 2.80 | 0.0670 |

FS: forged steel
CS: cast steel

Table 4 shows mechanical properties from cutting tests of the ferritic steels for high temperature steam turbine main components and the heat treatment conditions.

As the result of testing the central portion of the rotor shafts, it was confirmed that the characteristics required for the high pressure and intermediate pressure steam turbine rotors (625° C., $10^5$ h strength≧13 kgf/mm$^2$, 20° C. impact absorption energy≧1.5 kg-m) were satisfied. Thus, it was confirmed that it is possible to manufacture a steam turbine rotor capable of operating in steam having a temperature of above 620° C.

As a result of testing the blades, it was confirmed that the characteristics required for the high pressure and intermediate pressure steam turbine blades in the first stage (625° C., $10^5$ h strength≧15 kgf/mm$^2$) were satisfied. Thus, it was confirmed that it is possible to manufacture a steam turbine blade capable of operating in steam having a temperature of above 620° C.

As a result of testing the casings, it was confirmed that the characteristics required for the high pressure and intermediate pressure steam turbine casings (625° C., $10^5$ h strength≧10 kgf/mm$^2$, 20° C. impact absorption energy≧1 kg-m) were satisfied. Thus, it was confirmed that it is possible to manufacture a steam turbine casing capable of operating in steam having a temperature of above 620° C.

TABLE 4

| NAME OF MAIN COMPONENT | TENSILE STRENGTH (kg/mm$^2$) | 0.2% YIELD (kg/mm$^2$) | ELONGATION (%) | CONTRACTION (%) | IMPACT VALUE (kg-m) | FATT (%) | $10^3$ h CREEP RUPTURE STRENGTH (kg/mm$^2$) 625° C. | 575° C. | 450° C. | HEAT TREATMENT CONDITION |
|---|---|---|---|---|---|---|---|---|---|---|
| HP PORTION & IP PORTION | | | | | | | | | | |
| ROTOR | 90.5 | 78.6 | 20.6 | 66.8 | 3.8 | 40 | 17.0 | — | — | 1050° C. × 15 h water spray cool, 570° C. × 20 h furnace cool, 690° C. × 20 h furnace cool |
| BLADE | 93.4 | 81.5 | 20.9 | 69.8 | 4.1 | — | 18.1 | — | — | 1075° C. × 1.5 h oil cool, 740° C. × 5 h air cool |

TABLE 4-continued psil-14

| NAME OF MAIN COMPONENT | TENSILE STRENGTH (kg/mm²) | 0.2% YIELD (kg/mm²) | ELON-GATION (%) | CON-TRAC-TION (%) | IMPACT VALUE (kg-m) | FATT (%) | $10^3$ h CREEP RUPTURE STRENGTH (kg/mm²) 625° C. | 575° C. | 450° C. | HEAT TREATMENT CONDITION |
|---|---|---|---|---|---|---|---|---|---|---|
| NOZZLE | 93.0 | 80.9 | 21.4 | 70.3 | 4.8 | — | 17.8 | — | — | 1050° C. × 1.5 h oil cool, 690° C. × 5 h air cool |
| INNER CASING | 79.7 | 60.9 | 19.8 | 65.3 | 5.3 | — | 11.2 | — | — | 1050° C. × 8 h air blow cool, 600° C. × 20 h furnace cool, 730° C. × 10 h furnace cool |
| OUTER CASING | 68.6 | 57.2 | 20.4 | 65.4 | 1.5 | — | — | 12.5 | — | 1050° C. × 8 h air blow cool, 725° C. × 10 h furnace cool |
| INNER CASING FASTENING BOLT | 107.1 | 91.0 | 19.5 | 88.7 | 2.0 | — | 18.0 | — | — | 1075° C. × 2 h oil cool, 740° C. × 5 h air cool |
| LP PORTION | | | | | | | | | | |
| ROTOR | 91.8 | 80.0 | 22.0 | 70.1 | 19.1 | −50 | — | — | 36 | 950° C. × 30 h water spray cool, 605° C. × 45 h furnace cool |
| BLADE | 80.0 | 66.0 | 22.1 | 67.5 | 3.5 | — | — | — | 27 | 950° C. × 1.5 h oil cool, 650° C. × 5 h air cool |
| NOZZLE | 79.8 | 65.7 | 22.4 | 69.6 | 3.8 | — | — | — | 26 | 950° C. × 1.5 h oil cool, 650° C. × 5 h air cool |
| INNER CASING | 41.5 | 22.2 | 22.2 | 81.0 | — | — | — | — | — | — |
| OUTER CASING | 41.1 | 20.3 | 24.5 | 80.5 | — | — | — | — | — | — |
| MAIN STEAM STOP VALVE CASING | 77.0 | 61.0 | 18.6 | 65.0 | 2.5 | — | 11.2 | — | — | 1050° C. × 8 h air blow cool, 600° C. × 20 h furnace cool, 730° C. × 10 h furnace cool |
| STEAM CONTROL VALVE CASING | 77.5 | 61.6 | 18.2 | 64.8 | 2.4 | — | 11.0 | — | — | 1050° C. × 8 h air blow cool, 600° C. × 20 h furnace cool, 730° C. × 10 h furnace cool |

Figure 7:
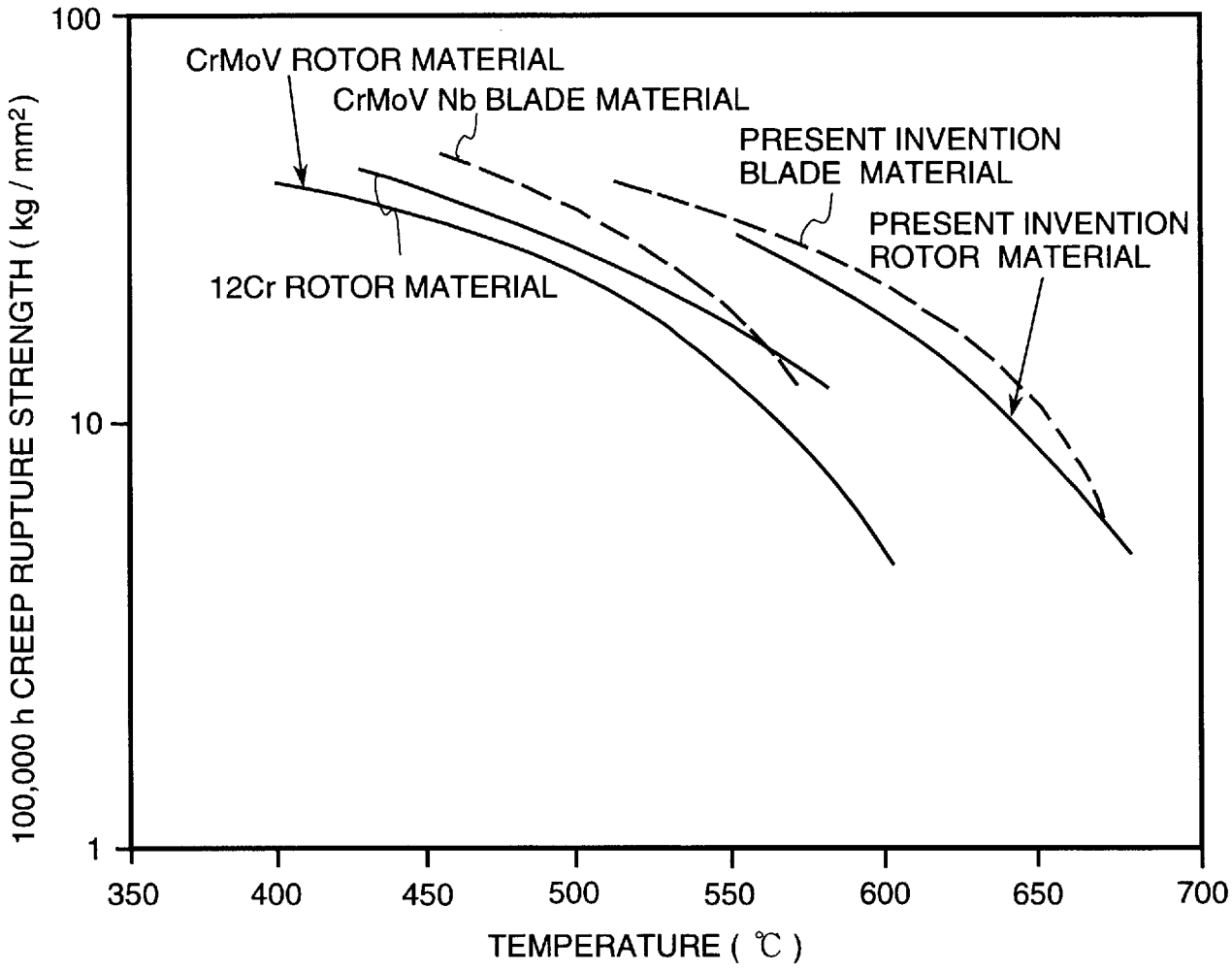
FIG. 7 is a graph showing creep rupture strengths for rotor shaft materials.

FIG. 7 is a graph showing the relationship between $10^5$ hour creep rupture strength for the rotor shaft materials and temperature. It can be understood that the materials according to the present invention have a sufficient creep rupture strength at 610 to 640° C. Therein, the 12Cr rotor material is a conventional material not containing B, W, Co.

In this embodiment, the journal portion of the rotor shaft was formed with build-up welding of Cr—Mo low alloy steel in order to improve the bearing characteristic. The build-up welding was performed in a manner as follows.

Sheathed arc welding rods (4.0ϕ diameter) were used as the test welding rods. Table 5 shows the chemical compositions (weight %) of the deposited metals produced when welded using the welding rods. The composition of the deposited metals were nearly the same as the composition of the welded material.

The welding conditions involved in a welding current of 170 A, a voltage of 24 V and speed was 26 cm/min.

TABLE 5

| No. | C | Si | Mn | P | S | Ni | Cr | Mo | Fe |
|---|---|---|---|---|---|---|---|---|---|
| A | .06 | .45 | .65 | .010 | .011 | — | 7.80 | 0.50 | Re |
| B | .03 | .65 | .70 | .009 | .008 | — | 5.13 | 0.53 | Re |
| C | .03 | .79 | .56 | .009 | .012 | .01 | 3.34 | 1.04 | Re |
| D | .03 | .70 | .90 | .007 | .016 | .03 | 1.30 | 0.57 | Re |

Re: remainder

Eight layers of build-up welding were formed on the surface of the test base material described above combining the welding rods used for each of the layers, as shown in Table 6. The thickness of each of the layers was 3 to 4 mm, and the total thickness was approximately 28 mm, and the surface was ground by approximately 5 mm.

The welding work conditions involving temperatures for preheating, inter-pass and initiation of stress release annealing (SR) were set to 250 to 350° C. and the SR treatment condition was 630° C.×36 hours holding.

All of the Test piece No. 1, No. 2 and No. 3 are based on the present invention, and the layers after the fifth layer were welded using the welding rod having the composition No. C or No. D, as shown in Table 6.

TABLE 6

| TP NO. | LAYER 1 | LAYER 2 | LAYER 3 | LAYER 4 | LAYER 5 | LAYER 6 | LAYER 7 | LAYER 8 |
|---|---|---|---|---|---|---|---|---|
| 1 | A | B | C | C | C | C | C | C |
| 2 | B | C | D | D | D | D | D | D |
| 3 | A | B | C | D | D | D | D | D |

TP NO.: test piece No. Roman character indicates kind of welding rod used.

In order to confirm the performance of the welded portion, a 160° side bending test was conducted on plate material on which the same build-up welding was performed. As a result, there was observed no crack in the welded portion.

Further, a bearing sliding test was conducted by rotating the shaft according to the present invention. As a result, there was observed no ill effect on the bearing, and the bearing was excellent in oxidation resistivity.

In addition to this embodiment, it is possible to apply the above bearing to a tandem compound type power plant constructed by connecting the high pressure turbine, the intermediate pressure turbine and the two low pressure steam turbines which rotate a single generator to generate electricity.

Table 7 shows the chemical composition of the Ni base deposition strengthening alloy used for the rotating blades up to the third stage in the high pressure steam turbine and the rotating blades in the first state in the intermediate pressure steam turbine operated by steam having a temperature above 640° C. These alloys were obtained by hot forging after manufacturing an ingot through vacuum arc remelting, performing solution treatment at a temperature of 1070 to 1200° C. for 1 to 8 hours depending on the alloy composition and being cooled by air after heating, and then performing ageing treatment by heating at a temperature 700 to 870° C. for 4 to 24 hours.

The high strength martensitic steel according to the present invention was used for the blades in the fourth stage and the fifth stage in the high pressure steam turbine and blades in the second stage and the third stage in the intermediate pressure steam turbine. In addition to this embodiment, it is possible to use the aforementioned Ni base alloy for the blades in the first stages in the high pressure steam turbine and the intermediate pressure steam turbine operating with steam having a temperature of 610 to 638° C., and the high strength martensitic steel according to the present invention is used for the blades in the second stage and the third stage of the high pressure steam turbine and the blades in the second stage of in the intermediate pressure steam turbine.

TABLE 7

| No. | C | Si | Mn | P | S | Ni | Cr | Mo | Co | Al | Ti | B | Fe | N |
|---|---|---|---|---|---|---|---|---|---|---|---|---|---|---|
| 1 | 0.047 | <0.01 | <0.01 | 0.02 | 0.0006 | 36.5 | 18.06 | 2.92 | 19.10 | 0.19 | 2.80 | 0.005 | Bal. | 0.0017 |
| 2 | 0.13 | 0.02 | <0.01 | 0.003 | 0.0008 | Bal. | 18.86 | 9.84 | 9.92 | 1.13 | 2.76 | 0.011 | 1.47 | 0.0014 |
| 3 | 0.12 | 0.02 | <0.01 | 0.002 | 0.0003 | Bal. | 19.0 | 9.70 | — | 1.14 | 2.67 | 0.007 | — | 0.0015 |
| 4 | 0.03 | <0.01 | <0.01 | 0.002 | 0.0004 | Bal. | 12.0 | 9.93 | 5.03 | 0.63 | 2.67 | 0.007 | 3.6 | 0.0015 |
| 5 | 0.03 | <0.01 | <0.01 | 0.002 | 0.0004 | Bal. | 12.31 | 9.96 | 10.08 | 0.62 | 2.67 | 0.008 | 3.56 | 0.0015 |
| 6 | 0.03 | <0.01 | <0.01 | 0.002 | 0.0005 | Bal. | 12.32 | 15.04 | — | 0.62 | 2.66 | 0.006 | 3.55 | 0.0015 |
| 7 | 0.03 | <0.01 | <0.01 | 0.002 | 0.0004 | Bal. | 12.31 | 20.0 | — | 0.62 | 2.66 | 0.006 | 3.55 | 0.0015 |

(Embodiment 2)

Rods were manufactured by melting alloys having the components shown in Table 8 through vacuum induction melting, casting to form 10 kg ingots, and then forging to form rods having a cross section of 30 mm square. Table 9 shows the relation of the ratios of the components. In a case of simulating a large steam turbine rotor shaft, in order to simulate the central portion of the rotor shaft, the rod was subjected to quenching of 1050° C.×5 h, and primary annealing of 570° C.×20 h, and second annealing of 690° C.×20 h. In a case of simulating a blade, the rod was subjected to quenching of 1100° C.×1 h and 100° C./h cooling, and tempering of 750° C.×1 h. Then, a creep rupture test was conducted under the condition of 625° C. and 30 kgf/mm$^2$. The results are shown in Table 7 together with the compositions of the alloys.

It can be understood from Table 8 that the creep rupture life of the alloys No. 1 to No. 9 according to the present invention is very long compared to that of the reference alloy No. 10.

The alloy No. 10 among the reference alloys is an alloy in which Co is omitted in the alloy according to the present invention.

Figure 8:
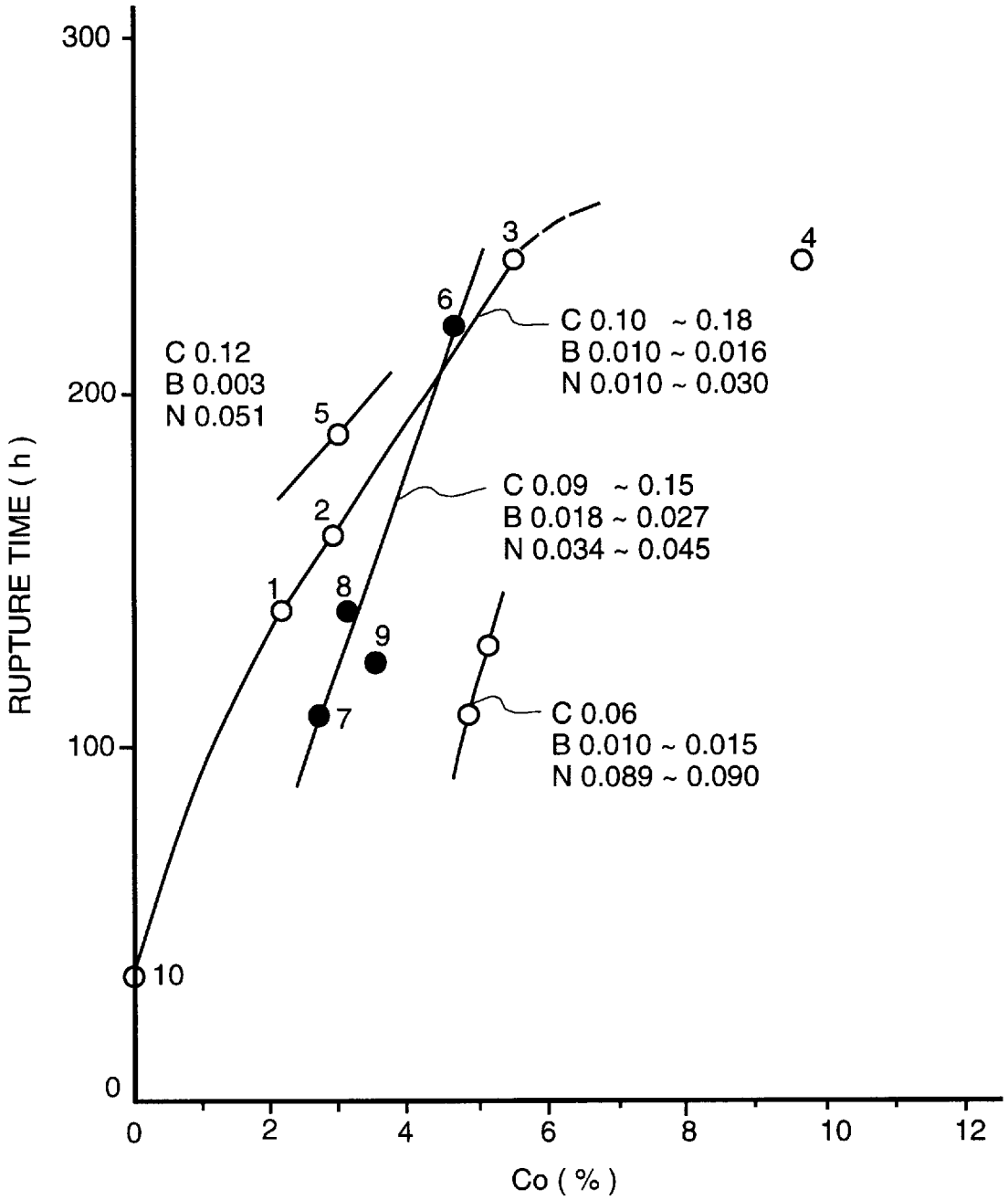
FIG. 8 is a graph showing the relationship between creep rupture time and amount of Co.
Figure 9:
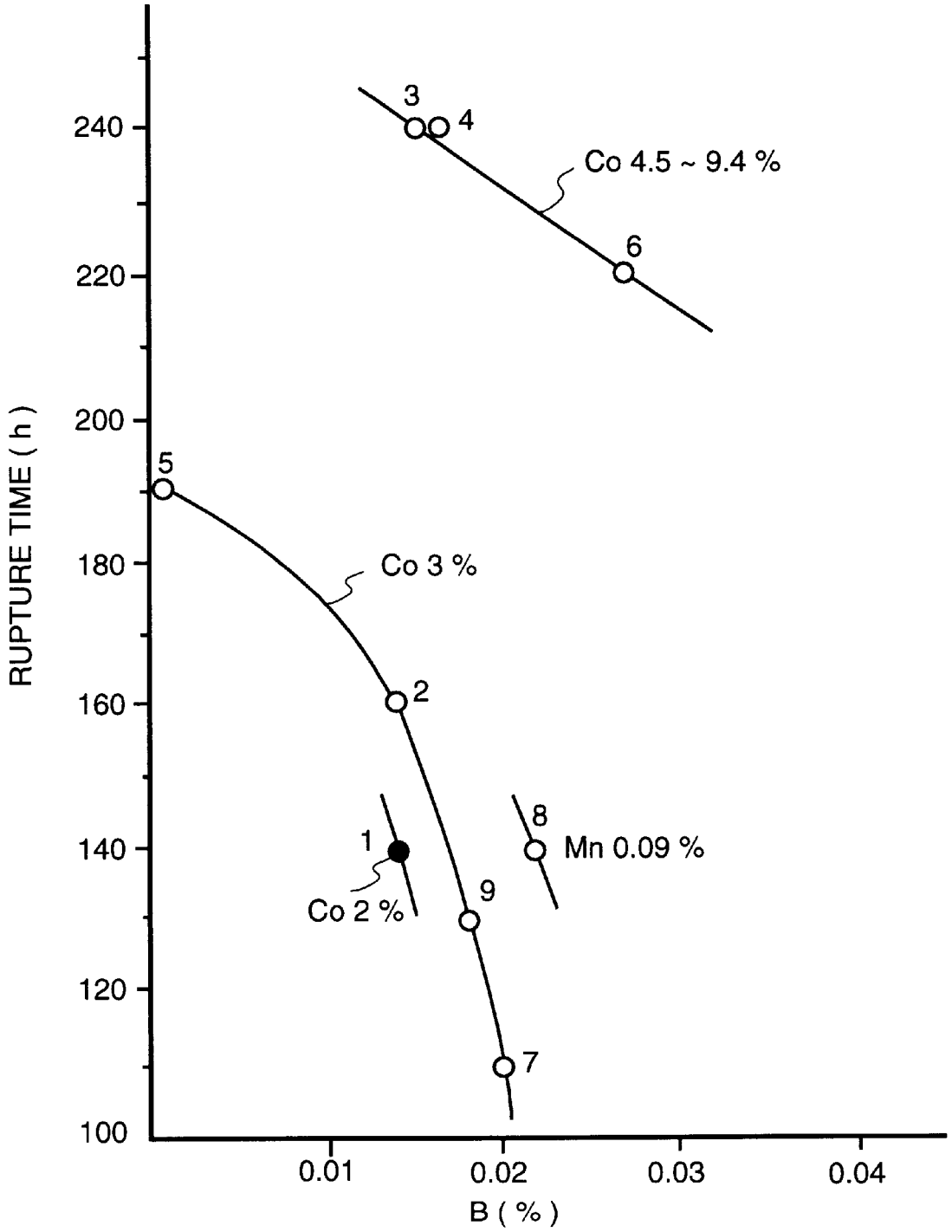
FIG. 9 is a graph showing the relationship between creep rupture time and amount of B.

FIG. 8 is a graph showing the relationship between the creep rupture time and the amount of Co. FIG. 9 is a graph similarly showing the relationship between the creep rupture time and the amount of B. As shown in FIG. 8, the creep rupture time is increased as the content of Co is larger. However, when the content of Co is excessively increased, temper embrittlement is apt to occur due to heating at 600 to 660° C. Therefore, in order to increase both of the strength and the toughness, it is preferable that the content of Co is 2 to 5% for temperatures of 620 to 630° C., and the content of Co is 5.5 to 8% for temperatures of 630 to 660° C.

As shown in FIG. 9, when the content of B is increased, the strength is decreased, and an excellent strength is shown when the content of B is below 0.03%. High strength can be attained by adjusting the content of B to 0.001 to 0.01% and the content of Co to 2 to 4% for temperatures of 620 to 630° C., and the content of B to 0.01 to 0.03% and the content of Co to 5 to 7.5% for temperatures of 630 to 660° C.

It is revealed that when the temperature exceeds 600° C. in the present embodiment, the strength becomes high as the content of N is decreased, that is, the strength of No. 2 is higher than that of No. 8 having a larger amount of N. It is preferable that the content of N is 0.01 to 0.04%. Since little of the element N is provided in a case of performing vacuum melting, the element is added by the base alloy.

As shown in Table 8, it is clear that all of the alloys according to the present invention show high strengths, as shown FIG. 7 of Embodiment 1. The rotor material shown in Embodiment 1 corresponds to the alloy No. 2 in this embodiment.

As shown in FIG. 9, the alloy No. 8 having a small amount of Mn, such as 0.09% shows a higher strength compared to the alloy having the same amount of Co. Therefore, in order to further strengthen the material, it is preferable that the content of Mn is adjusted to 0.03 to 0.20%.

(Embodiment 3)

Table 10 shows the chemical compositions (weight %) of the inner casing materials according to the present invention. The test piece was manufactured, assuming thick thickness portions of a large sized casing, by melting a raw material of 200 kg using a high frequency induction melting furnace, casting the melted steel into a sand mold having maximum thickness of 200 mm, a width of 380 mm and a height of 440 mm to produce an ingot. The test pieces No. 3 and No. 7 are made of materials of the present invention, and the test pieces No. 1 and No. 2 are made of conventional materials. The test pieces No. 1 and No. 2 are Cr–Mo—V cast steel and 11Cr—1Mo–V—N—N cast steel which are used for existing turbines. The test pieces were subjected to annealing treatment of 1050° C.×8 h and furnace cooling, and then were heat treated (normalizing treatment and tempering treatment), simulating a thick thickness portion of a large steam turbine casing under the following conditions.

Test piece No. 1:

1050° C.×8 h air cooling

710° C.×7 h air cooling

710° C.×7 h air cooling

Test pieces No. 2 to No. 7:

1050° C.×8 h air cooling

710° C.×7 h air cooling

710° C.×7 h air cooling

A weldability evaluation using these casing materials was performed based on JIS Z3158. Temperatures for preheating, inter-pass and initiation of post-heating were set to 200° C. and post-heating treatment was performed in a condition of 400° C.×30 minutes.

TABLE 8

| | CHEMICAL COMPOSITION (WEIGHT %) | | | | | | | | | | | | | CREEP RUPTURE TIME (h) 625° C. - 30 kgf/mm² | |
|---|---|---|---|---|---|---|---|---|---|---|---|---|---|---|---|
| No. | C | Si | Mn | Ni | Cr | Mo | W | V | Nb | Co | N | B | Fe | ROTOR SHAFT | BLADE |
| 1 | 0.11 | 0.01 | 0.50 | 0.54 | 10.72 | 0.15 | 2.61 | 0.20 | 0.09 | 2.15 | 0.025 | 0.014 | Bal | 140 | 278 |
| 2 | 0.11 | 0.01 | 0.50 | 0.50 | 10.98 | 0.15 | 2.59 | 0.21 | 0.09 | 2.87 | 0.025 | 0.014 | " | 161 | 315 |
| 3 | 0.11 | 0.01 | 0.51 | 0.53 | 11.00 | 0.16 | 2.55 | 0.22 | 0.08 | 5.79 | 0.027 | 0.015 | " | 241 | 508 |
| 4 | 0.11 | 0.01 | 0.48 | 0.49 | 11.03 | 0.18 | 2.60 | 0.19 | 0.08 | 9.43 | 0.030 | 0.016 | " | 240 | 488 |
| 5 | 0.12 | 0.01 | 1.30 | 0.11 | 11.24 | 0.20 | 2.65 | 0.18 | 0.11 | 2.98 | 0.051 | 0.003 | " | 192 | 392 |
| 6 | 0.13 | 0.01 | 0.15 | 0.89 | 11.35 | 0.09 | 2.91 | 0.27 | 0.10 | 4.50 | 0.045 | 0.027 | " | 219 | 456 |
| 7 | 0.09 | 0.01 | 0.64 | 0.09 | 10.54 | 0.32 | 3.33 | 0.14 | 0.15 | 2.77 | 0.028 | 0.020 | " | 111 | 225 |
| 8 | 0.15 | 0.01 | 0.09 | 0.33 | 12.63 | 0.27 | 2.46 | 0.16 | 0.08 | 3.01 | 0.035 | 0.022 | " | 140 | 286 |
| 9 | 0.12 | 0.01 | 0.37 | 0.71 | 10.22 | 0.14 | 2.41 | 0.23 | 0.06 | 3.45 | 0.034 | 0.018 | " | 126 | 258 |
| 10 | 0.11 | 0.01 | 0.51 | 0.50 | 10.78 | 0.15 | 2.58 | 0.21 | 0.14 | — | 0.026 | 0.013 | " | 34 | 78 |
| 11 | 0.09 | 0.02 | 0.53 | 0.51 | 11.00 | 0.23 | 2.66 | 0.22 | 0.07 | 2.53 | 0.020 | 0.018 | " | — | — |
| 12 | 0.10 | 0.05 | 0.48 | 0.58 | 10.90 | 0.20 | 2.72 | 0.19 | 0.05 | 2.51 | 0.035 | 0.011 | " | — | — |
| 13 | 0.10 | 0.04 | 0.50 | 0.60 | 11.01 | 0.20 | 2.60 | 0.20 | 0.06 | 2.50 | 0.018 | 0.010 | " | — | — |

TABLE 9

| No. | B + N | N/B | B/Co | Co/Mo | Co/Nb |
|---|---|---|---|---|---|
| 1 | 0.039 | 1.79 | 0.0065 | 14.3 | 23.9 |
| 2 | 0.039 | 1.79 | 0.0049 | 19.1 | 31.9 |
| 3 | 0.042 | 1.80 | — | — | — |
| 4 | 0.046 | 1.89 | — | — | — |
| 5 | 0.054 | 17.0 | 0.0010 | 14.9 | 27.1 |
| 6 | 0.072 | 1.67 | — | — | — |
| 7 | 0.048 | 1.40 | 0.0072 | 8.7 | 18.5 |
| 8 | 0.057 | 1.59 | 0.0073 | 11.1 | 37.6 |
| 9 | 0.052 | 1.89 | 0.0052 | 24.6 | 57.5 |
| 10 | 0.039 | 2.00 | — | — | — |
| 11 | 0.038 | 1.11 | 0.0071 | 11.0 | 36.1 |
| 12 | 0.046 | 3.18 | 0.0044 | 12.6 | 50.2 |
| 13 | 0.028 | 1.80 | 0.0040 | 12.5 | 41.7 |

TABLE 10

| TP | C | Si | Mn | Ni | Cr | Mo | W | V | Nb | N | B | OTHER | Cr EQ | W/Mo | Mo/Cr |
|---|---|---|---|---|---|---|---|---|---|---|---|---|---|---|---|
| 1 | 0.15 | 0.44 | 0.77 | 0.20 | 1.28 | 1.12 | — | 0.19 | — | — | — | Ti 0.02 | — | — | — |
| 2 | 0.13 | 0.40 | 0.52 | 0.55 | 10.25 | 0.90 | — | 0.20 | 0.10 | 0.05 | — | — | 9.01 | — | — |
| 3 | 0.12 | 0.22 | 0.51 | 0.82 | 9.05 | 0.59 | 1.59 | 0.21 | 0.06 | 0.05 | 0.0031 | — | 7.13 | 2.70 | 0.065 |
| 4 | 0.13 | 0.20 | 0.50 | 0.61 | 8.97 | 0.11 | 1.60 | 0.19 | 0.07 | 0.05 | 0.0019 | ○0.0055 | 5.31 | 14.6 | 0.012 |
| 5 | 0.13 | 0.22 | 0.49 | 0.95 | 9.00 | 0.65 | 1.06 | 0.20 | 0.05 | 0.05 | 0.0015 | — | 5.48 | 1.63 | 0.072 |
| 6 | 0.12 | 0.20 | 0.48 | 0.61 | 9.00 | 0.62 | 1.66 | 0.19 | 0.07 | 0.03 | 0.0010 | ○0.0051 | 8.21 | 2.68 | 0.069 |
| 7 | 0.12 | 0.19 | 0.50 | 0.58 | 9.10 | 0.68 | 1.68 | 0.20 | 0.06 | 0.02 | 0.0015 | ○0.0045 | 8.66 | 2.47 | 0.075 |
| 8 | 0.12 | 0.15 | 0.50 | 0.60 | 9.51 | 0.51 | 1.75 | 0.20 | 0.06 | 0.04 | 0.0015 | ○0.0040 | 8.12 | 3.43 | 0.054 |
| 9 | 0.12 | 0.15 | 0.52 | 0.55 | 9.55 | 0.48 | 1.90 | 0.20 | 0.06 | 0.04 | 0.0016 | ○0.0035 | — | 3.96 | 0.050 |

TP: test piece
Cr EQ: Cr equivalent

Table 11 shows the results of tensile characteristic at room temperature, Charpy V-notch impact absorption energy at 20° C., creep rupture strength at 650° C., $10^5$ h and welding crack test.

The creep rupture strength and the impact absorption energy of the materials according to the present invention (No. 3, 4, 6–9) having a proper amount added of B, Mo and W sufficiently satisfy the characteristics (625° C., $10^5$ h strength≧8 kgf/mm$^2$, 20° C. impact absorption energy≧1 kg-m) required for the high temperature high pressure steam turbine casing. Particularly, the alloys No. 3, No. 6 and No. 7 show high values of strength above 9 kgf/mm$^2$ and an impact value above 3.2 kgf-m. Further, no welding crack was observed in the material according to the present invention, that is, the weldability was excellent. As a result of studying the relation between the content of B and the occurrence of welding cracks, when the content of B exceeded 0.0035%, welding cracks were produced. There was some possibility of occurrence of a few cracks in the alloy No. 3. As to the effect of element Mo on the mechanical properties, the alloy containing Mo in an amount as high as 1.18% was low in impact value and could not satisfy the required toughness, though the creep rupture strength was high. On the other hand, the alloy containing Mo in an amount of 0.11% was low in creep rupture strength and could not satisfy the required strength, though the toughness was high.

As a result of studying the effect of element W on the mechanical properties, when the content of W was above 1.1%, the creep rupture strength was substantially increased. However, when the content of W was above 2%, the impact absorption energy at room temperature was decreased. Especially, by adjusting the ratio Ni/W to 0.25 to 0.75, it is possible to obtain a heat resisting cast steel casing material having a creep rupture strength at 625° C. for $10^5$ h of above 9 kgf/mm$^2$ and an impact absorption energy at room temperature of above 1 kgf-m, which are required for the high pressure and the intermediate pressure inner casings and the main steam stop valve and the control valve casings of the high temperature high pressure steam turbines operated under a condition of a temperature above 621° C. and a pressure above 250 kgf/cm$^2$. Especially, by adjusting the content of W to 1.2 to 2% and the ratio Ni/W to 0.25 to 0.75, it is possible to obtain an excellent heat resisting cast steel casing material having a creep rupture strength at 625° C. for $10^5$ h of above 10 kgf/mm2 and an impact absorption energy at room temperature of above 2 kgf-m.

Figure 10:
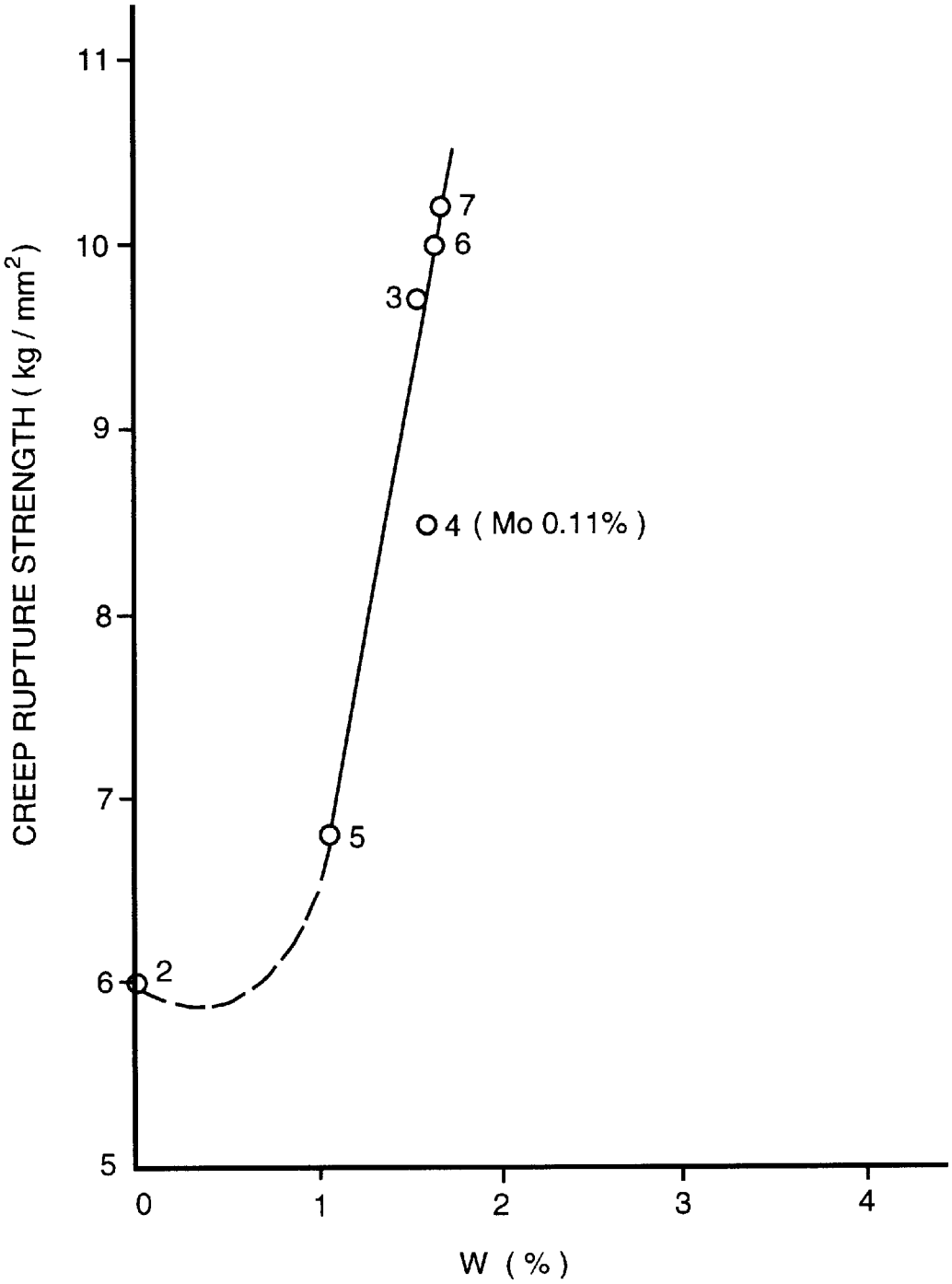
FIG. 10 is a graph showing the relationship between creep rupture strength and amount of W.

FIG. 10 is a graph showing the relationship between the creep rupture strength and the amount of W. As shown in the figure, the creep rupture strength can be substantially increased by adjusting the content of W above 1.0%, and particularly the creep rupture strength can be increased above 9.0 kg/mm$^2$ when the content of W is above 1.5%.

Figure 11:
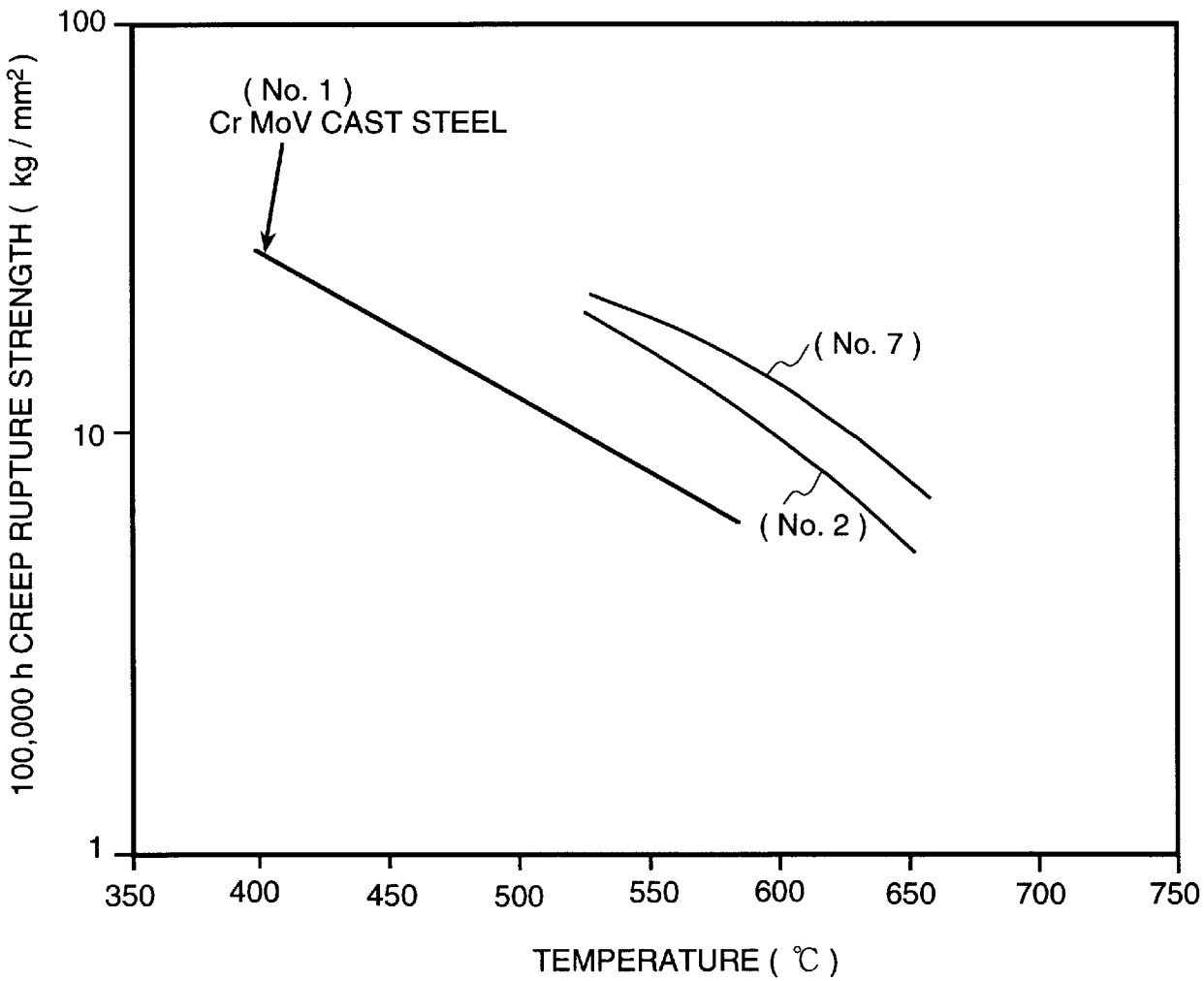
FIG. 11 is a graph showing creep rupture strengths for casing shaft materials.

FIG. 11 is a graph showing the relationship between $10^5$ hour creep rupture strength and rupture temperature. The cast steel No. 7 according to the present invention sufficiently satisfies the required strength at a temperature below 640° C.

The high pressure and the intermediate pressure inner casings described in Embodiment 1 and the main steam stop valve 69 and the control valve 70 connected thereto by welding 71, as shown in FIG. 12, were obtained by melting a raw alloy material of 1 ton having the target composition for the heat resisting cast steel according to the present invention using an electric furnace, degassing by ladle refining, and then casting in a sand mold.

The above cast steel was subjected to annealing heat treatment of 1050° C.×8 h furnace cooling, normalizing treatment of 1050° C.×8 h air blowing cooling, and two operations of annealing of 730° C.×8 h furnace cooling. The test casing having a totally annealed martensitic structure was inspected by cutting. As a result, it was confirmed that the cast steel satisfied the characteristics (625° C., $10^5$ h strength≧9 kgf/mm$^2$, 20° C. impact absorption energy≧1 kg-m) required for the high temperature high pressure steam turbine casing used under a pressure of 250 atmospheric pressure and at a temperature of 625° C., and was weldable.

Table 12 and Table 13 show chemical compositions of test pieces used in the various tests described above. The test piece was manufactured, assuming thick thickness portions of a large sized casing, by melting a raw material of 200 kg using a high frequency induction melting furnace, casting the melted steel into a sand mold having a maximum thickness of 200 mm, a width of 380 mm and a height of 440 mm to produce an ingot. The test pieces No. 8 and No. 9 in Table 13 are made of reference materials, and the test pieces No. 10 to No. 12 are made of materials of the present invention.

TABLE 11

| TP | TENSILE STRENGTH (kg/mm$^2$) | ELON-GATION (%) | CON-TRACTION (%) | IMPACT ABSORPTION ENERGY (kg-m) | 625° C., $10^5h^5$ CREEP RUPTURE STRENGTH (kg/mm$^2$) | OCCURRENCE OF WELDING CRACK |
|---|---|---|---|---|---|---|
| 1 | 67.4 | 22.3 | 68.5 | 2.1 | 3 | NO |
| 2 | 71.0 | 18.0 | 59.9 | 1.9 | 6 | NO |
| 3 | 72.8 | 19.7 | 64.8 | 2.1 | 9.7 | YES |
| 4 | 72.6 | 20.9 | 65.8 | 4.1 | 10.5 | NO |
| 5 | 70.8 | 20.3 | 62.7 | 4.5 | 8.8 | — |
| 6 | 73.5 | 20.8 | 64.8 | 4.4 | 10.5 | NO |
| 7 | 73.7 | 22.0 | 65.3 | 5.3 | 10.8 | NO |

TP: test piece

TABLE 12

| No. | C | Si | Mn | Ni | Cr | Mo | W | V | Nb | B | N | O | Cr EQUIVALENT | Ni/W | W/Mo | Mo/Cr |
|---|---|---|---|---|---|---|---|---|---|---|---|---|---|---|---|---|
| 8 | 0.11 | 0.19 | 0.53 | 0.60 | 9.23 | 0.65 | 1.62 | 0.19 | 0.04 | 0.0013 | 0.0334 | 0.0264 | 8.79 | 0.37 | 2.49 | 0.070 |
| 9 | 0.12 | 0.21 | 0.51 | 0.58 | 9.27 | 0.63 | 1.59 | 0.22 | 0.04 | 0.0010 | 0.0310 | 0.0191 | 8.96 | 0.36 | 2.52 | 0.068 |
| 10 | 0.13 | 0.18 | 0.49 | 0.64 | 9.31 | 0.66 | 1.63 | 0.20 | 0.04 | 0.0013 | 0.0350 | 0.0149 | 8.05 | 0.39 | 2.47 | 0.071 |
| 11 | 0.11 | 0.19 | 0.53 | 0.60 | 9.15 | 0.65 | 1.65 | 0.22 | 0.05 | 0.0012 | 0.0332 | 0.0095 | 9.14 | 0.36 | 2.54 | 0.071 |
| 12 | 0.10 | 0.20 | 0.52 | 0.62 | 9.23 | 0.65 | 1.60 | 0.21 | 0.04 | 0.0013 | 0.0334 | 0.0032 | 9.38 | 0.38 | 2.46 | 0.070 |

TABLE 13

| No. | TENSILE STRENGTH (kgf/mm$^2$) | ELONGATION (%) | CONTRACTION (%) | IMPACT ABSORPTION ENERGY $vE_0$(kgf-m) | 625° C., $10^5$ h CREEP RUPTURE STRENGTH (kgf/mm$^2$) |
|---|---|---|---|---|---|
| 8 | 71.9 | 20.1 | 60.5 | 0.35 | 6.1 |
| 9 | 72.1 | 19.6 | 54.7 | 0.50 | 7.8 |
| 10 | 71.8 | 22.3 | 65.4 | 1.10 | 9.5 |
| 11 | 71.5 | 21.9 | 65.6 | 3.90 | 10.9 |
| 12 | 72.0 | 23.0 | 66.6 | 5.80 | 10.7 |

Each of the test pieces was subjected to annealing treatment of 1050° C.≧8 h and furnace cooling, and then were heat treated (normalizing treatment and tempering treatment) simulating a thick thickness portion of a large steam turbine casing under the following conditions.

Test pieces of No. 8 to No. 12:

1050° C.×8 h air cooling

720° C.×7 h air cooling

720° C.×7 h furnace cooling

A weldability evaluation using these casing materials was performed based on JIS Z3158. FIGS. 13(*a*) to 13(*c*) shows the test piece shape and size. Temperatures for preheating, inter-pass and initiation of post-heating were set to 150° C. and post-heating treatment was performed in a condition of 400° C.×30 minutes.

Figure 14:
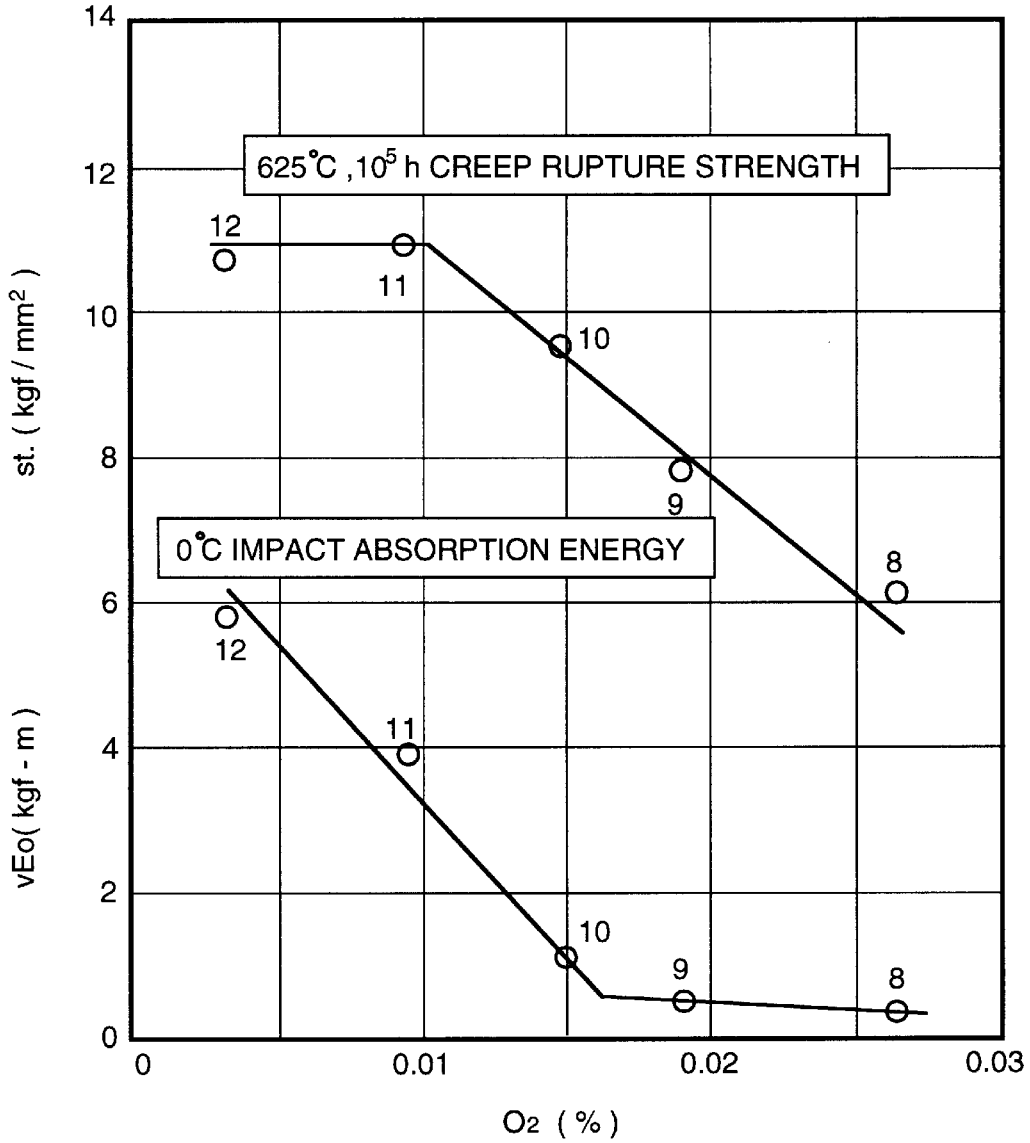
FIG. 14 is a graph showing the relationships between amount of O and creep rupture strength, and impact value.

FIG. 14 is a graph showing the effect of element O on the mechanical properties. When the content of O is increased, the creep rupture strength and the impact absorption energy are decreased. By decreasing the amount of O to a value lower than 0.015%, the required strength and the required impact value can be obtained.

The creep rupture strength and the impact absorption energy of the materials No. 10 to No. 12 according to the present invention having proper amounts of B, Mo and W to sufficiently satisfy the characteristics (625° C., $10^5$h strength≧9 kgf/mm$^2$, 20° C. impact absorption energy≧1 kg-m) required for the high temperature high pressure steam turbine casing. Further, by adding Ta of 0.08% and Zr of 0.05%, the toughness at 20° C. became better. Further, no welding crack was observed in the material having a content of B below 0.0025% according to the present invention, that is, the weldability was excellent. Welding cracks were observed in the material having a content of B above 0.003%. As to the effect of element Mo on the mechanical properties, the reference alloy containing mo in an amount above 1.5% was low in impact value and could not satisfy the required toughness, though the creep rupture strength was high. On the other hand, the reference alloy containing Mo in an amount below 0.5% was low in creep rupture strength and could not satisfy the required strength, though the toughness was high.

When the ratio Ni/W is increased too high, the creep rupture strength is decreased. On the contrary, when the ratio Ni/W is decreased too low, the impact absorption energy at room temperature is decreased. By adjusting the ratio Ni/W to 0.25 to 0.75, it is possible to obtain a heat resisting cast steel casing material having a creep rupture strength at 625° C. for $10^5$ h of above 9 kgf/mm$^2$ and an impact absorption energy at room temperature of above 1 kgf-m, which are required for the high pressure and the intermediate pressure inner casings and the main steam stop valve and the control valve casings of the high temperature high pressure steam turbines operating under a condition of a temperature above 621° C. and a pressure above 250 kgf/cm$^2$. Especially, by adjusting the content of W to 1.2 to 2% and the ratio Ni/W to 0.25 to 0.75, it is possible to obtain an excellent heat resisting cast steel casing material having a creep rupture strength at 625° C. for $10^5$ h of above 10 kgf/mm$^2$ and an impact absorption energy at room temperature of above 2 kgf-m.

(Embodiment 4)

In this embodiment, the steam temperatures of the high pressure steam turbine and the intermediate pressure steam turbine are changed to 649° C. from the temperature of 625° C. in Embodiment 1, and the construction and the size are designed to be nearly the same as Embodiment 1. The different points from Embodiment 1 are the rotor shafts, the first stage rotating blades and the first stage fixed blades and the inner casings of the high pressure and the intermediate pressure steam turbines, which are directly in contact with the higher temperature steam. There is a large advantage in that the materials can satisfy the required strength and the conventional design can be applied only by increasing the content of B to 0.01 to 0.03% and the content of Co to 5 to 7 % in the materials shown in Table 7 described before in regard to the materials, except for the materials for the inner casing, and only by increasing the content of W to 2 to 3% and adding Co of 3% in the materials in Embodiment 1 in regard to the materials for the inner casing. That is, in this embodiment, although the first stage blades of the high pressure steam turbine exposed to high temperature are made of the Ni base alloy, all the others are made of ferritic steel. Therefore, the conventional design concept can be directly applied. Since the steam inlet temperature to the rotating blades and the fixed blades in the second stage becomes approximately 610° C., it is preferable that the material used for the first stage in Embodiment 1 is used also for the second stage.

Further, although the steam temperature of the low pressure steam turbine is approximately 405° C. and a little higher than that of approximately 380° C. in Embodiment 1, super-clean material can be used for the rotor shaft because the material for the rotor shaft itself in Embodiment 1 has a sufficient strength.

Further, instead of a cross-compound type connection in this embodiment, it is possible to employ a tandem compound type where all the turbines are directly connected and rotated at a speed of 3600 rpm.

According to the present invention, since a ferritic heat resisting cast steel having a high creep rupture strength at 625° C. and a high toughness at room temperature can be obtained, it is possible to manufacture an ultra-super critical pressure steam turbine casing for use at a temperature up to 650° C. and high temperature components of that kind using a ferritic heat resisting cast steel (material according to the present invention) instead of the conventional austenitic heat resisting cast steel.

By using the heat resisting cast steel according to the present invention for a turbine casing, instead of the conventional austenitic heat resisting cast steel, the turbine casing can be manufactured by the same design concept. Further, since the ferritic heat resisting cast steel according to the present invention has a small thermal expansion coefficient compared to that of the austenitic heat resisting cast steel, there is an advantage in that rapid starting-up of a steam turbine can be easily performed and the turbine hardly suffers thermal fatigue failure.

According to the present invention, with a martensitic heat resisting steel and cast steel having a high creep rupture strength-at a temperature of 610 to 660° C. and a high toughness at room temperature, all of the main components for an ultrahigh critical pressure steam turbine operating at high temperature can be manufactured using the ferritic heat resisting steel, and the conventional steam turbine basic design concept can be used as it is, and a highly reliable thermal power plant can be obtained.

In the past, an austenitic alloy had to be used for the components operated at such a high temperature. Therefore, from the standpoint of manufacturability, it was difficult to manufacture a sound large sized rotor. However, by using the ferritic heat resisting forged steel according to the present invention, it is possible to manufacture a sound large sized rotor.

Furthermore, since a high temperature steam turbine, of which most of the large sized components are made of the ferritic steel according to the present invention, does not have an austenitic alloy having a large thermal expansion coefficient, there is an advantage in that rapid starting-up of a steam turbine can be easily performed and the turbine hardly suffers thermal fatigue failure.

What is claimed is:

1. A high strength heat resisting cast steel which contains C of 0.06 to 0.16%, Si of not more than 1%, Mn of not more than 1%, Cr of 8 to 12%, Ni of 0.1 to 1.0%, V of 0.05 to 0.3%, Nb of 0.01 to 0.15%, N of 0.01 to 0.1%, Mo of not more than 1.5%, W of 1 to 3%, B of 0.0005 to 0.003% and necessarily includes O, and wherein said amount of O is not more than 0.010% in weight percentages.

2. A high strength heat resisting cast steel according to claim 1, wherein the content ratio of Ni to W, Ni/W, in the high strength heat resisting cast steel is 0.25 to 0.75.

3. A high strength heat resisting cast steel according to claim 1, which further contains at least one of Ta of not more than 0.15% and Zr of not more than 0.1%.

4. A high strength heat resisting cast steel according to claim 1, wherein a Cr equivalent calculated by the following equation is 4 to 10;

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}.$$

5. A high strength heat resisting cast steel according to claim 1, wherein the creep rupture strength at 625° C. for $10^5$ hours is not less than 9 kgf/mm$^2$ and the impact value at room temperature is not less than 3.2 kgf-m.

6. A high strength heat resisting cast steel which contains C of 0.09 to 0.14%, Si of not more than 0.3%, Mn of 0.40 to 0.70%, Cr of 8 to 10%, Ni of 0.4 to 0.7%, V of 0.15 to 0.25 %, Nb of 0.04 to 0.08%, N of 0.02 to 0.06%, Mo of 0.40 to 0.80%, W of 1.4 to 1.9%, B of 0.001 to 0.0025% and necessarily includes, O, and wherein said amount of O is not more than 0.010% in weight percentages and the remainder of Fe and inevitable impurities.

7. A method of manufacturing a high strength heat resisting cast steel, the method comprising the steps of melting a raw material having the composition according to claim 1 using an electric furnace, degassing by ladle refining, and casting the material in a sand mold to form a cast body.

8. A method of manufacturing a high strength heat resisting cast steel according to claim 7, the method comprising the steps of annealing the cast body at 1000 to 1150° C. after said casting, performing normalizing treatment by heating the fast body at 1000 to 1100° C. and rapidly cooling, it and then tempering it twice at a temperature 550 to 750° C. and at a temperature 670 to 770° C.

9. A steam turbine casing made of a cast steel which contains C of 0.06 to 0.16%, Si of not more than 1%, Mn of not more than 1%, Cr of 8 to 12%, Ni of 0.1 to 1.0%, V of 0.05 to 0.3%, Nb of 0.01 to 0.15%, N of 0.01 to 0.1%, Mo of not more than 1.5%, W of 1 to 3%, B of 0.0005 to 0.003% and necessarily includes O, and wherein said amount of O is not more than 0.010% in weight percentages.

10. A steam turbine casing made of a cast steel according to claim 9, wherein the content ratio of Ni to W, Ni/W, in the high strength heat resisting cast steel is 0.25 to 0.75.

11. A steam turbine casing made of a cast steel according to claim 9, which further contains at least one of Ta of not more than 0.15% and Zr of not more than 0.1%.

12. A steam turbine casing made of a cast steel according to claim 9, wherein a Cr equivalent calculated by the following equation is 4 to 10;

$$\text{Cr equivalent}=\text{Cr}+6\text{Si}+4\text{Mo}+1.5\text{W}+11\text{V}+5\text{Nb}-40\text{C}-30\text{N}-30\text{B}-2\text{Mn}-4\text{Ni}-2\text{Co}.$$

13. A steam turbine casing made of a cast steel according to claim 9, wherein the creep rupture strength under 625° C. for $10^5$ hours is not less than 9 kgf/mm$^2$ and the impact value at room temperature is not less than 3.2 kgf-m.

14. A steam turbine casing manufactured by melting an alloy raw material having a composition according to claim 9 using an electric furnace, degassing by ladle refining, and casting the material in sand mold to form a cast body.

15. A method of manufacturing a steam turbine casing according to claim 14, the method comprising the steps of annealing the cast body at 1000 to 1150° C. after said casting, performing normalizing treatment by heating the cast body at 1000 to 1100° C. and rapidly cooling it, and then tempering it twice at a temperature of 550 to 750° C. and at a temperature of 670 to 770° C., respectively.

16. A steam turbine casing made of a cast steel which contains C of 0.09 to 0.14%, Si of not more than 0.3%, Mn of 0.40 to 0.70%, Cr of 8 to 10%, Ni of 0.4 to 0.7%, V of 0.15 to 0.25 %, Nb of 0.04 to 0.08%, N of 0.02 to 0.06%, Mo of 0.40 to 0.80%, W of 1.4 to 1.9%, B of 0.001 to 0.0025% and necessarily includes, O, and wherein said amount of O is not more than 0.010% in weight percentages and the remainder of Fe and inevitable impurities.

17. A steam turbine power plant having a high pressure steam turbine, an intermediate pressure steam turbine and a low pressure steam turbine, wherein the inlet steam temperature to the rotating blades in the first stages of said high pressure steam turbine and said intermediate pressure steam turbine is 610 to 660° C.; the inlet steam temperature to the rotating blades in the first stage of said low pressure steam turbine is 380 to 475° C.; rotor shafts, rotating blades and fixed blades, at least in the first stages exposed to said inlet steam temperature, and inner casings of said high pressure steam turbine and said intermediate pressure steam turbine are made of a high strength martensitic steel containing Cr of 8 to 13 weight %, while other rotating blades thereof are made of a combination of said martensitic steel and a Ni base alloy; and said inner casings having a creep rupture strength at a temperature corresponding to said steam temperature for $10^5$ hours of not less than 9 kg/mm$^2$ and an impact value at room temperature of not less than 3.2 kg-m.

18. A power plant according to claim 17, wherein said low pressure steam turbine has a rotor shaft, rotating blades implanted onto said rotor shaft, fixed blades for guiding steam flow to said rotating blades and an inner casing supporting said fixed blades, having more than eight stages of said rotating blades arranged symmetrically in a right hand side and a left hand side, the first stages of said rotating blades being implanted in the middle portion of said rotor shaft to form a double flow construction, said rotor shaft having a distance (L) between bearing centers of not less than 7000 mm and a minimum diameter (D) at portions having said fixed blades of not less than 1150 mm, the ratio (L/D) being 5.4 to 6.3, said rotor shaft being made of a Ni—Cr—Mo—V low alloy steel containing Cr of 1 to 2.5 weight % and Ni of 3.0 to 4.5 weight %, said rotating blades in the last stage having a length of not shorter than 40 inches and being made of a Ti base alloy.

19. A power plant according to claim 17, wherein said low pressure steam turbine has a rotor shaft, rotating blades implanted onto said rotor shaft, fixed blades for guiding steam flow to said rotating blades and an inner casing supporting said fixed blades, the inlet temperature of the steam to said rotating blades in the first stage being 380 to 450° C., said rotor shaft being made of a low alloy steel containing C of 0.2 to 0.3%, Si of not more than 0.05%, Mn of not more than 0.1%, Ni of 3.0 to 4.5%, Cr of 1.25 to 2.25 %, Mo of 0.07 to 0.20%, V of 0.07 to 0.2%, and Fe of not less than 92.5% in weight percentages.

20. A steam turbine having a rotor shaft, rotating blades implanted onto said rotor shaft, fixed blades for guiding steam flow to said rotating blades and an inner casing supporting said fixed blades, said steam flowing to the first stage of said rotating blades having a temperature of 610 to 660° C. and a pressure not lower than 150 kg/cm$^2$, wherein said rotor shafts, the rotating blades and fixed blades at least in the first stages are made of a high strength martensitic steel having a martensitic structure containing Cr of 9 to 13 weight %, said high strength martensitic steel having a creep rupture strength at a temperature corresponding to said steam temperature for 1 hours of not less than 15 kg/mm$^2$, while other rotating blades therefore are made of a combination of said martensitic steel and a Ni base alloy having a tensile strength at room temperature not less than 90 kg/mm$^2$; said inner casing being made of a martensitic steel containing Cr of 8 to 12 weight % having a creep rupture strength at a temperature corresponding to said steam temperature for $10^5$ hours of not less than 9 kg/mm$^2$ and an impact value at room temperature of not less than 3.2 kg-m.

21. A steam turbine according to claim 20, wherein said pressure is 200 kg/cm$^2$ or 250 kg/cm$^2$.

22. A steam turbine having a rotor shaft, rotating blades implanted onto said rotor shaft, fixed blades for guiding steam flow to said rotating blades and an inner casing supporting said fixed blades, wherein said rotor shaft and said fixed blades at least in the first stage are made of a high strength martensitic steel containing C of 0.05 to 0.20%, Si of not more than 0.15%, Mn of 0.03 to 1.5%, Cr of 9.5 to 13%, Ni of 0.05 to 1.0%, V of 0.05 to 0.35%, Nb of 0.01 to 0.20%, N of 0.01 to 0.06%, Mo of 0.05 to 0.5%, W of 1.0 to 3.5%, Co of 2 to 10%, B of 0.0005 to 0.03%, and having Fe of not less than 78% in weight percentages; said rotating blades being made of a combination of said martensitic steel and a Ni base alloy containing C of 0.03 to 0.15%, Si of not more than 0.3%, Mn of not more than 0.2%, Cr of 12 to 20%, Mo of 9 to 20%, Al of 0.5 to 1.5%, Ti of 2 to 3%, B of 0.003 to 0.015% in weight percentage; said inner casing being made of a high strength martensitic steel containing C of 0.06 to 0.16%, Si of not more than 0.5%, Mn of not more than 1%, Ni of 0.2 to 1.0%, Cr of 8 to 12%, V of 0.05 to 0.35%, Nb of 0.01 to 0.15%, N of 0.01 to 0.1%, Mo of not more than 1.5 %, W of 1 to 4%, B of 0.0005 to 0.003%, O of not more than 0.015%, and having Fe of not less than 85% in weight percentages.

23. A high pressure steam turbine having a rotor shaft, rotating blades implanted onto said rotor shaft, fixed blades for guiding steam flow to said rotating blades and an inner casing supporting said fixed blades, wherein the first stage of said rotating blades is of a double flow construction and more than seven stages of said rotating blades, except for the first stage, are provided in one side, said rotor shaft having a distance (L) between bearing centers of not less than 5000 mm and a minimum diameter (D) at portions having said fixed blades of not less than 600 mm, the ratio (L/D) being 8.0 to 9.0, some rotating blades and said rotor shaft being made of a high strength martensitic steel containing Cr of 9 to 13 weight %, and other rotating blades being made of a combination of some martensitic steel and a Ni base alloy, said inner casing being made of a martensitic cast steel containing Cr of 8 to 12 weight % and having a creep rupture strength at a temperature corresponding to said steam temperature for $10^5$ hours of not less than 9 kg/mm and an impact value at room temperature of not less than 3.2 kg-m.

24. An intermediate pressure steam turbine having a rotor shaft, rotating blades implanted onto said rotor shaft, fixed blades for guiding steam flow to said rotating blades and an inner casing supporting said fixed blades, wherein more than six stages of said rotating blades are symmetrically provided in right hand side and left hand side and the first stages of said rotating blades are implanted in the middle portion of said rotor shaft to form a double flow construction, said rotor shaft having a distance (L) between bearing centers of not less than 5000 mm and a minimum diameter (D) at portions having said fixed blades of not less than 600 mm, the ratio (L/D) being 8.2 to 9.2, rotating blades and said rotor shaft being made of a high strength martensitic steel containing Cr of 9 to 13 weight %, otherwise said rotating blades being made of a combination of said martensitic steel and a Ni base alloy, said inner casing being made of a martensitic cast steel containing Cr of 8 to 12 weight % and having a creep rupture strength at a temperature corresponding to said steam temperature for 10 hours of not less than 9 kg/mm2 and an impact value at room temperature of not less than 3.2 kg-m.

25. A steam turbine power plant having a high pressure steam turbine and an intermediate pressure steam turbine connected to two low pressure steam turbines connected to each other in tandem, wherein the inlet steam temperature to the rotating blades in first stages of said high pressure steam turbine and said intermediate pressure steam turbine is 610 to 660° C.; the inlet steam temperature to the rotating blades in the first stage of said low pressure steam turbine being 380 to 475° C.; the metal temperature of a portion of the rotor shaft implanting first stage rotating blades and said first stage rotating blades of said high pressure steam turbine being maintained so as to not become lower than a temperature of 40° C. below the inlet steam temperature to the first stage rotating blades of said high pressure steam turbine; the metal temperature of a portion of the rotor shaft implanting first stage rotating blades and said first stage rotating blades of said intermediate pressure steam turbine being maintained so as to not become lower than a temperature of 75° C. below the inlet steam temperature to the first stage rotating blades of said intermediate pressure steam turbine; the rotor shafts and some rotating blades of said high pressure steam turbine and said intermediate pressure steam turbine being made of a martensitic steel containing Cr of 9.5 to 13 weight %, and other rotating blades at least in the first stage of said high pressure steam turbine and said intermediate pressure steam turbine being made of a combination of a Ni base alloy and said martensitic steel; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

26. A coal fired thermal power plant having a coal fired boiler, a steam turbine system driven by steam produced by said boiler, at most two electric power generators having an output power not less than 1000 MW produced by at least one unit driven by said steam turbine, wherein said steam turbine system includes a high pressure steam turbine, an intermediate pressure steam turbine and two low pressure steam turbines connected to said high pressure steam turbine; the inlet steam temperature to the rotating blades in the first stages of said high pressure steam turbine and said intermediate pressure steam turbine is 610 to 660° C.; the inlet steam temperature to the rotating blades in the first stage of said low pressure steam turbines being 380 to 450° C.; a super-heater of said boiler for heating steam to a temperature higher by 3° C. than said inlet steam temperature to the first stage rotating blades of said high pressure steam turbine and causing the super-heated steam to flow into the first stage rotating blades of said high pressure steam turbine; a re-heater of said boiler for heating inlet steam to a temperature higher by 2° C. than said inlet steam temperature to the first stage rotating blades of said intermediate pressure steam turbine by heating steam flowing out from said high pressure steam turbine and causing the re-heated steam to flow into the first stage rotating blades of said intermediate pressure steam turbine; an economizer of said boiler for heating inlet steam to a temperature higher by 3° C. than said inlet steam temperature to the first stage rotating blades of said low pressure steam turbine by heating the steam flow out from said intermediate pressure steam turbine and causing said steam to flow into the first stage rotating blades of said low pressure steam turbine; the rotor shafts and some rotating blades of said high pressure steam turbine and said intermediate pressure steam turbine being made of a martensitic steel containing Cr of 9.5 to 13 weight %, and other rotating blades at least in the first stage of said high pressure steam turbine and said intermediate pressure steam turbine being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

27. A high pressure steam turbine having a rotor shaft, rotating blades implanted onto said rotor shaft, fixed blades for guiding steam flow to said rotating blades and an inner casing supporting said fixed blades, wherein said rotating blades are composed of more than seven stages and the blade lengths are from 35 mm in the upstream side to 210 mm in the downstream side; the diameter of said rotor shaft in a portion implanting said rotating blade being larger than (a) the diameter in a portion corresponding to said fixed blades; the width in the shaft direction of said implanting portion being larger in the downstream side than in the upstream side stepwise; the ratio of the blade width to the blade length decreasing from 0.6 in the upstream side to 1.0 in the downstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to the steam temperature for $10^5$ hours of not less than 9 kg/mm$^2$ and an impact value at room temperature of not less than 3.2 kg-m.

28. A high pressure steam turbine having a rotor shaft, rotating blades implanted onto said rotor shaft, fixed blades for guiding steam flow to said rotating blades and an inner casing supporting said fixed blades, wherein said rotating blades are composed of more than seven stages and the blade lengths are from 35 mm in the upstream side to 210 mm in the downstream side; the ratio of the blade length in a stage to the blade length in an adjacent stage being less than 1.2, said ratio gradually increasing as the stage approaches the downstream side, and said blade length in the downstream side being larger than that in the upstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

29. A high pressure steam turbine having a rotor shaft, rotating blades implanted onto said rotor shaft, fixed blades for guiding steam flow to said rotating blades and an inner casing supporting said fixed blades, wherein said rotating blades are composed of more than seven stages and the blade lengths are from 35 mm in the upstream side to 210 mm in the downstream side; the width in the shaft direction of said rotor shaft in a portion corresponding to said fixed blade decreasing from the downstream side to the upstream side stepwise; the ratio of the blade length of said rotating blade in a stage to the blade length of an adjacent stage in the downstream side being in a range of 0.65 to 1.8, said ratio decreasing stepwise as the stage approaches the downstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for 10 hours of not less than 9 kg/mm, and an impact value at room temperature of not less than 3.2 kg-m.

30. An intermediate pressure steam turbine having a rotor shaft, rotating blades implanted onto said rotor shaft, fixed blades for guiding steam flow to said rotating blades and an inner casing supporting said fixed blades, wherein more than six stages of said rotating blades are symmetrically provided in a right hand side and a left hand side to form a double flow construction, the blade lengths of said rotating blades are 100 mm in the upstream side to 300 mm in the downstream side; the diameter of said rotor shaft in a portion implanting said rotating blade being larger than the diameter in a portion corresponding to said fixed blades; the width in the shaft direction of said implanting portion being stepwise larger in the downstream side than in the upstream side; the ratio of the blade width to the blade length decreasing from 0.45 in the upstream side to 0.75 in the downstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

31. An intermediate pressure steam turbine having a rotor shaft, rotating blades implanted onto said rotor shaft, fixed blades for guiding steam flow to said rotating blades and an inner casing supporting said fixed blades, wherein more than six stages of said rotating blades are symmetrically provided in a right hand side and a left hand side to form a double flow construction, blade lengths of said rotating blades are 100 mm in the upstream side to 300 mm in the downstream side; the ratio of the blade length in a stage to the blade length in an adjacent stage being less than 1.3, said ratio gradually increasing as the stage approaches to the downstream side; said blade length in the downstream side being larger than that in the upstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

32. An intermediate pressure steam turbine having a rotor shaft, rotating blades implanted onto said rotor shaft, fixed blades for guiding steam flow to said rotating blades and an inner casing supporting said fixed blades, wherein more than six stages of said rotating blades are symmetrically provided in a right hand side and a left hand side to form a double flow construction, the blade lengths of said rotating blades are 100 mm in the upstream side to 300 mm in the down stream side; the width in the shaft direction of said rotor shaft in a portion corresponding to said fixed blade decreasing from the downstream side to the upstream side stepwise; the ratio of the blade length of said rotating blade in a stage to the blade length of an adjacent stage in the downstream side being in a range of 0.45 to 1.60, said ratio decreasing stepwise as the stage approaches the downstream side; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

33. A high pressure steam turbine having a rotor shaft, rotating blades implanted onto said rotor shaft, fixed blades for guiding steam flow to said rotating blades and an inner casing supporting said fixed blades, wherein said rotating blades are composed of more than seven stages; the diameter of said rotor shaft in a portion corresponding to said fixed blades being smaller than the diameter in a portion implanting said rotating blades; the width in the shaft direction of said portion corresponding to said fixed blades increasing stepwise by more than two steps in the downstream side of said steam flow compared with the width in the upstream side; the distance between said rotating blades in the last stage and said rotating blades in a preceding stage being 0.75 to 0.95 times the distance between said rotating blades in the second stage and said rotating blades in the third stage; the width in the shaft direction of said implanting portion of said rotor shaft increasing stepwise by more than three steps in the downstream side compared to the width in the upstream side, said width in the last stage being 1 to 2 times the width in the shaft direction in the second stage; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

34. An intermediate pressure steam turbine having a rotor shaft, rotating blades implanted onto said rotor shaft, fixed blades for guiding steam flow to said rotating blades and an inner casing supporting said fixed blades, wherein said rotating blades are composed of more than six stages; the diameter of said rotor shaft in a portion corresponding to said fixed blades being smaller than the diameter in a portion implanting said rotating blades; the width in the shaft direction of said portion corresponding to said fixed blades increasing stepwise by more than two steps in the downstream side of said steam flow compared with the width in the upstream side; the distance between said rotating blades in the last stage and said rotating blades in a preceding stage being 0.6 to 0.8 times the distance between said rotating blades in the first stage and said rotating blades in the second stage; the width in the shaft direction of said implanting portion of said rotor shaft increasing stepwise by more than two steps in the downstream side compared to the width in the upstream side, the width in the last stage being 0.8 to 2 times the width in the shaft direction in the second stage; some rotating blades being made of a martensitic steel containing Cr of 9.5 to 13 weight %, and other rotating blades at least in the first stage being made of a combination of a Ni base alloy and said martensitic steel containing Cr of 9.5 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

35. A steam turbine having a rotor shaft, rotating blades implanted onto said rotor shaft, fixed blades for guiding steam flow to said rotating blades and an inner casing supporting said fixed blades, said steam flowing to the first stage of said rotating blades having a temperature of 610 to 660° C., wherein said rotor shaft and said inner casing are made of a martensitic steel containing Cr of 8 to 13 weight %; said inner casing being made of a martensitic cast steel containing Cr of 8 to 12 weight % and having a creep rupture strength at a temperature corresponding to said steam temperature for $10^5$ hours of not less than 9 kg/mm$^2$ and an impact value at room temperature of not less than 3.2 kg-m.

36. A steam turbine according to claim 35, wherein said rotor shaft is made of a high strength martensitic steel having totally a annealed martensitic structure containing Cr of 9 to 13 weight % and a creep rupture strength for $10^5$ hours of not less than 15 kg/mm$^2$.

37. A steam turbine according to claim 35, wherein at least one of said rotating blades in at least the first stage and said fixed blades at least in the first stage is made of a martensitic steel containing Cr of 8 to 13 weight % having a creep rupture strength at a temperature corresponding to the temperature of the steam flowing into said rotating blades in the first stage for $10^5$ hours of not less than 15 kg/mm$^2$ and a tensile strength at room temperature of not less than 90 kg/mm$^2$.

38. A steam turbine according to claim 35, wherein said rotating blades in at least the first stage is made of a Ni base precipitation hardening alloy having a tensile strength at room temperature of not less than 90 kg/mm.

39. A steam turbine according to claim 35, wherein said rotor shaft is made of a high strength martensitic steel containing C of 0.05 to 0.20%, Si of not more than 0.15%, Mn of 0.03 to 1.5%, Cr of 9.5 to 13%, Ni of 0.05 to 1.0%, V of 0.05 to 0.35%, Nb of 0.01 to 0.20%, N of 0.01 to 0.06%, Mo of 0.05 to 0.5%, W of 1.0 to 3.5%, Co of 2 to 10%, B of 0.0005 to 0.03%, and having Fe of not less than 78% in weight percentages; said inner casing being made of a high strength martensitic steel containing C of 0.06 to 0.16%, Si of not more than 0.5%, Mn of not more than 1%, Ni of 0.2 to 1.0%, Cr of 8 to 12%, V of 0.05 to 0.35%, Nb of 0.01 to 0.15%, N of 0.01 to 0.1%, Mo of not more than 1.5%, W of 1 to 4%, B of 0.0005 to 0.003%, O of not more than 0.015%, and having Fe of not less than 85% in weight percentages.

40. A steam turbine power plant having a high pressure steam turbine, an intermediate pressure steam turbine and a low pressure steam turbine, wherein the inlet steam temperature to the rotating blades in the first stages of said high pressure steam turbine and said intermediate pressure steam turbine is 610 to 660° C.; the inlet steam temperature to the rotating blades in the first stage of said low pressure steam turbine is 380 to 475° C.; rotor shafts, rotating blades and fixed blades, at least in the first stages exposed to said inlet steam temperature, and inner casings of said high pressure steam turbine and said intermediate pressure steam turbine are made of a high strength martensitic steel containing Cr of 8 to 13 weight %, while other rotating blades thereof are made of a combination of said martensitic steel and a Ni base alloy; and said inner casings having a creep rupture strength at a temperature corresponding to said steam temperature for $10^5$ hours of not less than 9 kg/mm$^2$ and an impact value at room temperature of not less than 3.2 kg-m, wherein said low pressure steam turbine has a rotor shaft, rotating blades implanted onto said rotor shaft, fixed blades for guiding steam flow to said rotating blades and an inner casing supporting said fixed blades, said rotating blades having more than eight stages arranged symmetrically in a right hand side and a left hand side to form a double flow construction, the blade lengths of said rotating blades increasing from 90 mm in the upstream side of said steam flow to 1300 mm in the down stream side; the diameter of said rotor shaft in a portion implanting said rotating blade being larger than the diameter in a portion corresponding to said fixed blades; the width in the shaft direction of said implanting portion being stepwise larger in the downstream side than in the upstream side; the ratio of the blade width to the blade length decreasing from 0.15 in the upstream side to 1.0 in the downstream side.

41. A steam turbine power plant having a high pressure steam turbine, an intermediate pressure steam turbine and a low pressure steam turbine, wherein the inlet steam temperature to the rotating blades in the first stages of said high pressure steam turbine and said intermediate pressure steam turbine is 610 to 660° C.; the inlet steam temperature to the rotating blades in the first stage of said low pressure steam turbine is 380 to 475° C.; rotor shafts, rotating blades and fixed blades, at least in the first stages exposed to said inlet steam temperature, and inner casings of said high pressure steam turbine and said intermediate pressure steam turbine are made of a high strength martensitic steel containing Cr of 8 to 13 weight %, while other rotating blades thereof are made of a combination of said martensitic steel and a Ni base alloy; and said inner casings having a creep rupture strength at a temperature corresponding to said steam temperature for $10^5$ hours of not less than 9 kg/mm$^2$ and an impact value at room temperature of not less than 3.2 kg-m, wherein said low pressure steam turbine has a rotor shaft, rotating blades implanted onto said rotor shaft, fixed blades for guiding steam flow to said rotating blades and an inner casing supporting said fixed blades, said rotating blades having more than eight stages arranged symmetrically in a right hand and a left hand side to form a double flow construction, the blade lengths of said rotating blades increasing from 90 mm in the upstream side of said steam flow to 1300 mm in the down stream side; the blade length in a stage in the downstream side being larger than that in an adjacent stage in the upstream side; the ratio of said blade length in a stage to the blade length in an adjacent stage being in the range of 1.2 to 1.7, said ratio gradually increasing as the stage approaches the downstream side.

42. A steam turbine power plant having a high pressure steam turbine, an intermediate pressure steam turbine and a low pressure steam turbine, wherein the inlet steam temperature to the rotating blades in the first stages of said high pressure steam turbine and said intermediate pressure steam turbine is 610 to 660° C.; the inlet steam temperature to the rotating blades in the first stage of said low pressure steam turbine is 380 to 475° C.; rotor shafts, rotating blades and fixed blades, at least in the first stages exposed to said inlet steam temperature, and inner casings of said high pressure steam turbine and said intermediate pressure steam turbine are made of a high strength martensitic steel containing Cr of 8 to 13 weight %, while other rotating blades thereof are made of a combination of said martensitic steel and a Ni base alloy; and said inner casings having a creep rupture strength at a temperature corresponding to said steam temperature for $10^5$ hours of not less than 9 kg/mm$^2$ and an impact value at room temperature of not less than 3.2 kg-m, wherein said low pressure steam turbine has a rotor shaft, rotating blades implanted onto said rotor shaft, fixed blades for guiding steam flow to said rotating blades and an inner casing supporting said fixed blades, said rotating blades having more than eight stages arranged symmetrically in a right hand side and a left hand side to form a double flow construction, the blade lengths of said rotating blades increasing from 90 mm in the upstream side of said steam flow to 1300 mm in the down stream side; the width in the shaft direction of said rotor shaft in a portion corresponding to said fixed blade decreasing from the downstream side to the upstream side stepwise; the ratio of the blade length of said rotating blade in a stage to the blade length of an adjacent stage in the downstream side being in a range of 0.2 to 1.4, said ratio decreasing stepwise as the stage approaches to the downstream side.

43. A steam turbine power plant having a high pressure steam turbine, an intermediate pressure steam turbine and a low pressure steam turbine, wherein the inlet steam temperature to the rotating blades in the first stages of said high pressure steam turbine and said intermediate pressure steam turbine is 610 to 660° C.; the inlet steam temperature to the rotating blades in the first stage of said low pressure steam turbine is 380 to 475° C.; rotor shafts, rotating blades and fixed blades, at least in the first stages exposed to said inlet steam temperature, and inner casings of said high pressure steam turbine and said intermediate pressure steam turbine are made of a high strength martensitic steel containing Cr of 8 to 13 weight %, while other rotating blades thereof are made of a combination of said martensitic steel and a Ni base alloy; and said inner casings having a creep rupture strength at a temperature corresponding to said steam temperature for $10^5$ hours of not less than 9 kg/mm$^2$ and an impact value at room temperature of not less than 3.2 kg-m, wherein said low pressure steam turbine has a rotor shaft, rotating blades implanted onto said rotor shaft, fixed blades for guiding steam flow to said rotating blades and an inner casing supporting said fixed blades, said rotating blades having more than eight stages arranged symmetrically in a right hand side and a left hand side to form a double flow construction, the diameter of said rotor shaft in a portion corresponding to said fixed blades being smaller than the diameter in a portion implanting said rotating blades; the width in the shaft direction of said portion corresponding to said fixed blades increasing stepwise by more than three steps in the downstream side of said steam flow compared with the width in the upstream side; the width between said rotating blades in the last stage and said rotating blades in the preceding stage being 1.5 to 2.5 times the distance between said rotating blades in the first stage and said rotating blades in the second stage; the width in the shaft direction of said implanting portion of said rotor shaft increasing stepwise by more than three steps in the downstream side compared to the width in the upstream side; said width in the last stage being 2 to 3 times the width in the shaft direction in the second stage.

44. A high strength heat resisting cast steel which contains C of 0.06 to 0.16%, Si of not more than 1%, Mn of not more than 1%, Cr of 8 to 12%, Ni of 0.1 to 1.0%, V of 0.05 to 0.3%, Nb of 0.01 to 0.15%, N of 0.01 to 0.1%, Mo of not more than 1.5%, W of 1 to 3%, B of 0.0005 to 0.003% and necessarily includes O, wherein said O is Present in an amount of not more than 0.010% in weight percentages, wherein the creep rupture strength at 625° C. for $10^5$ hours is not less than 9 kgf/mm$^2$ and the impact value at room temperature is not less than 3.2 kgf-m.

45. The high strength heat resistant cast steel according to claim 1, wherein said O is present in an amount greater than 0.0032% and not more than 0.010% in weight percentages.

46. The high strength heat resistant cast steel according to claim 3, wherein said O is present in an amount greater than 0.0032% and not more than 0.010% in weight percentages.

47. The high strength heat resistant cast steel according to claim 9, wherein said O is present in an amount greater than 0.0032% and not more than 0.010% in weight percentages.

48. The high strength heat resistant cast steel according to claim 11, wherein said O is present in an amount greater than 0.0032% and not more than 0.010% in weight percentages.

* * * * *